US008758203B2

(12) United States Patent
Thorpe

(10) Patent No.: US 8,758,203 B2
(45) Date of Patent: Jun. 24, 2014

(54) ISOMETRIC EXERCISE APPARATUS AND STORAGE RACK THEREFOR

(71) Applicant: Brad Thorpe, Toronto (CA)

(72) Inventor: Brad Thorpe, Toronto (CA)

( * ) Notice: Subject to any disclaimer, the term of this patent is extended or adjusted under 35 U.S.C. 154(b) by 0 days.

(21) Appl. No.: 13/750,305

(22) Filed: Jan. 25, 2013

(65) Prior Publication Data

US 2013/0143722 A1 Jun. 6, 2013

Related U.S. Application Data

(63) Continuation of application No. 13/137,686, filed on Sep. 2, 2011, now Pat. No. 8,376,917, which is a continuation of application No. 12/385,079, filed on Mar. 30, 2009, now Pat. No. 8,029,423.

(51) Int. Cl.
*A63B 21/002* (2006.01)
*A63B 21/00* (2006.01)

(52) U.S. Cl.
USPC ..... 482/91; 482/133

(58) Field of Classification Search
CPC ..... A63B 21/00; A63B 21/00047; A63B 21/002; A63B 21/0023; A63B 2021/00; A63B 2021/002
USPC ..... 482/91–94, 98–100, 133, 135–137, 482/139, 142, 145, 905, 907; 601/23, 601/33–35; 5/612; 211/85.7
See application file for complete search history.

(56) References Cited

U.S. PATENT DOCUMENTS 3,339,913 A 9/1967 Anderson
3,567,219 A 3/1971 Foster
3,662,602 A 5/1972 Weiss
3,891,207 A 6/1975 Helliwell
4,405,128 A 9/1983 McLaughlin et al.
4,487,413 A 12/1984 Fall
4,600,189 A 7/1986 Olschansky et al.
4,944,508 A 7/1990 Collins
5,044,505 A 9/1991 Spratt
5,538,487 A 7/1996 Fulmer (Continued)

OTHER PUBLICATIONS

International Search Report and Written Opinion issued by International Searching Authority in respect of International PCT Application No. PCT/CA2010/000388.

*Primary Examiner* — Oren Ginsberg
(74) *Attorney, Agent, or Firm* — Fasken Martineau DuMoulin LLP

(57) ABSTRACT

The present invention relates generally to exercise equipment and more specifically, to an isometric exercise apparatus and a storage rack therefor. The isometric exercise apparatus includes a frame which has a base and a sidewall joined to the base. The base has an exercise platform for supporting a user's body. Also provided is a restraint arm assembly connected to the frame. The arm restraint assembly includes a swing arm pivotally connected to the base, a restraint arm carried by the swing arm and positionable above the exercise platform to inhibit movement of a portion of the user's body so as to allow the user to perform isometric exercises. An indexing assembly is provided to fix the swing arm in a predetermined angular position selected from a set of discrete angular positions relative to the base. At least one limb restraint accessory is positionable at predetermined locations along the base for inhibiting movement of the user's limb so as to allow the user to perform isometric exercises. The apparatus can rapidly be adapted or configured to target a plurality of joint angles to work different muscle groups (or different muscles within the same muscle group) for an enhanced isometric workout.

19 Claims, 46 Drawing Sheets

(56) References Cited

U.S. PATENT DOCUMENTS

| | | | | |
|---|---|---|---|---|
| 5,603,681 | A | 2/1997 | Olschansky et al. | |
| 5,616,110 | A | 4/1997 | Nascimento | |
| 5,617,958 | A | 4/1997 | Laug et al. | |
| 5,810,702 | A | 9/1998 | Wilkinson | |
| 6,022,303 | A | 2/2000 | Abdo | |
| 6,036,624 | A | 3/2000 | Cascini | |
| 6,164,465 | A | 12/2000 | Schroeder | |
| 6,422,981 | B1 | 7/2002 | Riser | |
| 6,699,162 | B2 | 3/2004 | Chen | |
| 7,476,186 | B1 | 1/2009 | Steffee | |
| 7,678,033 | B2 | 3/2010 | Tyree | |
| 7,762,936 | B2 | 7/2010 | Conley et al. | |
| 8,029,423 | B2 * | 10/2011 | Thorpe | 482/91 |
| 8,376,917 | B2 * | 2/2013 | Thorpe | 482/91 |
| 2004/0209751 | A1 | 10/2004 | Thonn, Jr. | |
| 2005/0148448 | A1 | 7/2005 | Mersch | |
| 2006/0276311 | A1 | 12/2006 | Martin et al. | |
| 2010/0204027 | A1 | 8/2010 | Dauterive | |

* cited by examiner

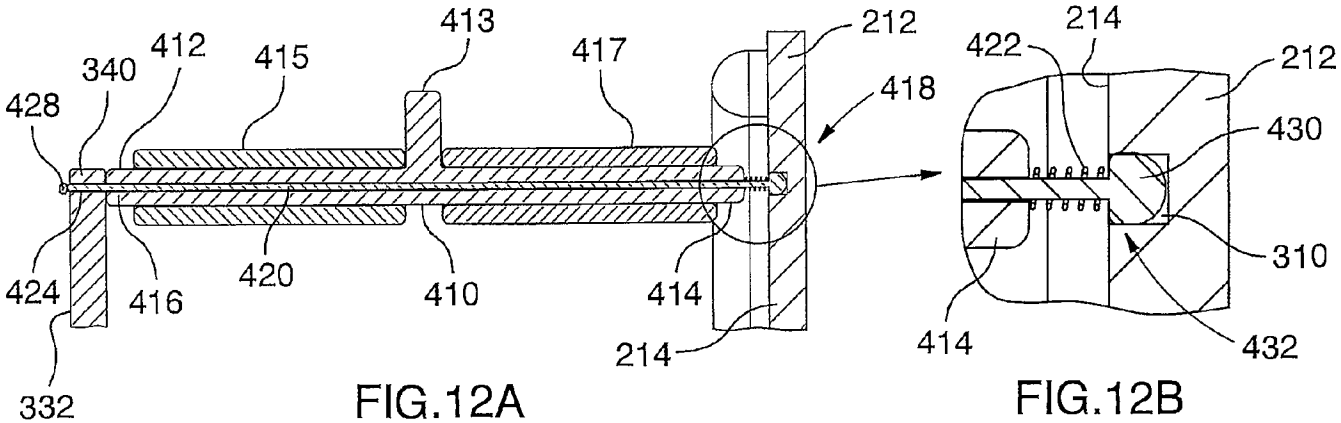
FIG.12A
FIG.12B
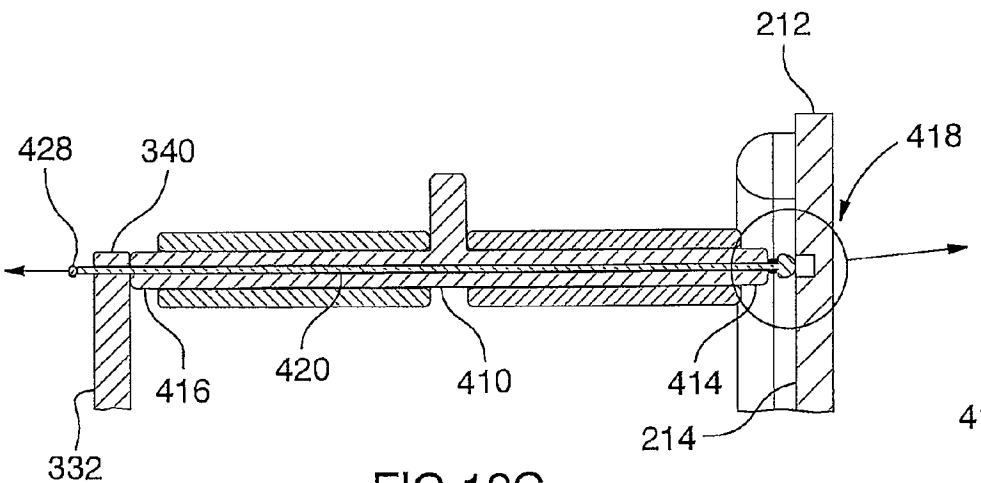
FIG.12C
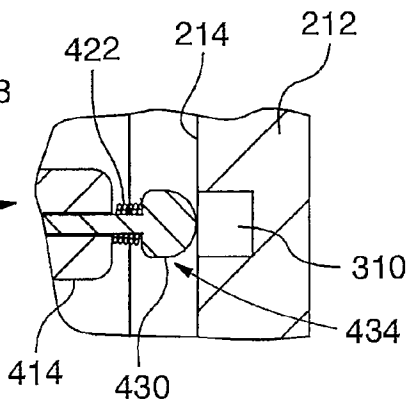
FIG.12D

ISOMETRIC EXERCISE APPARATUS AND STORAGE RACK THEREFOR

RELATED APPLICATION

This application is a continuation application of U.S. application Ser. No. 13/137,686 filed on Sep. 2, 2011 now issued to U.S. Pat. No. 8,376,917, which is a continuation of U.S. patent application Ser. No. 12/385,079 filed on Mar. 30, 2009 now issued to U.S. Pat. No. 8,029,423.

FIELD OF THE INVENTION

The present invention relates generally to exercise equipment and more specifically, to an isometric exercise apparatus and a storage rack therefor.

BACKGROUND OF THE INVENTION

A growing segment of the population suffers from obesity, hypertension and diabetes and other related health conditions, commonly referred to as lifestyle ailments or diseases. Such lifestyle ailments can be treated or avoided altogether with adequate exercise and a proper diet. As a result, people are increasingly seeking to maintain or achieve a healthy body weight and get fit through increased exercise. Such exercise may be obtained through participation in team or individual sports, or alternatively, by performing any of a variety of exercise regimens, protocols or programs which may include aerobic and/or anaerobic exercises.

Many exercise programs include strength training routines designed to stimulate muscle growth and increase muscular strength. Such routines have been shown to confer on the exercising individual several health benefits including: (1) increasing cardiovascular efficiency resulting in lower blood pressure and a decrease in heart disease; (2) increasing bone density resulting in a reduced risk of osteoporosis and arthritis; and (3) increasing metabolic activity resulting in sustainable fat loss. Some strength training routines require the exercising individual to perform certain dynamic or isotonic movements using free weights or specialized machines which target a specific muscle or muscle group and work it through a range of motion. During these dynamic movements, the length of the targeted muscle changes as the muscle is being contracted through the range of motion. The popularity of such routines has resulted in a great number of dynamic exercise machines having been developed and manufactured. Such equipment can now be seen in almost every health and fitness club across the country.

However, under certain circumstances, resistance training which involves dynamic movements (and the equipment employed to perform such exercises) can pose an increased risk of physical injury to the individual due to the inertia effect exerted by the equipment. Moreover, this type of resistance training may not be suitable for certain individuals, particularly those who are recovering from an existing injury or illness and are being rehabilitated.

Another type of strength training involves the performance of isometric exercises (also referred to as isometrics). During such exercises the joint angle and the length of the associated muscle do not change during contraction. Studies have shown that training with isometrics can increase peak muscle power up to thirty-two percent (32%) more than with dynamic movements and can increase muscular endurance up to one-hundred-and-twelve percent (112%) over what can be achieved with dynamic movements. Moreover, since isometrics tend to be inertia free, the risk of physical injury to the individual tends to be substantially mitigated thereby making such exercises more suitable for rehabilitative applications.

While the benefits of isometrics have been recognized for over fifty years, this form of training has not had the same popularity as that of dynamic resistance training. This may be due in part to the fact that very little equipment has been developed specifically for the performance of isometrics. Isometrics are usually performed by working the joint and muscle against an immovable force or restraint. Traditionally, this restraint has been provided by a structural item, such as a floor or a wall. However, while these types of restraints tend to be adequate for certain joint angles and muscles, it may be more difficult to properly work other joint angles and muscles isometrically using these restraints. Based on the foregoing, there is a real need for exercise equipment specifically designed for isometrics.

In light of the foregoing, it would be advantageous to have an isometric exercise apparatus which provides an external restraint source for a plurality of joint motions. Preferably, such an apparatus could be configured easily and quickly to create different types of restraint for enhanced versatility thereby offering the exercising individual the option to perform a variety of isometric exercises.

SUMMARY OF THE INVENTION

In accordance with one broad embodiment of the present invention, there is provided an isometric exercise apparatus includes a frame which has a base and a sidewall joined to the base. The base has an exercise platform for supporting a user's body. Also provided is a restraint arm assembly connected to the frame. The arm restraint assembly includes a swing arm pivotally connected to the base, a restraint arm carried by the swing arm and positionable above the exercise platform to inhibit movement of a portion of the user's body so as to allow the user to perform isometric exercises. An indexing assembly is provided to fix the swing arm in a predetermined angular position selected from a set of discrete angular positions relative to the base. At least one limb restraint accessory is positionable at predetermined locations along the base for inhibiting movement of the user's limb so as to allow the user to perform isometric exercises.

In another feature, the frame is collapsible. The base is hingedly connected to the sidewall. Additionally, the sidewall is moveable between a first, in-use position and a second, out-of-use position. When in the first, in-use position, the sidewall is oriented at least substantially perpendicular to the base. When in the second, out-of use position, the sidewall is collapsed against the base. In a further feature, the apparatus further includes locking means engageable with the base and the sidewall for maintaining the sidewall in the first, in-use position.

In yet another feature, the sidewall has a front face oriented towards the base and an opposing back face. The apparatus further includes at least one pad carried on the front face of the sidewall for cushioning a portion of the user's body. The at least one pad includes a first pad and a second pad spaced apart from the first pad.

In still a further feature, the base has a first side, a second side opposite the first side, a third side extending between the first and second sides, and a fourth side opposite the third side and extending between the first and second sides. The first side is provided with a first handle and the second side is provided with a first pair of spaced apart castors. Additionally, the third side is provided with a second handle and the fourth side is provided with a second pair of spaced apart castors.

In an additional feature, the at least one limb restraint attachment is a first limb restraint attachment. The apparatus includes a second limb restraint attachment releasably mounted to the exercise platform. In one feature, the second limb restraint attachment is a dual foot restraint attachment. In another feature, the second limb restraint attachment is a footpad.

In a further feature, the restraint arm assembly is releasably connected to the frame.

In yet another feature, the indexing assembly includes an indexing plate mounted to the base and an indexing pin releasably engageable with a portion of the indexing plate and a portion of the swing arm to fix the swing arm to the indexing plate. The indexing plate has a plurality of indexing apertures defined therein. Each indexing aperture corresponds to one of the predetermined angular positions. The swing arm has a first end pivotally connected to the base, a second end attached to the restraint arm and includes at a location intermediate the first and second ends a bore. The bore of the swing arm is alignable with one of the indexing apertures to allow insertion of the indexing pin therethrough. The plurality of indexing apertures is disposed in a semi-circular arrangement along the indexing plate. In still another feature, the indexing assembly is provided with locking means to prevent disengagement of the indexing pin from the indexing plate and the swing arm.

In an additional feature, the base has a length and width. The restraint arm extends generally parallel to the width of the base. Moreover, the restraint arm has a first portion attached to the swing arm and a second portion releasably connected to the sidewall. In a further feature, the sidewall has defined therein a plurality of indexing bores. Each indexing bore corresponds to one of the predetermined angular positions and is configured to receive the second portion of the restraint arm. The restraint arm includes a tubular body and a retractable locking pin assembly housed within the tubular body. The locking pin assembly includes a locking pin provided with a tip. The tip defines the second portion of the restraint arm configured for insertion into one of the indexing bores of the sidewall. The locking pin is moveable between an engaged position and a retracted position. When in the engaged position, the locking pin engages the sidewall and its tip is received within one of the indexing bores and when in the retracted position, the locking pin is disengaged from the sidewall. In an additional feature, the locking pin is biased in the engaged position.

In still another feature, the base includes a plurality of slots defined into the outer margins of the base. Each slot is disposed at one of the predetermined locations and configured to receive a portion of the at least one limb restraint attachment therein. Additionally, the base has a first side, a second side opposite the first side, a third side extending between the first and second sides, and a fourth side opposite the third side and extending between the first and second sides. The plurality of slots includes at least one slot disposed along the first side of the base, at least one slot disposed along the second side of the base and at least one slot disposed along the third side of the base.

In yet another feature, the base has a longitudinal axis and a transverse axis perpendicular to the longitudinal axis. At least some of the slots of the plurality are oriented generally perpendicular to the longitudinal axis of the base. In one additional feature, at least some of the slots of the plurality are oriented generally perpendicular to the transverse axis of the base. In another additional feature, at least some of the slots of the plurality are canted relative to the longitudinal axis of the base.

In still another feature, the at least one limb restraint attachment includes a connector arm and a retaining member. The connector arm has a first end and a second end for insertion into one of the plurality of slots. The retaining member is supported on the first end of the connector arm for restraining a portion of the user's limb. The retainer member has a shape selected from the group consisting of: (a) a U-shape; and (b) a C-shape. In an alternative feature, the retainer member may be formed with one of a partially open cuff and a fully closed cuff.

In a further feature, the retainer member is releasably connected to the connector arm. The retainer member is positionable on the connector arm in a first orientation and in a second orientation. The first orientation is substantially perpendicular to the second orientation. In an additional feature, the at least one limb restraint attachment further includes means for securing the second end of the connector within one of the plurality of slots. In yet another feature, the at least one limb restraint attachment is an arm restraint attachment.

In accordance with another broad embodiment of the present invention, there is provided an isometric exercise apparatus includes a frame which has a base and a sidewall joined to the base. The base has an exercise platform for supporting a user's body. Also provided, is a restraint arm assembly connectable to the frame. The restraint assembly includes a swing arm pivotally connectable to the base. A restraint arm is mountable to the swing arm and positionable above the exercise platform to inhibit movement of a portion of the user's body so as to allow the user to perform isometric exercises. An indexing assembly is provided for fixing the swing arm in a predetermined angular position selected from a set of discrete angular positions relative to the base. At least one limb restraint accessory is positionable at predetermined locations along the base for inhibiting movement of the user's limb so as to allow the user to perform isometric exercises.

In accordance with yet another broad embodiment of the present invention, there is provided a kit for an isometric exercise apparatus and storage rack therefor. The kit includes a collapsible frame having a base and a sidewall joined to the base. The base has an exercise platform for supporting a user's body. Also provided is a restraint arm assembly connectable to the frame. The restraint assembly includes a swing arm pivotally connectable to the base. A restraint arm is mountable to the swing arm and positionable above the exercise platform to inhibit movement of a portion of the user's body so as to allow the user to perform isometric exercises. An indexing assembly is provided for fixing the swing arm in a predetermined angular position selected from a set of discrete angular positions relative to the base. At least one limb restraint accessory is positionable at predetermined locations along the base for inhibiting movement of the user's limb so as to allow the user to perform isometric exercises. The kit further includes a rack structure for suspending the frame when in a collapsed state.

BRIEF DESCRIPTION OF THE DRAWINGS

The embodiments of the present invention shall be more clearly understood with reference to the following detailed description of the embodiments of the invention taken in conjunction with the accompanying drawings, in which:

FIG. 12*a* is a partial, enlarged cross-sectional view of the restraint arm of the restraint arm assembly illustrated in FIG. 9 with its locking pin shown engaged within one of the bores defined in the panel of the sidewall;

FIG. 12*b* is a magnified detail view of the encircled portion "12*b*" shown in FIG. 12*a;*

FIG. 12*c* is a partial, enlarged cross-sectional view of the restraint arm similar to that shown in FIG. 12*a*, except that the locking pin is now shown moved to its retracted, disengaged position;

FIG. 12*d* is a magnified detail view of the encircled portion "12*d*" shown in FIG. 12*c;*

DETAILED DESCRIPTION OF THE EMBODIMENTS OF THE INVENTION

Figure 1:
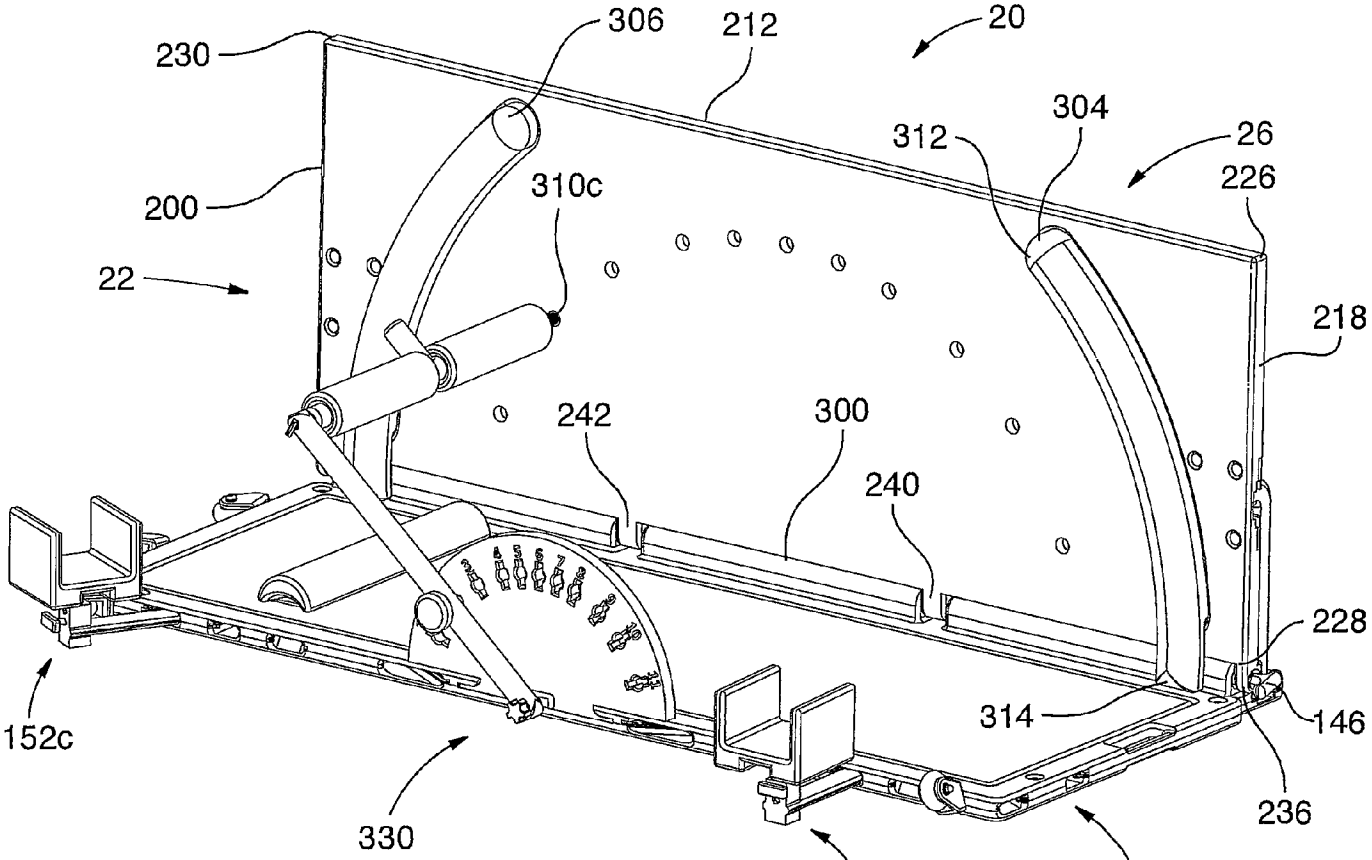
FIG. 1 is a front left perspective view of an isometric exercise apparatus depicted in a deployable, ready-to use configuration, with the sidewall of the apparatus frame shown in an upstanding position relative to the base of the apparatus frame, according to an embodiment of the present invention.

The description which follows, and the embodiments described therein are provided by way of illustration of an example, or examples of particular embodiments of principles and aspects of the present invention. These examples are provided for the purposes of explanation and not of limitation, of those principles of the invention. In the description that follows, like parts are marked throughout the specification and the drawings with the same respective reference numerals.

Referring to FIGS. 1 through 6, there is shown an apparatus for performing isometric exercises generally designated with reference numeral 20. The isometric exercise apparatus 20 has a frame 22 which includes a base 24 and a sidewall 26 hingedly connected to the base 24 along a portion thereof. The base 24 is designed for placement on a support surface such as a floor.

Figure 7:
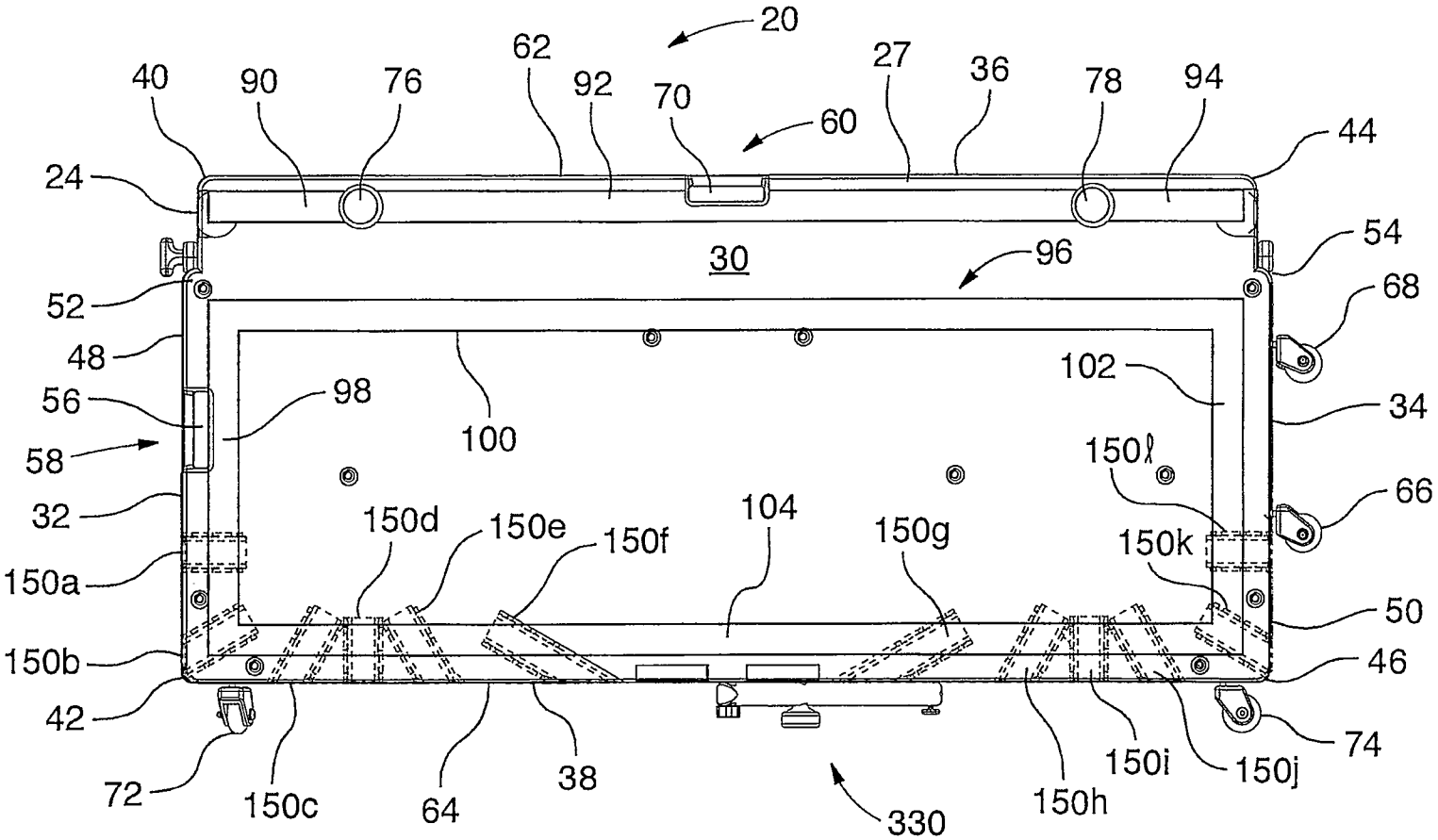
FIG. 7 is a bottom plan view of the base panel shown in FIG. 1 taken in isolation, with the plurality of motion restraint accessories omitted for clarity and a plurality of slots cut into the base shown in dashed lines.

The base 24 includes a substantially rectangular panel 27 provided with a top face 28 (see FIG. 3) and an opposed bottom face 30 (see FIG. 7). As best shown in FIG. 7, the shape of the panel 27 is defined by a pair of opposed, relatively short first and second sides 32 and 34, and a pair of opposed, relatively long, first and second sides 36 and 38 extending between the short sides 28 and 30. The first short side 32 meets the first long side 36 at a first radiused corner 40, and joins the second long side 38 at a second radiused corner 42. The two remaining corners of the panel 27—third and fourth radiused corners 44 and 46—are formed by the juncture of the second short side 34 and each of the first and second long sides 36 and 38, respectively. At a location approximately four-fifths of the way between the first and second long sides 36 and 38 proximate the first and third corners 40 and 44, the outer edges 48 and 50 of the first and second short sides 32 and 34 come in a short distance toward each other to define shoulder portions 52 and 54. Beyond the shoulder portions 52 and 54, the outer edges 48 and 50 are parallel to each other as they extend toward their respective corners 40 and 44.

The panel 27 may be constructed of a relatively rigid, ABS plastic. It will however be appreciated that other materials selected for their relatively light weight and their enhanced stiffness, strength and wear resistance characteristics, may be used to make the base 24 as well, for instance, polyvinylchloride (PVC) or polypropylene. The panel 27 may be fabricated with a number of weight reducing holes or apertures defined therein to facilitate transport and handling of the isometric exercise apparatus 20 and to enhance its portability.

In the preferred embodiment, the base 24 has a length $L_1$ which measures seventy-two (72) inches, and a width $W_1$ which measures thirty-three (33) inches, wherein the length $L_1$ is measured between the outer edges 48 and 50 at the second and fourth corners 42 and 46 and the $W_1$ is measured between the outer edges 62 and 64 at the third and fourth corners 44 and 46. The length $L_1$ and the width $W_1$ of the base 24 are selected to accommodate the body shape and size of a plurality of different users of the isometric exercise apparatus 20. Of course, the dimensions of the base 24 could be adjusted to suit a particular application or type of user.

As best shown in FIG. 7, inwardly of the outer edge 48 and at a location closer to the shoulder portion 52 than to the corner 42, there is a generally rectangular aperture 56 which extends between the top and bottom faces 28 and 30 of the base 24. The aperture 56 is sized to allow the fingers of a person's hand to extend therethrough. In this manner, a first handle 58 fashioned by the outer edge 48 and the aperture 58, is incorporated into the first short side 32. Disposed opposite the first handle 58, is a pair of spaced apart castors 66 and 68 which are attached to the outer edge 50 of the second short side 34. The first handle 58 may be grasped by an individual and when used in conjunction with castors 66 and 68 may be used to facilitate transport of the apparatus 20 or the base 24 from one location to another.

The frame 22 is further provided with a second handle 60 incorporated into the first long side 36 midway between the first and third corners 40 and 44. In like fashion to the first handle 58, the second handle 60 is formed by the outer edge 62 of the first long side 36 and a generally rectangular aperture 70 extending between the top and bottom faces 28 and 30 of the base 24. A pair of castors 72 and 74 disposed opposite the second handle 60 is attached to the outer 64 of the second long side 38. Thus arranged, the second handle 60 can be used in conjunction with the castors 72 and 74 to roll the apparatus 20 to a desired location.

Figure 22:
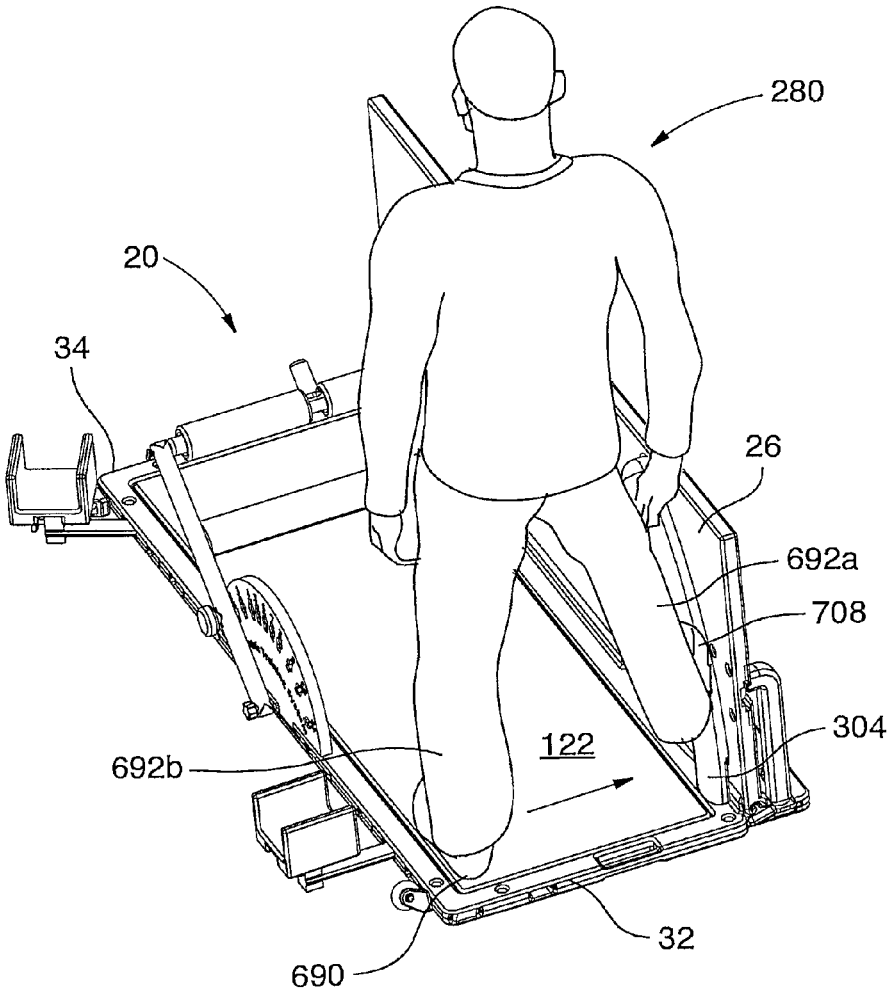
FIG. 22 is a perspective view of a user positioned within the isometric exercise apparatus of FIG. 1, shown performing an isometric exercise utilizing the sidewall as a restraint to urge contraction of the one of the user's hip flexor muscles.
Figure 23:
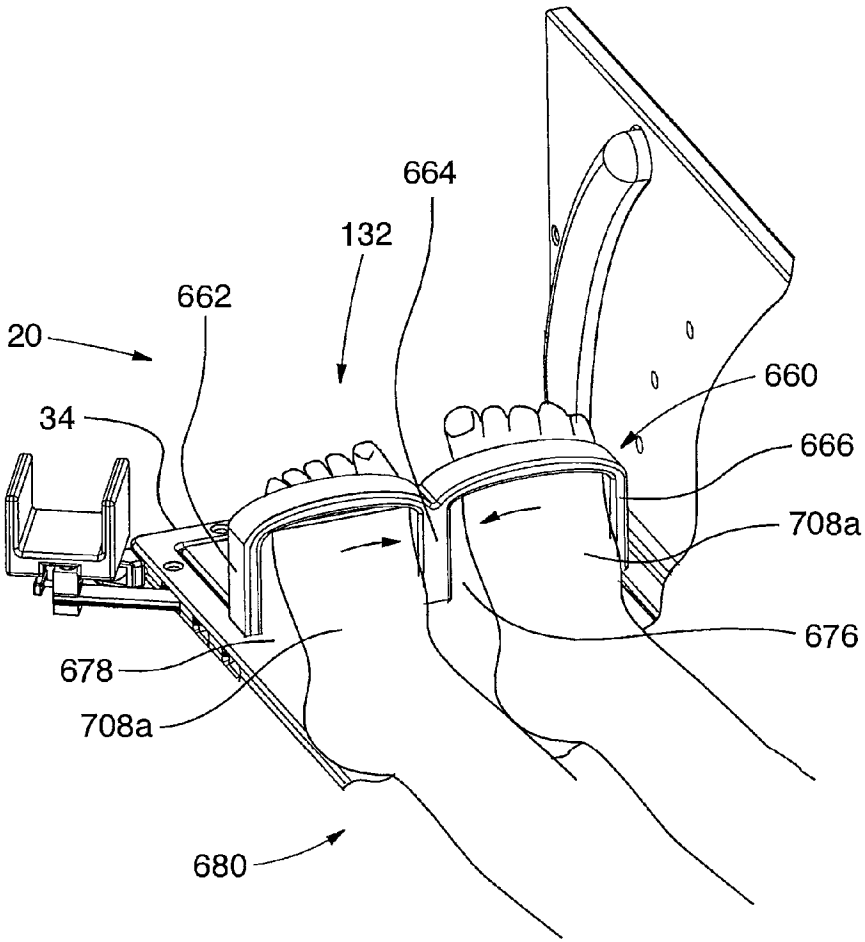
FIG. 23 is a partial perspective view of a user positioned within the isometric exercise apparatus of FIG. 1, shown performing an isometric exercise utilizing the dual foot restraint attachment as a restraint to urge contraction of certain of the user's lower leg muscles.

Relatively large, first and second bores 76 and 78 are located on either side of the second handle 60 at spaced apart locations. The first bore 76 is disposed near the first corner 40, while the second bore 78 is formed near the third corner 44. Each bore 76, 78 is sized to receive a support arm 82, 84 of a rack 80 (as best shown in FIGS. 22 and 23). As will be explained in greater detail below, the isometric exercise apparatus 20 may be hung on the rack 80 from the support arm 82 and 84, for storage when not in use.

As shown in FIG. 7, the bottom face 30 is provided with several grip-enhancing bands or strips 90, 92, 94 and 96. These bands tend to increase the friction which exists between the base 24 and the support surface (not shown) and tends to mitigate the risk that the isometric exercise apparatus 20 will move or shift during use. The first band 90 is relatively short and generally rectangular. It runs between the first corner 40 and the first bore 66. The second band 92 is also generally rectangular but is relatively longer than the first band 90, as it extends between the first and second bores 76 and 78. Midway between the bores 76 and 78, the width of the second band 92 narrows to accommodate the second handle 60. The third band 94 is generally similar in size and shape to the first band 90 and extends between the second bore 78 and the third corner 44. The fourth band 96 is configured differently than the others in that it is built up of four portions 98, 100, 102 and 104 which are configured to frame a rectangular space 108.

In this embodiment, the bands 90, 92, 94 and 96 are fixed to the bottom face of the base 24 with an adhesive. However, this need not be the case in every application. In other embodiments, the grip-enhancing bands could be attached to the base using hook and loop fasteners or other types of fasteners.

Figure 2:
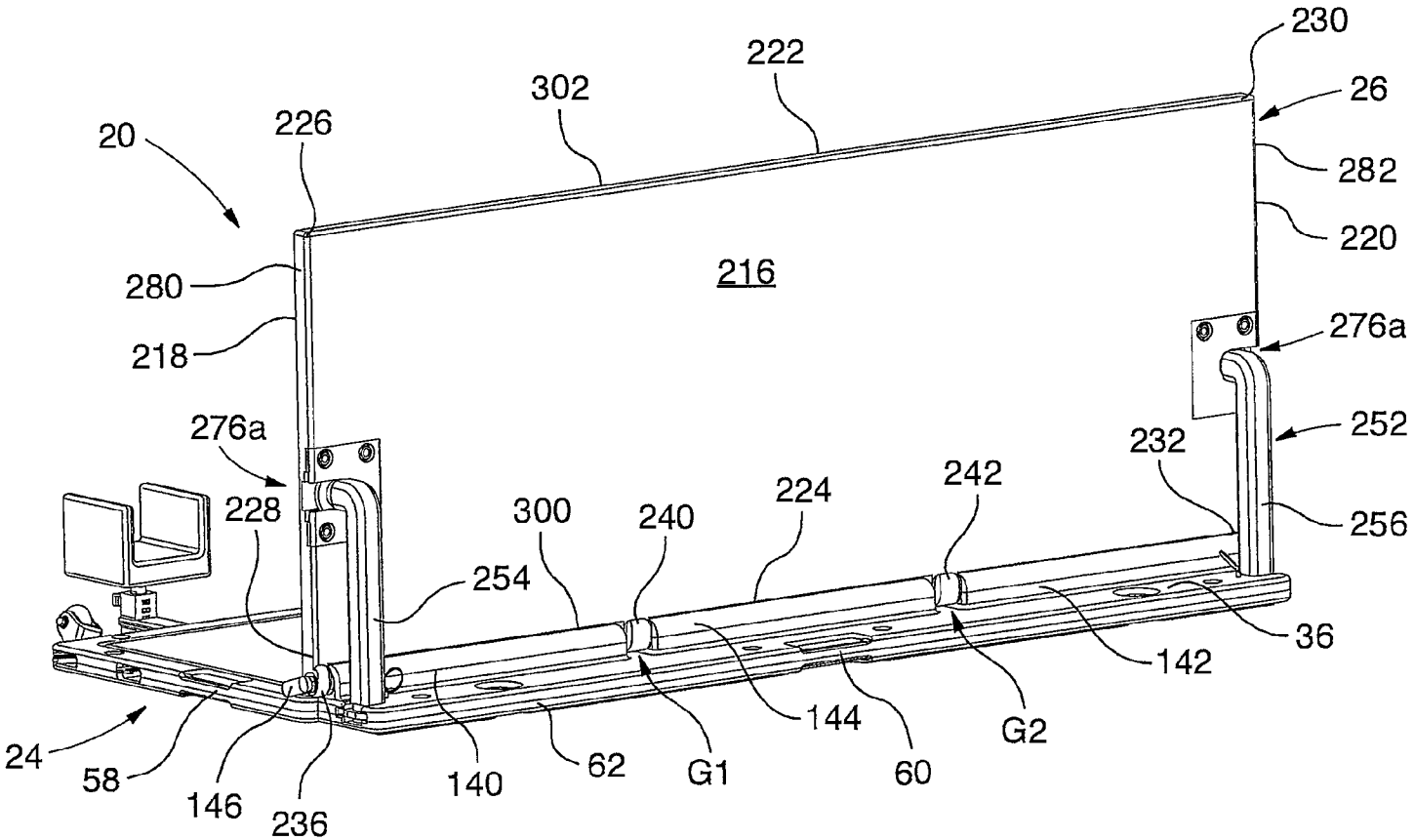
FIG. 2 is a rear right perspective view of the isometric exercise apparatus shown in FIG. 1.
Figure 3:
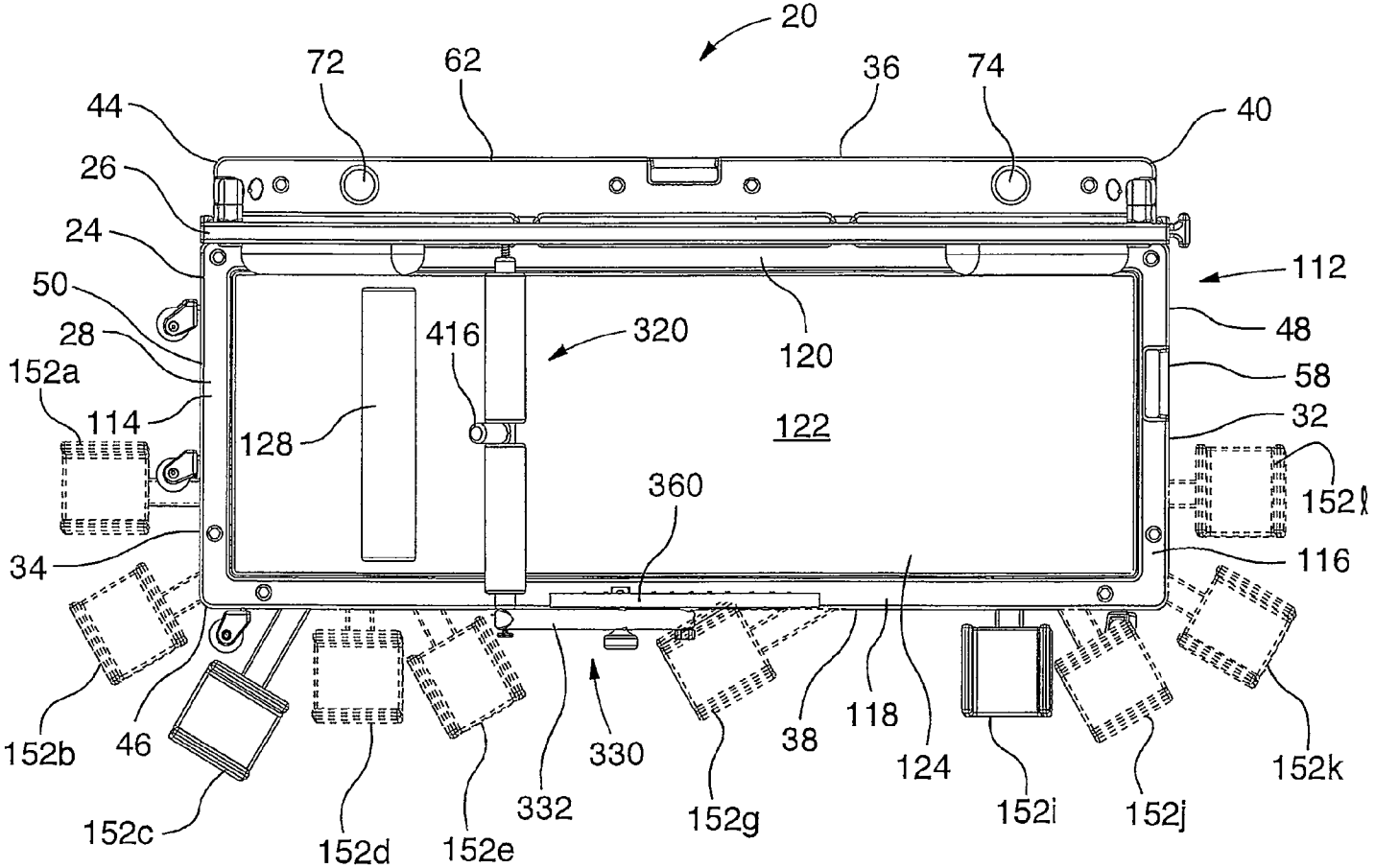
FIG. 3 is a top plan view of the isometric exercise apparatus illustrated in FIG. 1 with a plurality of motion restraint accessories (shown in dashed lines) attached to the outer edges of the base panel of the apparatus frame at various locations.

Referring now to FIGS. 1 to 3, the top face 28 has a rectangular station 110 formed therein. The boundaries of the station 110 are delimited by a frame 112 having margins 114, 116, 118 and 120. Each margin 114, 116, 118 extends outwardly toward a corresponding outer edge 48, 50, 64, respectively. Secured within the station 110 is an exercise platform 122 which supports the user's body while he/she is performing exercises using the isometric exercise apparatus 20. The exercise platform 122 may attached to the panel using adhesives or fasteners. In this embodiment, the exercise platform 122 is a resilient pad 124 provided with a memory foam core sheathed in a durable material, such as vinyl. However, in alternative embodiments, the exercise platform can be a rubber mat or a mat made of any other material exhibiting suitable resiliency and wear resistance properties.

Figure 5:
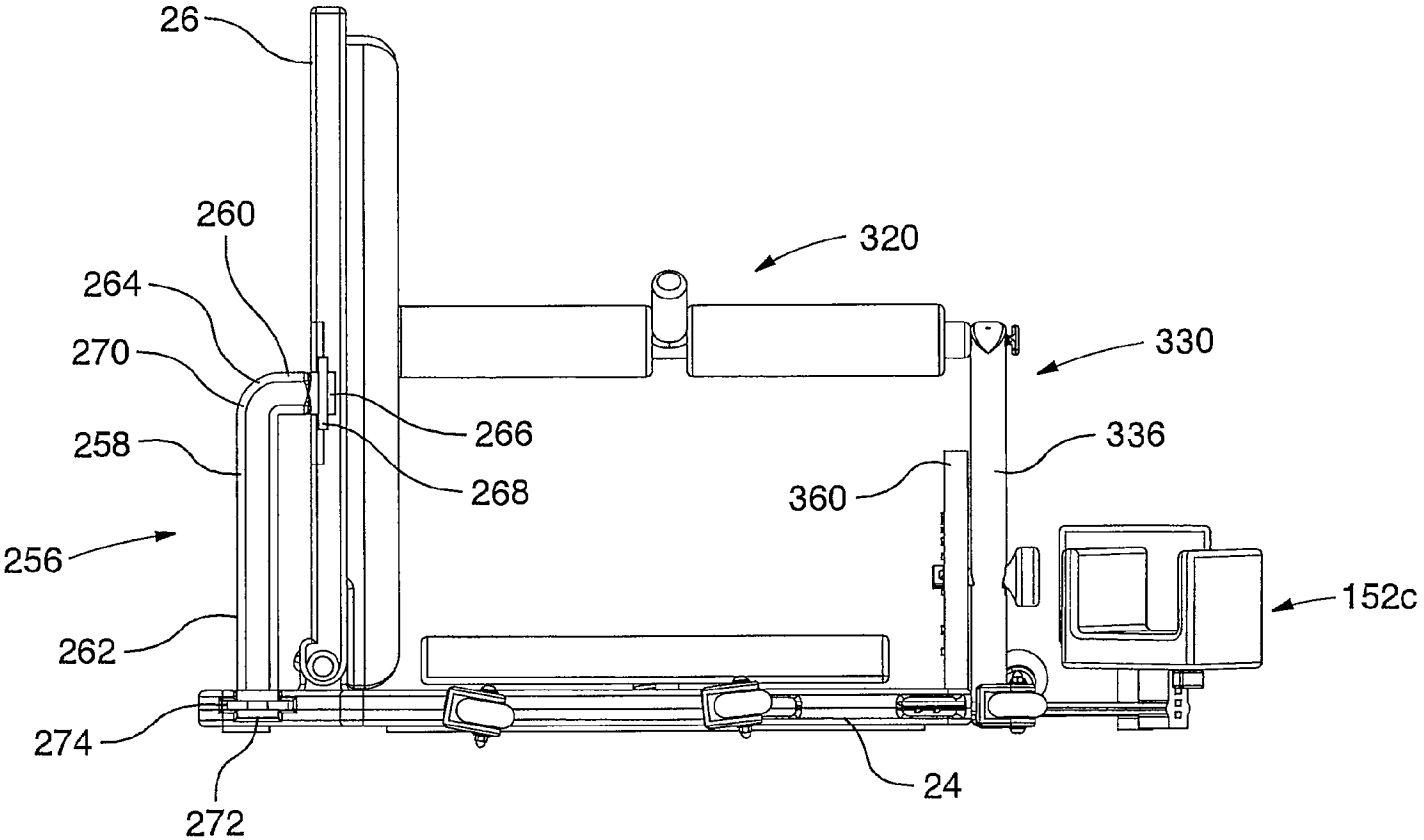
FIG. 5 is an end view of the isometric exercise apparatus shown in FIG. 1.

Defined in, and extending through, the top and bottom faces of the exercise platform 122 is an aperture 126 (visible in FIG. 5). The aperture 126 is aligned with, and provides access to, a threaded blind bore (not shown) formed in the top face 28 of the base 24. The blind bore is sized to receive the threaded connector of an accessory or attachment of the isometric exercise apparatus 20, for example, of the footpad 128 shown in FIG. 1 or the dual foot restraint accessory 132 shown in FIG. 6.

As best shown in FIGS. 1 and 2, the base 24 carries on its top face 28 three hinge tubes oriented generally parallel to the outer edges 62 and 64—a first hinge tube 140, a second hinge tube 142 and a third hinge tube 144 disposed between the first and second hinge tubes 140 and 142. A gap $G_1$ separates the first hinge tube 140 from the third hinge tube 144. Similarly, a gap $G_2$ exists between the second hinge tube 142 and the third hinge tube 144. The hinge tubes 140, 142 and 144 are disposed in the region which lies between the margin 120 and the outer edge 62. Each hinge tube 140, 142, 144 has a passageway (not shown) defined therein. The passageways are disposed in alignment with each other so as to allow a portion of the hinge pin or rod 146 to pass through each of them. As will be explained in greater detail below, the hinge tubes 140, 142 and 144 and the hinge rod 146 form part of the hinge connection between the base 24 and the sidewall 26.

Referring now to FIGS. 3, 5, 6 and 8, a plurality of slots generically identified with reference numeral 150 extends from the outer edges 48, 50 and 64, into the panel 27 and toward the station 110. As will be explained in greater detail below, the slots 150 are adapted to receive and retain a connector arm of an accessory of the isometric exercise apparatus 20 (as shown in FIG. 8*c*). In the preferred embodiment, the slots 150 include twelve slots 150*a*, 150*b*, 150*c*, 150*d*, 150*e*, 150*f*, 150*g*, 150*h*, 150*i*, 150*j*, 150*k* and 150*l*, disposed at different locations along the sides 32, 34 and 38 and having different orientations relative to their corresponding outer edges 48, 50 and 64. The relative position and orientation of each slot 150 are now described in greater detail.

Slot 150*a* is formed in the second short side 34 between the fourth corner 46 and the castor 66 (but closer to the castor 66) and extends perpendicular to the outer edge 50. Slot 150*b* is also formed in the short side 34, but it is disposed very close to the fourth corner 46 and is cut on a slant. More specifically, slot 150*b* is oriented at an angle of approximately 30 degrees as measured from the outer edge 50. Slots 150*c*, 150*d* and 150*e* are positioned adjacent to each other on the second long side 38 proximate the fourth corner 46. Slot 150*c* is canted away from the fourth corner 46 and forms an angle of 60 degrees with the outer edge 64. Slot 150*d* lies between slots 150*c* and 150*e* and has a perpendicular orientation relative to the outer edge 64. Slot 150*e* is disposed furthest from the fourth corner 46. In like fashion to slot 150*c*, slot 150*e* also extends at angle of 60 degrees as measured from the outer edge 64. However, in the case of slot 150*e*, the direction of inclination is toward the fourth corner 46. Still moving away from the fourth corner 46 along the outer edge 64, there is slot 150*f*. Slot 150*f* is oriented toward the fourth corner and has an angle of inclination relative to the outer edge 64 of 30 degrees.

The arrangement of slots 150*g*, 150*h*, 150*i*, 150*j*, 150*k* and 150*l* along the first short side 32 and the second long side 38 is the mirror image of the layout of slots 150*f*, 150*e*, 150*d*, 150*c*, 150*b* and 150*a* (respectively) along the second short side 34 and the second long side 38, such that the arrangement of slots 150*g* through 150*l* requires no further description.

The arrangement and orientation of slots 150*a* to 150*l* affords a user the opportunity to perform many different exercises using the apparatus 20. Simply by changing the placement of the accessory (generically identified with reference numeral 152) from one slot to another, the user can rapidly adapt the apparatus 20 to target a plurality of joint angles to work different muscle groups (or different muscles within the same muscle group) for an enhanced isometric workout. As will be apparent to a person skilled in the art, this feature tends to make the isometric exercise apparatus 20 very versatile. To illustrate this versatility, a plurality of accessories 152*a*, 152*c*, 152*d*, 152*f*, 152*i*, 152*j*, 152*k* and 1521 mounted within their respective slots 150*a*, 150*c*, 150*d*, 150*f*, 150*i*, 150*j*, 150*k* and 150*l* are shown in dashed lines in FIG. 3.

While in the preceding paragraphs an arrangement of twelve slots was described, it should be appreciated that this need not be the case in every application. In other embodiments, a different number of slots could be used. Moreover, the slots could be laid out differently along the outer edges of the panel and/or could have a different orientation (i.e. perpendicular or slanted relative to the outer edge with varying angles).

Figure 8A:
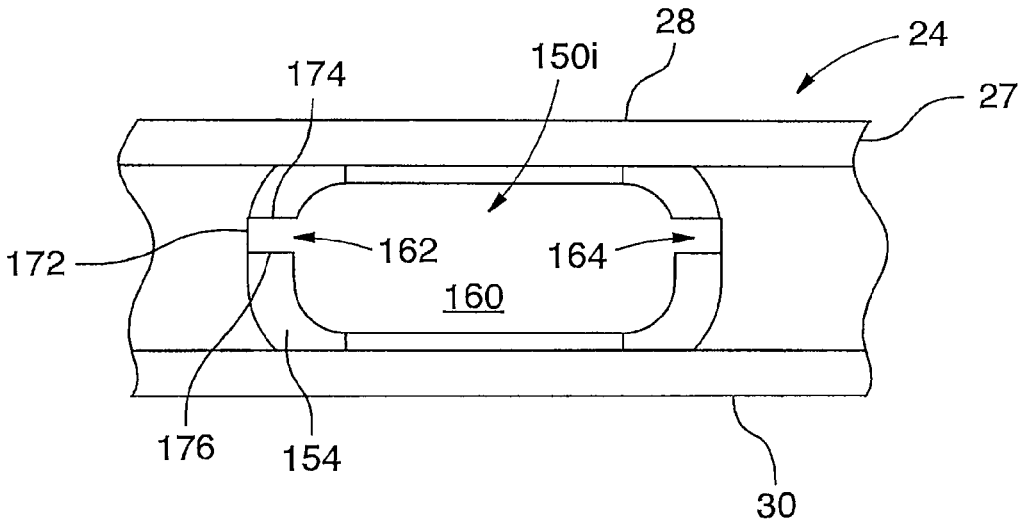
FIG. 8*a* is an enlarged, isolated front elevation view of one of the slots defined in one of the outer edges of the base panel shown in FIG. 1.
Figure 8C:
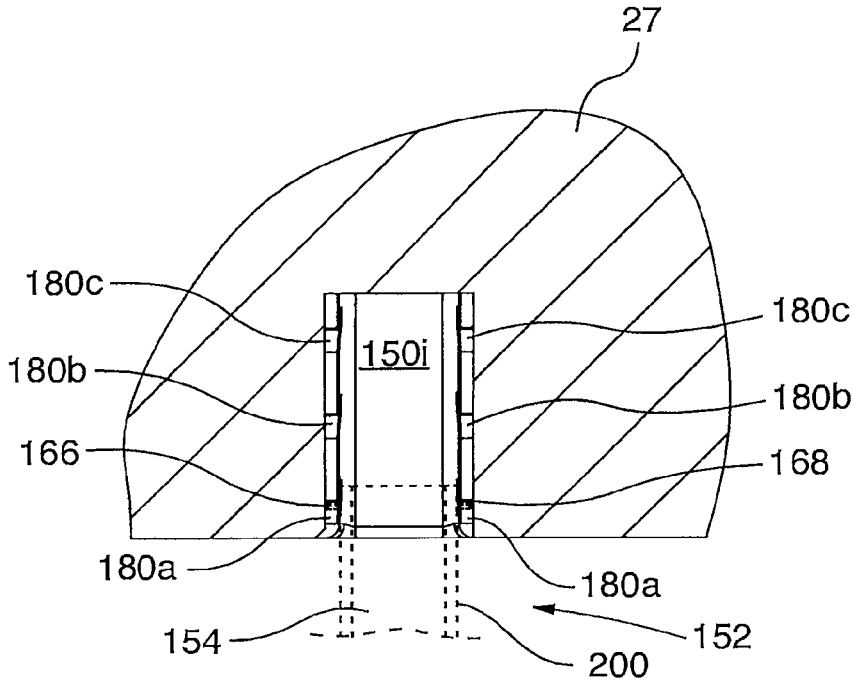
FIG. 8*c* is a top plan view of the slot illustrated in FIG. 8*a* showing a connector arm of the arm restraint attachment received within the slot.
Figure 8B:
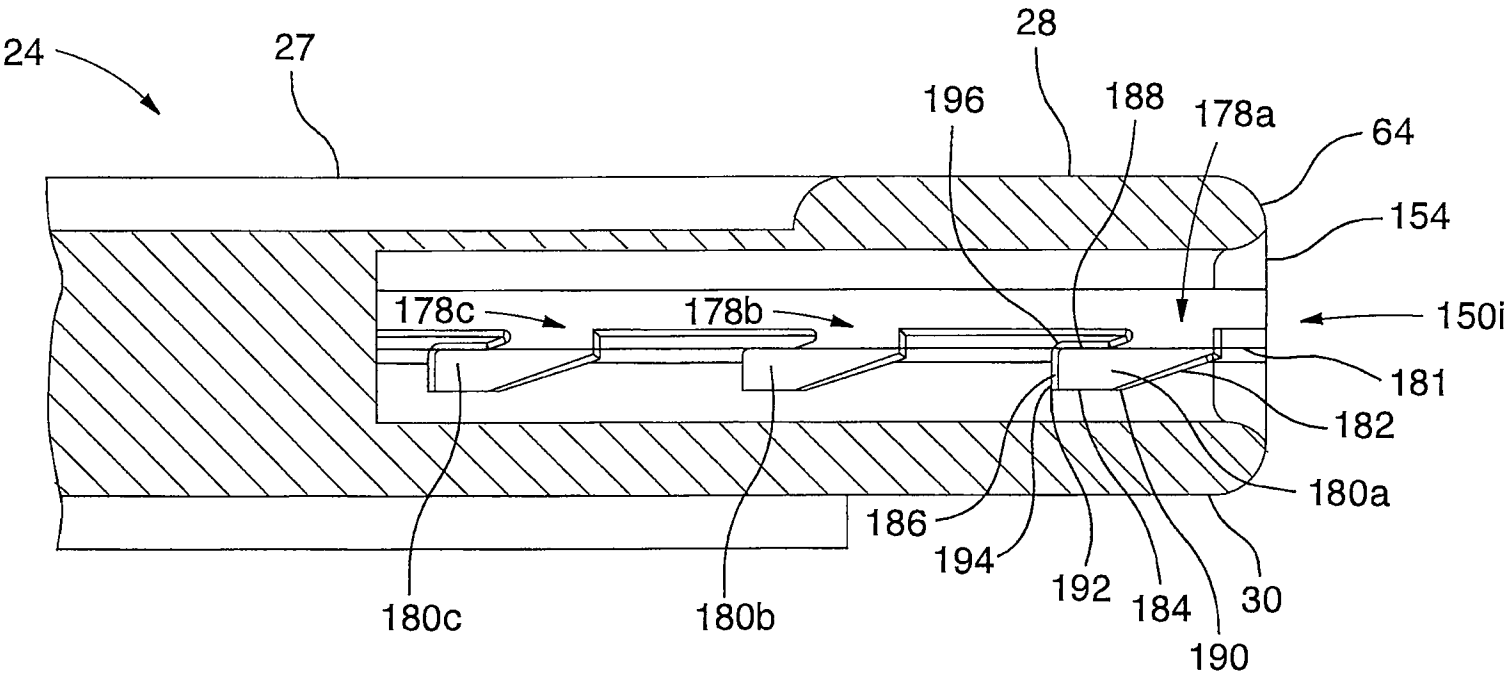
FIG. 8*b* is a cross-sectional view of the slot shown in FIG. 8*a* taken along line "8*b*-8*b*"

But for differences arising from their varying orientations, the slots 150 all have a generally similar structure, such that a description of one representative slot—slot 150*i*—will suffice for the others. Referring now to FIGS. 8*a* and 8*b*, slot 150*i* has a tapered throat 154 (widest at the outer edge 48 and narrowing in the direction of the slot) which tends to serve as a guide for locating the connector arm 156 of the arm restraint attachment 152*i* into the slot 150*i*. The throat 154 opens onto a relatively large central opening 160 whose profile is generally oblong. Bounding on either side, and opening onto, the central opening 160 are first and second C-shaped channels 162 and 164. The channels 162 and 164 are sized to accommodate the travel of locking pins 166 and 168 along the channels (as best shown in FIG. 8*c*) which protrude from the terminal end 170 of the connector arm 156. Each channel 162 and 164 has a back portion 172 and a pair of opposed, upper and lower arm portions 174 and 176 joined to the back portion 172. The lower arm portion 176 has, at spaced apart locations, cutaways 178 which open onto locking recesses 180.

In the preferred embodiment, the lower arm portion 76 is provided with three cutaways 178*a*, 178*b* and 178*c*; each cutaway giving access to a corresponding locking recess 180*a*, 180*b*, 180*c*, respectively. The first cutaway 178*a* and its corresponding locking recess 180*a* is located closest to the throat 154 while the third cutaway 178*c* and its corresponding locking recess 180*c* is located furthest away from it. The second cutaway 178*b* and its corresponding locking recess 180*b* is disposed intermediate the first and third cutaways 178*a* and 178*c* and their respective locking recesses 180*a* and 180*c*. In alternative embodiments, the number of cutaways and locking recesses could be varied to suit the particular application.

Each locking recess 180 is defined by a relatively short, substantially vertical wall portion 181, a downwardly sloping wall portion 182, a horizontal wall portion 184, a vertical wall portion 186 and an overhanging lip portion 188. The substantially wall portion 181 extends from the cutaway 178 to connect to the downwardly sloping wall portion 182. The wall portion 182 joins the horizontal wall portion 184 at the first end 190 thereof. At the opposite second end 192, the horizontal wall portion 184 meets the lower end 194 of the vertical wall portion 186. The overhanging lip portion 188 is connected to the upper end 196 of the vertical wall portion 186 and runs back toward the cutaway 178 generally parallel to horizontal wall portion 184.

When the locking pins 166 and 168 of the connector arm 154 are received within the locking recesses 180*a*, the accessory 152 is at its most extended position 200 (see the accessory 152*c* shown in FIG. 3). The accessory 152 is in its partially retracted position 202, when the locking pins 166 and 168 are accommodated in the locking recesses 180*b* (see the accessory 152*a* shown in FIG. 3). Lastly, the accessory 152 can be moved to its most retracted position 204 by moving the locking pins 166 and 168 into the locking recesses 180*c* (see the accessory 152*i* shown in FIG. 3).

As will be appreciated by a person skilled in the art, the provision of a plurality of cutaways 178 and locking recesses 180 allows the user to adjust the distance by which an accessory 152 protrudes beyond the outer edge 64. This functionality permits the user to customize the isometric exercise apparatus 20 to suit his/her body shape or size. Moreover, by modifying this distance, the apparatus 20 can be adapted to allow the user to isolate different joint angles and perform different exercises or cause different muscles to be contracted.

Figure 4A:
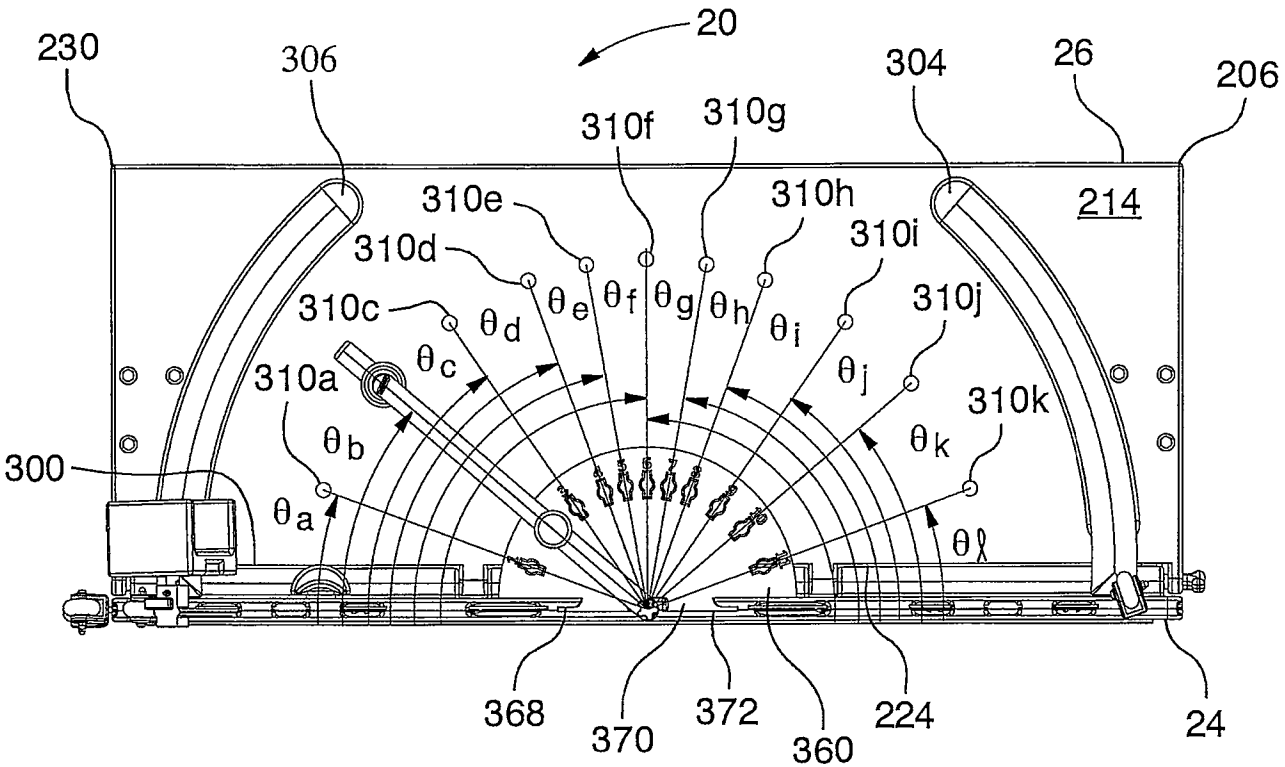
FIG. 4*a* is a front elevation view of the isometric exercise apparatus shown in FIG. 1, with one of the arm restraint accessories removed for clarity.

Referring now to FIGS. 1, 2 and 4*a*, the sidewall 26 will now be described in greater detail. The sidewall 26 includes a substantially rectangular panel 212 provided with a first face 214 (see FIG. 1) and an opposed second face 216 (see FIG. 2). The shape of the panel 212 is defined by a pair of opposed, relatively short first and second sides 218 and 220, and a pair of opposed, relatively long, first and second sides 222 and 224 extending between the short sides 218 and 220. The first short side 218 meets the first long side 222 at a first corner 226, and joins the second long side 224 at a second corner 228. The two remaining corners of the panel 212—third and fourth corners 230 and 232—are formed by the juncture of the second short side 220 and each of the first and second long sides 222 and 224, respectively.

The panel 212 may be constructed of a material similar to that used for panel 27 of the base 24. For reasons of enhanced visibility or aesthetics, the panel may be made transparent or translucent. In the preferred embodiment, the sidewall 26 has a length $L_2$ equal to the length $L_1$ of the base 24 and the width $W_2$ (as measured between the outer edges 300 and 302 of the long sides 222 and 224) of 26.5 inches.

As best shown in FIG. 2, protruding from the outer edge 234 of second long side 224 are a plurality of hinge knuckles 236, 238, 240 and 242. Hinge knuckles 236 and 238 are located at the first and fourth corners 228 and 232, respectively, while the hinge knuckles 238 and 240 are located at intermediate locations between the first and fourth corners 228 and 232. These locations correspond to the gaps $G_1$ and $G_2$ defined between the first and third hinge tubes 140 and 144 and the second and third hinge tubes 142 and 144. Each hinge knuckle 236, 238, 240 and 242 has a passageway (not shown) which when aligned with the passageways defined in the hinge tubes 140, 142 and 144 allow a portion of the hinge pin or rod 146 to pass therethrough.

Figure 6:
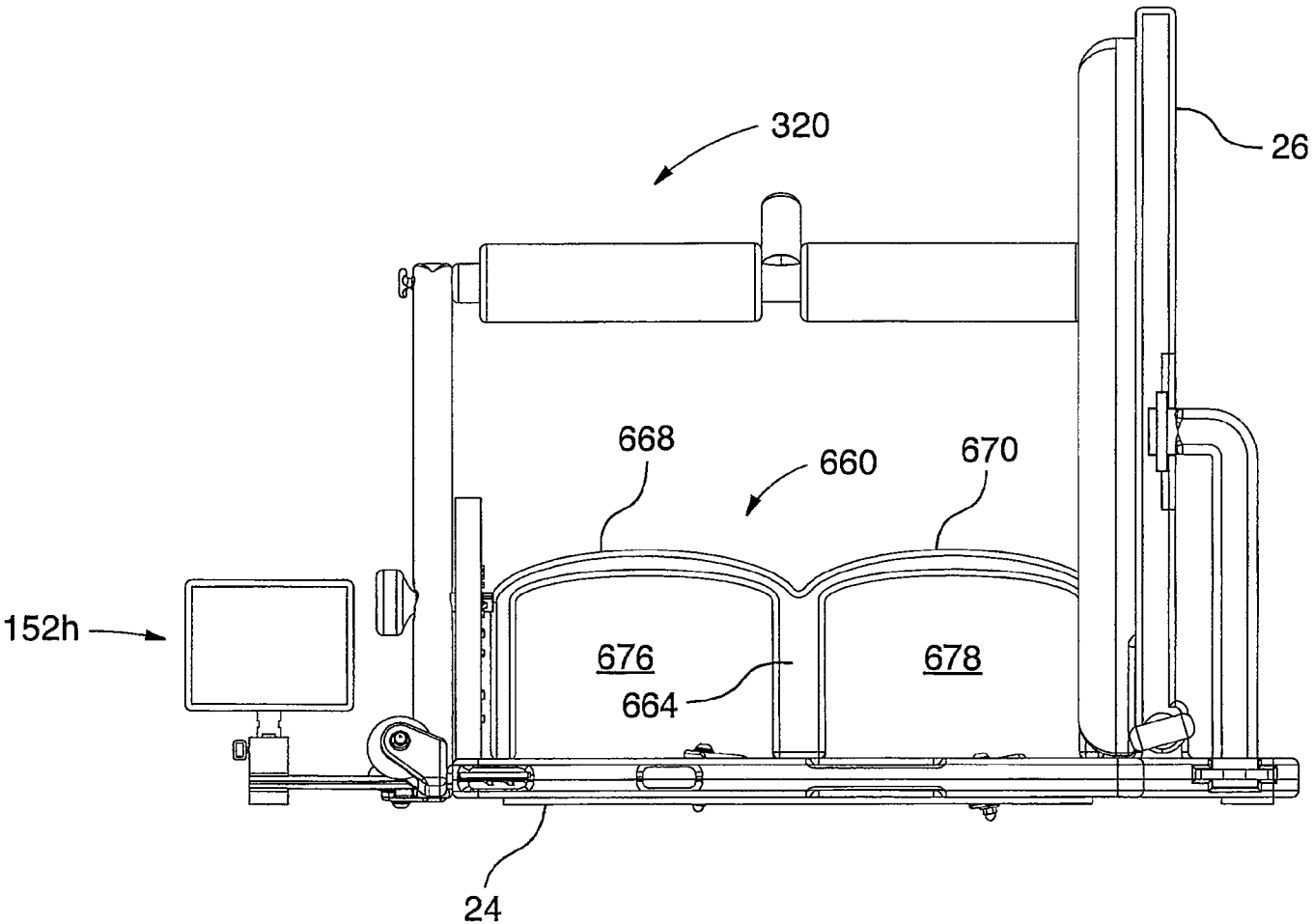
FIG. 6 is another end view of the isometric exercise apparatus taken from the opposite end to that illustrated in FIG. 5, the footpad attachment shown in FIG. 5 having been replaced with a dual foot restraint attachment.

Thus formed, the hinge connection between the base 24 and the sidewall 26 allows the sidewall 26 to be moved between a collapsed position 250 (shown in FIG. 26) and an upstanding position 252 (shown in FIGS. 1 and 2). When the sidewall 26 is moved to its collapsed position 250 the first face 214 of the sidewall 26 is brought opposite the top face 28 of the base 24 and the apparatus 20 is now in its out-of-use, storage position 251. In the upstanding 252, the sidewall 26 lies perpendicular or at least substantially perpendicular to the base 24 as shown in FIGS. 5 and 6 and the apparatus occupies its in-use position 253.

While it is generally preferred for purposes of storage and minimizing the footprint occupied by the isometric exercise apparatus 20 (i.e. enhancing the compactness of the apparatus) that the frame 22 be collapsible, it will appreciated that this need not be the case in every application. In an alternative embodiment, the frame could be configured such that the sidewall is maintained in a fixed position relative to the base. In such an embodiment, the sidewall could extend perpendicular to the base and be permanently joined to the base along an edge thereof.

Referring to FIGS. 2, 5, 6 and 20, the apparatus 20 is provided with a pair of side locking bars 254 and 256 engageable with both the base 24 and the sidewall 26, to retain the sidewall 26 in the upstanding in-use position 252. Each locking bar 254, 256 has a generally L-shaped body 258 defined by a first, relatively short arm 260 and a second, relatively long arm 262. The first short arm 260 includes a proximal end 264 joined to the first short arm 260 and a distal or free end 266 (best shown in FIG. 5). Located a very short distance inwardly of the free end 266 is a first flange portion 268 which runs peripherally about the first short arm 260.

In like fashion to the first short arm 260, the second long arm 262 also has a proximal end 270 and a distal or free end 272. The proximal end 270 is connected to the proximal end 264 of the first short arm 260. The second long arm 262 is also provided with a second flange portion 274 formed inwardly of the free end 272 and extending about the periphery of the second long arm 262.

The first and second flange portions 268 and 274 are configured to be retained within receiving stations (identified generically as) 276 formed respectively in the sidewall 26 and the base 24. The sidewall 26 has two receiving stations 276*a* and 276*b*—one to accommodate the first flange portion 268 of each side locking bar 254, 256. Station 276*a* is defined in the outer edge 280 of the first short side 218 of panel 212 and is disposed roughly midway between the first and second corners 226 and 228. Station 276*b* is similarly formed in the outer edge 282 of the second short side 220 midway between the third and fourth corners 230 and 232.

Figure 27A:
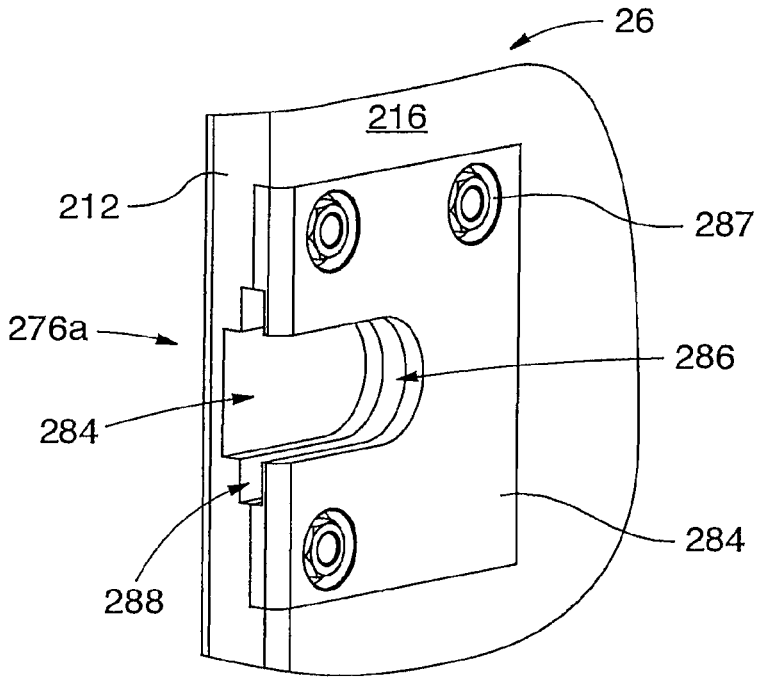
FIG. 27*a* is an isolated perspective view of one of the receiving stations defined in the second face of the sidewall shown in FIG. 26.

Referring to FIG. 27*a*, each station 276*a*, 276*b* is defined by a portion of the second face 216 of the panel 212 and a plate 284 secured to the panel 212. More specifically, the second face 216 has a thumbnail-shaped rebate 284 formed therein which is sized to receive the free end 266 of the short arm 260. Similarly, the plate 284 has a thumbnail-shaped cutaway 286 opposed, and aligned with, the rebate 284. Disposed intermediate the rebate 284 and the cutaway 286 is relatively larger slot 288 which is designed to accommodate the first flange portion 268. It will thus be understood by a person skilled in the art that when the first flange portion is received within the slot 288, the locking bar is captively retained between the panel 212 and the plate 284 with its motion restricted in five degrees of movement.

In the preferred embodiment the plate 284 is secured to panel 212 by three fasteners 287. In alternative embodiments, the plate could be attached differently. For instance, it could be welded onto the panel.

In like fashion to the sidewall 26, the base 24 is provided with two receiving stations 278*a* and 278*b*—one to accommodate the second flange portion 274 of each side locking bar 254, 256. Station 278*a* is defined in the outer edge 48 of the first short side 32 of panel 27 and is disposed adjacent the corner 40. Station 278*b* is similarly formed in the outer edge 50 of the second short side 34 near the corner 44.

Figure 27B:
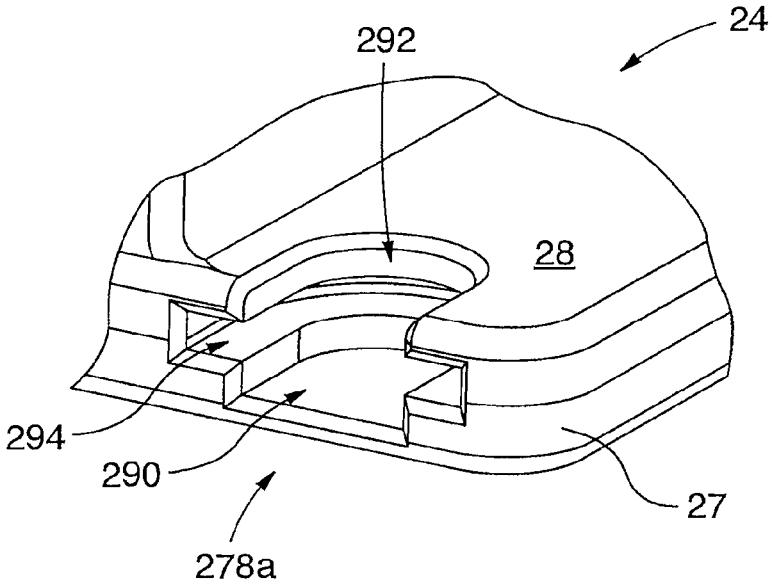
FIG. 27*b* is an isolated perspective view of one of the receiving stations defined in the top face of the base shown in FIG. 26.

FIG. 27*b* shows an enlarged perspective view of station 278*a*. Station 278*a* generally resembles station 276*a* in that it too is defined by a thumbnail-shaped rebate 290, a thumbnail-shaped cutaway 292 opposed, and aligned with, the rebate 290 and a relatively large slot 294 disposed intermediate the rebate 290 and the cutaway 292. In this case, the slot 294 is designed to accommodate the second flange portion 274. Contrary to the station 276*a*, the station 278*a* is wholly formed by panel 27.

As best shown in FIG. 2, to prevent the accidental release of the second flange portions 274 from the stations 278*a* and 278*b*, the apparatus 20 is further provided with a pair of locking pins 303 for securing the locking bars 254 and 256 in position. Each locking pin 303 is designed for insertion through a first bore 305 defined in the base 24 adjacent the station 278*a* or 278*b* (as the case may be) and a second bore 307 formed into the second flange portion 274 of the locking bar 254 and 256.

In other embodiments, the locking bars could be placed at different locations or configured differently. Alternatively, a single locking bar may be used. In a further alternative, the sidewall could be secured in the in-use position using other locking means.

Figure 24:
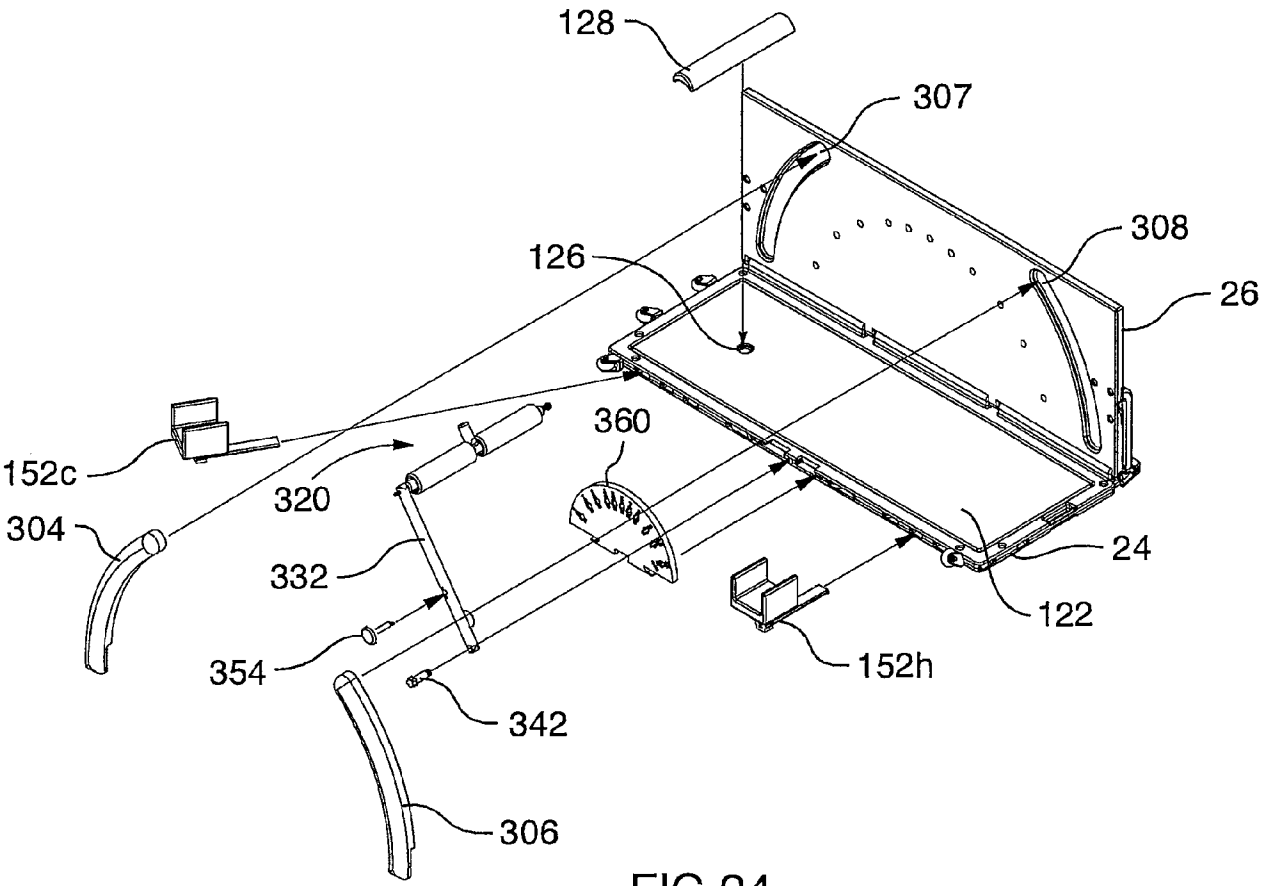
FIG. 24 is a partially exploded, perspective view of the isometric exercise apparatus illustrated in FIG. 1 showing the restraint arm assembly, the footpad, the arm restraint attachments and the arc-shaped pads exploded from the apparatus frame.

Referring now to FIG. 4*a*, the panel 212 has a pair of arc-shaped pads 304 and 306 mounted to its first face 214 in opposition to each other and proximate the corners 226 and 230. The back portion of the pads 304 and 306 are nestled within arcuate recesses 307 and 308 formed within the first face 214 (as shown in FIG. 24). Preferably, the pads 304 and 306 are retained within the recesses 307 and 308 by magnetic engagement. However, in alternative embodiments, other means could be used to attach the pads to the panel 212. For instance, the pads and the recesses could be configured for a snap fit, or could be provided with co-operating with hook and loop fastener strips. In still another embodiment, the pads could be provided with one or more male connectors for insertion into female sockets defined in the panel 212.

Each pad 304, 306 has a first end 312 carried a short distance away from the outer edge 222 and a second end 314 which projects beyond the outer edge 224. When the base 24 and the sidewall 26 are connected to each other, the second end 314 abuts or nearly abuts the top face 28 of the base 24. Preferably, the pads 304 and 306 have a core made of a resilient material, for example, memory foam or the like, and are sheathed in vinyl. However, it should be appreciated that other materials could be used to fabricate the pads. The location and shape of the pads 304 and 306 are selected to allow a user to comfortably urge a portion of his/her body against the pads while performing an exercise using the apparatus 20. In alternative embodiments, the pads could have a different shape and could be disposed differently on the first face 214 of the panel 212.

The panel 212 is further provided with a plurality of spaced apart blind bores generically identified with reference numeral 310, extending into the first face 214 of the panel 212. Preferably, the plurality of blind bores 310 include eleven bores—bores 310*a*, 310*b*, 310*c*, 310*d*, 310*e*, 310*f*, 310*g*, 310*h*, 310*i*, 310*j* and 310*k*—which are disposed across the panel 212 in a semi-circular arrangement. The bores 310*a*, 310*b*, 310*c*, 310*d*, 310*e*, 310*f*, 310*g*, 310*h*, 310*i*, 310*j* and 310*k* are each radially displaced from the plane of the base 24 by an angle $\theta_a$, $\theta_b$, $\theta_c$, $\theta_d$, $\theta_e$, $\theta_f$, $\theta_g$, $\theta_h$, $\theta_i$, $\theta_j$, $\theta_k$ and $\theta_l$, respectively. Angles $\theta_g$, $\theta_h$, $\theta_i$, $\theta_j$, $\theta_k$ and $\theta_l$ correspond to angles $\theta_a$, $\theta_b$, $\theta_c$, $\theta_d$, $\theta_e$ and $\theta_f$, respectively. In the preferred embodiment, $\theta_a$ measures 20 degrees; $\theta_b$ measures 40 degrees; $\theta_c$ measures 55 degrees; $\theta_d$ measures 70 degrees; $\theta_e$ measures 80 degrees; $\theta_f$ measures 90 degrees; $\theta_g$ measures 90 degrees, $\theta_h$ measures 80 degrees; $\theta_i$ measures 70 degrees; $\theta_j$ measures 55 degrees; $\theta_k$ measures 40 degrees; and $\theta_l$ measures 20 degrees.

As will be explained in greater detail, the purpose of bores 310 is to receive and captively retain a portion of the restraint or support arm 320 in order to hold the restraint arm 320 above the exercise platform 122 at different predetermined angular positions relative to the plane of base 24. It will thus be appreciated that the particular arrangement of the bores 310 along the panel 212 corresponds to specific, predetermined angular settings for the restraint arm 320. By virtue of the number of bores 310 provided, a user is afforded the opportunity to move the restraint arm 320 to a plurality of positions thereby allowing different joint angles to be isolated and different exercises to be performed or different muscle groups to be worked.

While the provision of eleven bores is generally preferred, in other embodiments, the panel 212 could be provided with more or less bores depending on the needs of the user. Similarly, the bores could be disposed differently than in the preferred embodiment. For example, the radial spacing between adjacent bores could be varied (i.e. increased or decreased).

Referring now to FIGS. 1, 4*a*, 4*b*, 9 and 10, the support or restraint arm assembly 330 is now described in greater detail. The restraint arm assembly 330 includes a swing arm 332 pivotable relative to the base 24, the restraint or support arm 320 carried by the swing arm 332 and an indexing assembly 334 for setting the angular position of the swing arm 332 (and restraint arm 320) relative to the plane of the base 24.

In this embodiment, the swing arm 332 is an elongate rod 336 having a first end 338 pivotally connected to the base 24 and a second opposed end 340 attached to the restraint arm 320. The pivot connection between the swing arm 332 and the base 24 is formed by a pivot pin 342 having a knob 344 at one end and threading at the other. The pivot pin 342 extends through an aperture (not shown) defined in the first end 338 and is received in a threaded blind bore (not shown) formed in the outer edge 64 of the second long side 38 roughly midway between corners 42 and 46.

Figure 4B:
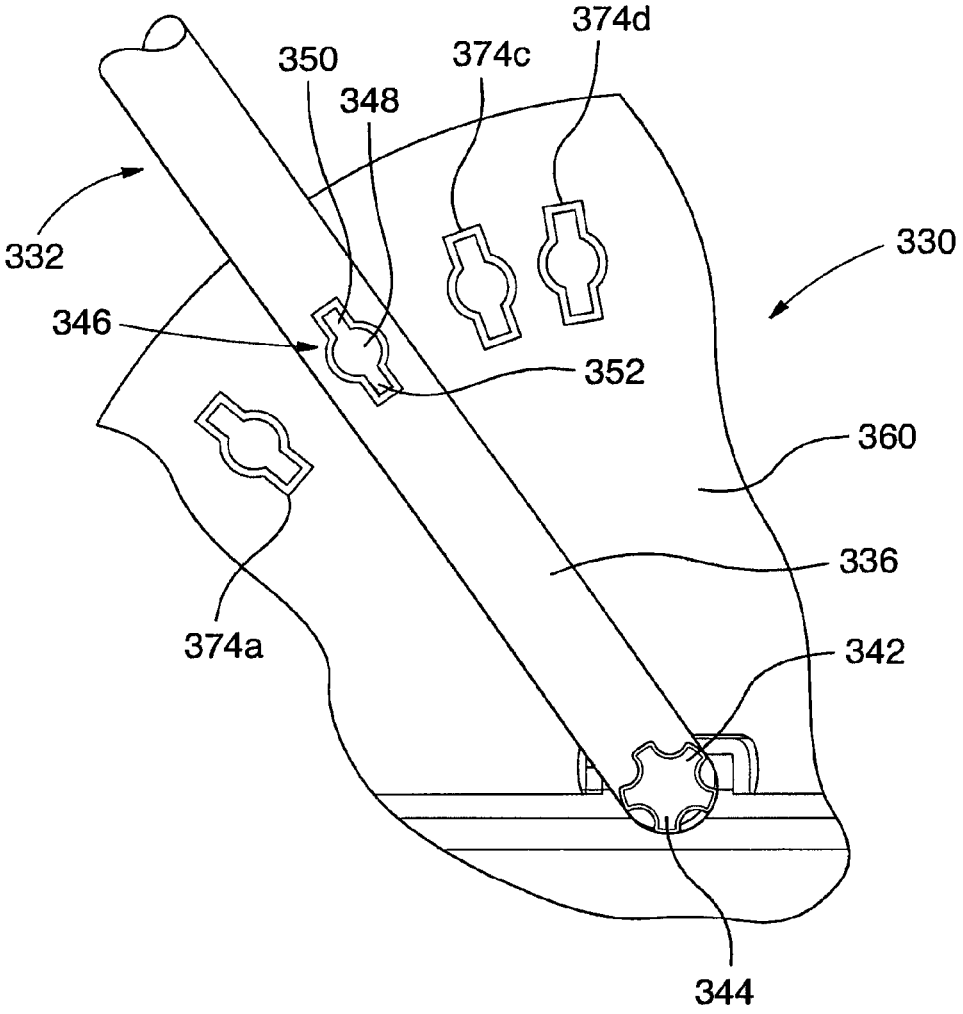
FIG. 4*b* is a magnified detail view of the restraint arm assembly illustrated in FIG. 4*a* showing the swing arm and the indexing plate; the indexing key having been omitted to better reveal the keyhole defined in the swing arm.

Defined in the rod 336 at a location closer to the first end 338 than to the second end 340, is a keyhole 346. As shown in FIG. 4*b*, the keyhole 346 includes a centrally disposed, circular opening 348 provided with a rectangular slot 350, 352 positioned on either side of, and opening onto, the circular opening 348. As explained below, the keyhole 346 co-operates with an indexing member or key 354 and other portions of the indexing assembly 334 to secure the swing arm 332 in one of a plurality of predetermined angular positions.

The indexing assembly 334 includes an indexing plate 360 attached to the base 24 and an indexing pin or key 362 engageable with at least a portion of the indexing plate 360. The indexing plate 360 is substantially semi-circular, its shape being defined by an arcuate edge 364 with two opposed ends and a straight edge 366 extending between the two ends of the arcuate edge 364. Extending from the straight edge 366 in the plane of the indexing plate 348, are two spaced apart mounting tabs 368 and 370; each provided with a laterally extending finger-like projection 372. The mounting tabs 368 and 370 are designed to be snugly received within corresponding recesses 371 and 373 formed within the outer edge 64 of the second long side 38 (shown in FIG. 24), for a snap fit. The finger-like projections 372 serve to locate the mounting tabs 368 and 370 within the recesses. The gap that exists between the mounting tabs 368 and 370 provides clearance for the pivot connection between the first end 338 and the base 24. When attached to the base 24 with mounting tabs 368 and 370, the indexing plate 360 stands upright or proud of the base 24, its straight edge 366 abutting the top face 28 of the base 24.

The indexing plate 360 is further provided with a plurality of keyholes generically identified with reference numeral 374. The number of keyholes 374 corresponds to the number of blind bores 310 defined in the panel 212. In the embodiment shown in FIG. 4*a*, the plurality of keyholes 374 includes eleven keyholes—keyholes 374*a*, 374*b*, 374*c*, 374*d*, 374*e*, 374*f*, 374*g*, 374*h*, 374*i*, 374*j* and 374*k*-which are disposed across the indexing plate 360 in a semi-circular arrangement corresponding to that of blind bores 310*a*, 310*b*, 310*c*, 310*d*, 310*e*, 310*f*, 310*g*, 310*h*, 310*i*, 310*j* and 310*k*. Accordingly, much like blind bores 310*a* to 310*k*, the keyholes 374*a* to 374*k* are each radially displaced from the plane of the base 24 by angle $\theta_a$, $\theta_b$, $\theta_c$, $\theta_d$, $\theta_e$, $\theta_f$, $\theta_g$, $\theta_h$, $\theta_i$, $\theta_j$ and $\theta_k$, respectively.

Each keyhole 374 extends between the first face 376 (which is oriented away from the panel 212) and the second face 378 (which is positioned opposite the first face 214 of the panel 212) and is configured similarly to the keyhole 346 defined in the rod 336. In particular, each keyhole 374 also includes a centrally disposed, circular opening 380 provided with a rectangular slot 382, 384 positioned on either side of, and opening onto, the circular opening 380 (see FIG. 10). Furthermore, in like fashion to keyhole 346, each keyhole 374 is adapted to receive therethrough a portion of the indexing key 354.

Figure 10:
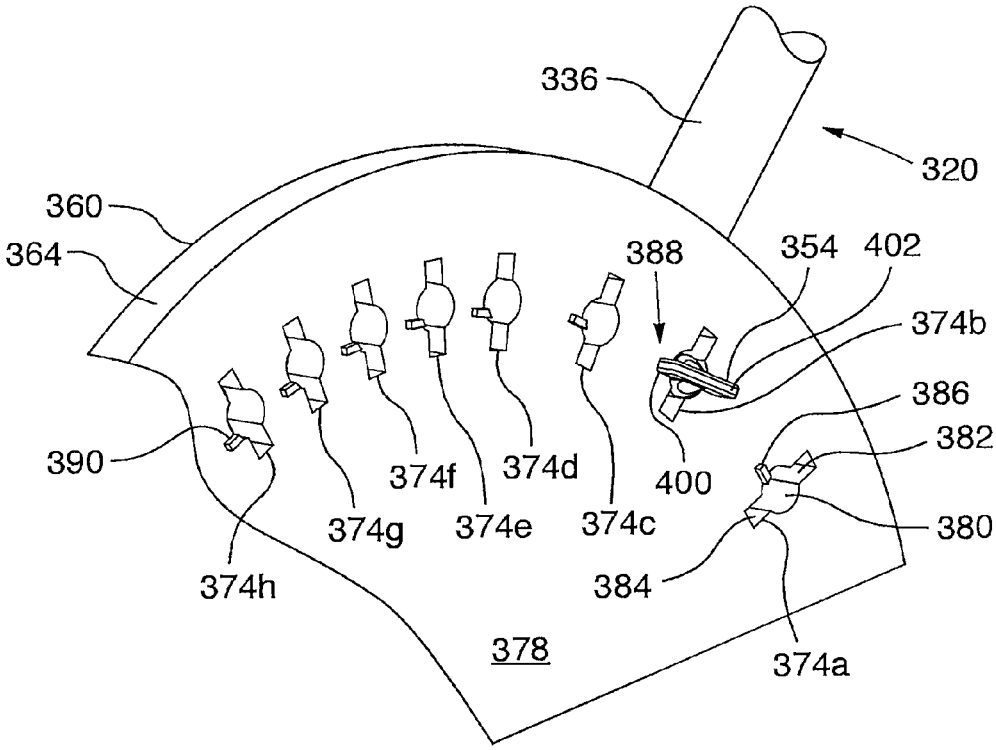
FIG. 10 is an enlarged partial, rear perspective view of the indexing plate of the restraint arm assembly illustrated in FIG. 4*a* showing the indexing key engaged within one of the keyholes defined in the indexing plate and rotated such that the protruding locking tabs at the end of the indexing key are misaligned with the slots of the keyhole.

Associated with each keyhole 374 is a stop member 386 for preventing rotation of the indexing key 354 when the indexing key 354 is inserted into the keyhole 374 and pivoted to its locking position 388. In this embodiment and as shown in FIG. 10, the stop member 386 takes the form of a relatively small, rectangular projection 390 extending from the second face 378 and disposed adjacent the circular opening 380. In other embodiments, a stop for the indexing key could take an alternate form. For instance, instead of a projection, the stop could be defined by one or more grooves or notches machined into the second face 378 of the indexing plate 360. The notch would be adapted to receive and retain a portion of the indexing key to prevent rotation thereof.

Figure 11:
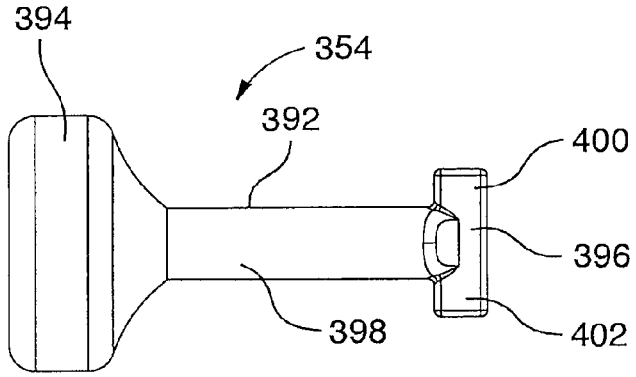
FIG. 11 is a side elevation view of the indexing key shown in FIG. 10.

Referring now to FIG. 11, the indexing key 354 has a body 392 provided with a bulbous grip or handle portion 394 at one end, a transverse key portion 396 fixed at the opposite end and a cylindrical portion 398 extending between the handle portion 394 and the key portion 396. When viewed from the side, the cylindrical portion 398 and the key portion 396 have a generally T-shaped profile. The key portion 396 has a pair of opposed locking tabs 400 and 402; each locking tab 400, 402 extending away from the juncture of the key portion 396 with the cylindrical portion 398. The cross-sectional area of the key portion 396 is sized slightly smaller than the keyhole 310 defined in the rod 336 and the keyholes 374 defined in the indexing plate 360 so as to allow insertion of the indexing key 354 through the rod and the indexing plate 360.

When the indexing key 354 is inserted into the keyhole 374 and pivoted to its locking position 388, the locking tabs 400 and 402 are misaligned with the rectangular slots 382 and 384 thereby preventing the indexing key 354 from being removed from the keyhole 374. Moreover, in the locking position 388, one of the tabs 400 or 402 abuts the stop member 386.

Referring now to FIGS. 12*a* to 12*d*, the restraint arm 320 has a generally cylindrical body 410 having a first end 412 welded to the second end 340 of the swing arm 332 and a second end 414 disposed opposite the first face 214 of the panel 212. At a position intermediate the first and second ends 412 and 414, a stubby handle 413 protrudes from the body 410. Tubular foam pads 415 and 417 extend along the cylindrical body 410 on either side of the handle 413 and provide cushioning to the user during exercise.

Machined through the body 410 is a longitudinal bore 416 which partially accommodates a retractable locking pin assembly 418. The locking pin assembly 418 includes a relatively thin, elongate rod or locking pin 420 captively retained within the bore 416, but capable of limited movement along the longitudinal axis of the bore 416, and a helical spring member 422 wrapped loosely about the pin 420. The pin 420 extends through a relatively short bore 424 formed at the second end 340 of the swing arm 332 and passes through the bore 416. The first end 426 of the pin 420 extends beyond the edge of the swing arm 332 and terminates with a relatively small, first stop member 428. This stop member serves a dual function. It limits the longitudinal displacement of the pin 420 in the direction of the panel 212 and also doubles as a pull for retracting the pin 420. Similarly, the second end 428 of the pin 420 protrudes beyond the end 414 of the restraint arm 320 and terminates with a second stop member 430. The second stop member 430 is sized generally larger than the first stop member 428, but is configured to fit into the blind bores 310 defined in face 214 of the panel 212. The second stop member 430 is operable to limit the longitudinal displacement of the pin 420 in the direction moving away from the side panel 212.

The locking pin 420 is moveable between an engaged position 432 (shown in FIGS. 12*a* and 12*b*) and a retracted or disengaged position 434 (shown in FIGS. 12*c* and 12*d*). When the locking pin 420 is in the engaged position 432, the locking pin 420 is engaged with the panel 212, its second stop member 430 being received within the one of the blind bores 310. The locking pin 420 is biased in the engaged position 432 by virtue of the helical spring member 422. When the locking pin 420 is in the retracted or disengaged position 434, the locking pin 420 is no longer in engagement with the panel 212 as its second stop member 430 is pulled out from the bore 310.

Figure 9:
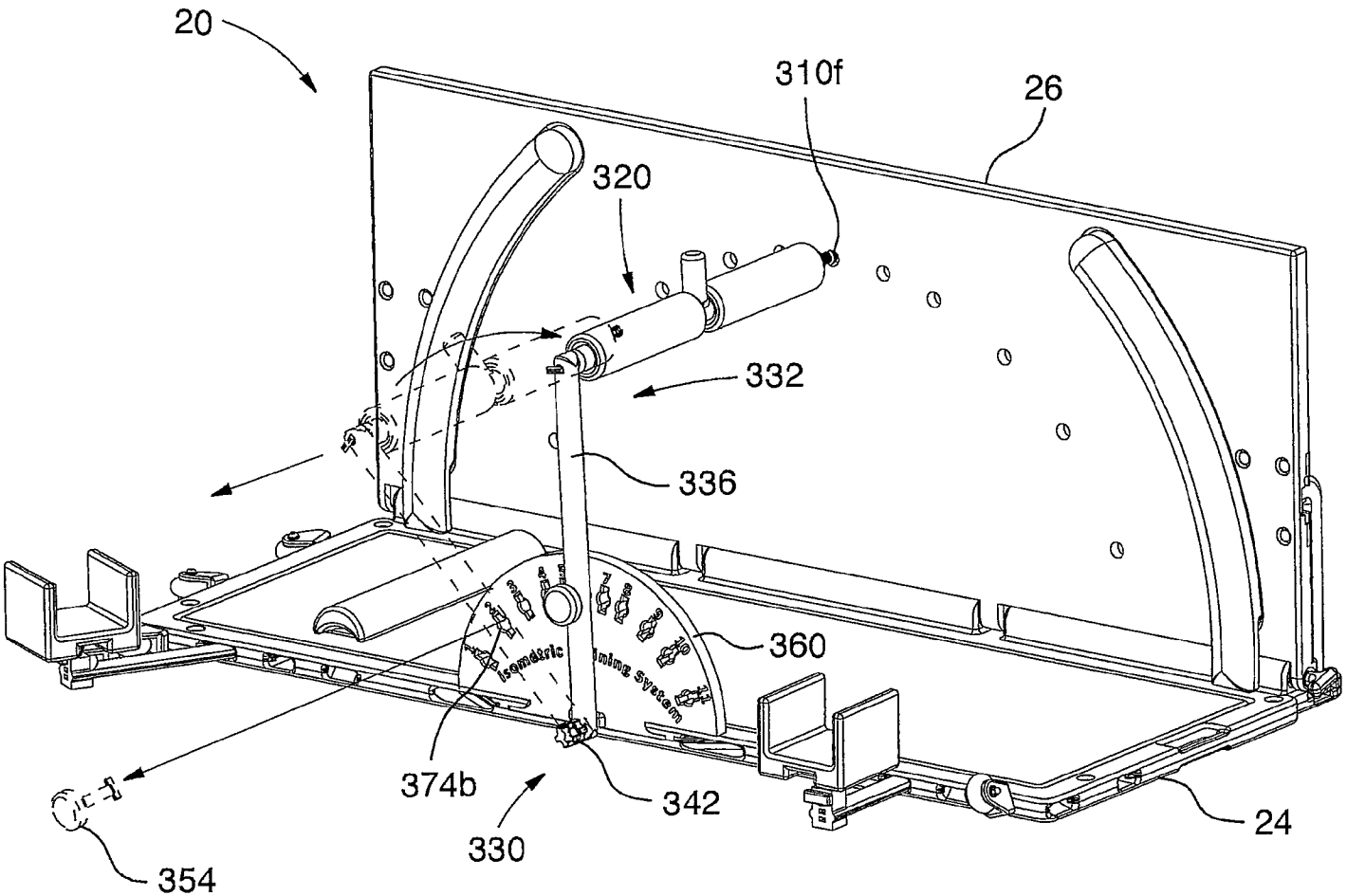
FIG. 9 is a perspective view of the isometric exercise apparatus similar to that illustrated in FIG. 1, showing the horizontal restraint member of the restraint arm assembly being moved from a first position to a second position.

The typical mode of operation of the restraint arm assembly 330 and the locking pin assembly 418 is now described in greater detail. FIG. 9 shows the initial angular position of the swing arm 332 and restraint arm 320 in dashed lines and the final angular position of these components in full lines. As a first step, the swing arm 332 is decoupled from the indexing plate 360 so that it is free to rotate about the pivot pin 342. This is achieved by removing the indexing key 354 from the keyhole 348 defined in the rod 336 and the keyhole 374*b* formed in indexing plate 360. The user grasps the handle portion 394 of the indexing key 354 and rotates the body 392 until the locking tabs 400 and 402 are aligned with the slots 350 and 352 of the keyhole 348 and the slots 382 and 384 of the keyhole 374*b*. Thereafter, the indexing key 354 is pulled out of the swing arm 332 and the indexing plate 360.

Next, the user releases the restraint arm 320 from engagement with the panel 212 by pulling on the first stop member 428 to overcome the biasing effect of the spring member 422. This urges the locking pin 420 to move from its engaged position 432 to its disengaged position 434. With the locking pin 420 in the disengaged position 434, the swing arm 332 and the restraint arm 320 are now free to pivot relative to the base 24. While holding onto the first stop member 428 the user grasps the stubby handle 413 and uses it to direct the restraint arm 320 to the blind bore 310*f* which corresponds to the desired final angular position. The user then releases the first stop member 428 to cause the locking pin 420 to return to its engaged position 432. With the restraint arm 320 locked in place, the swing arm 332 is now secured against rotation by inserting the key portion 396 of the indexing key 354 through the aligned keyholes 348 and 374*f*. The indexing key 354 is then rotated until one of the locking tabs 400 and 402 abuts the rectangular projection 390.

The isometric exercise apparatus 20 can be used with a plurality of attachments or accessories for enhanced versatility and comfort. Examples of such attachments are the first arm restraint attachment 152 shown in FIGS. 13*a* to 13*d* and the second arm restraint attachment 540 shown in FIGS. 14*a* and 14*b*, the footpad 128 and the dual foot restraint accessory 132. Of course, the apparatus 20 could be employed with other attachments as well.

Figure 13A:
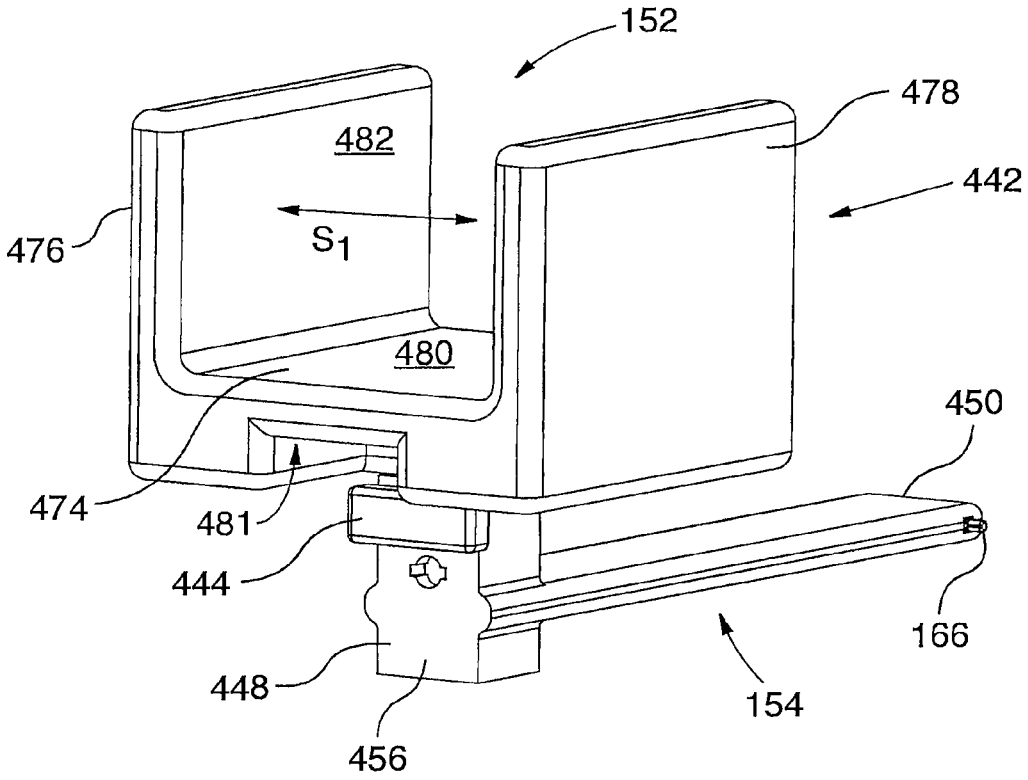
FIG. 13*a* is an isolated perspective view of the first arm restraint attachment shown in FIG. 1.
Figure 13C:
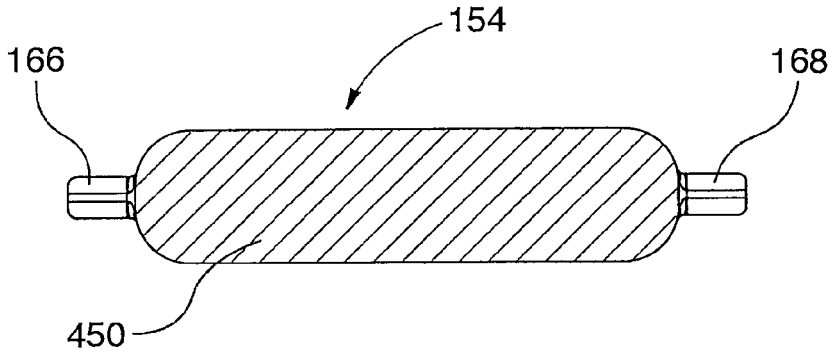
FIG. 13*c* is an exploded perspective view of the first arm restraint attachment shown in FIG. 13*a;*
Figure 13B:
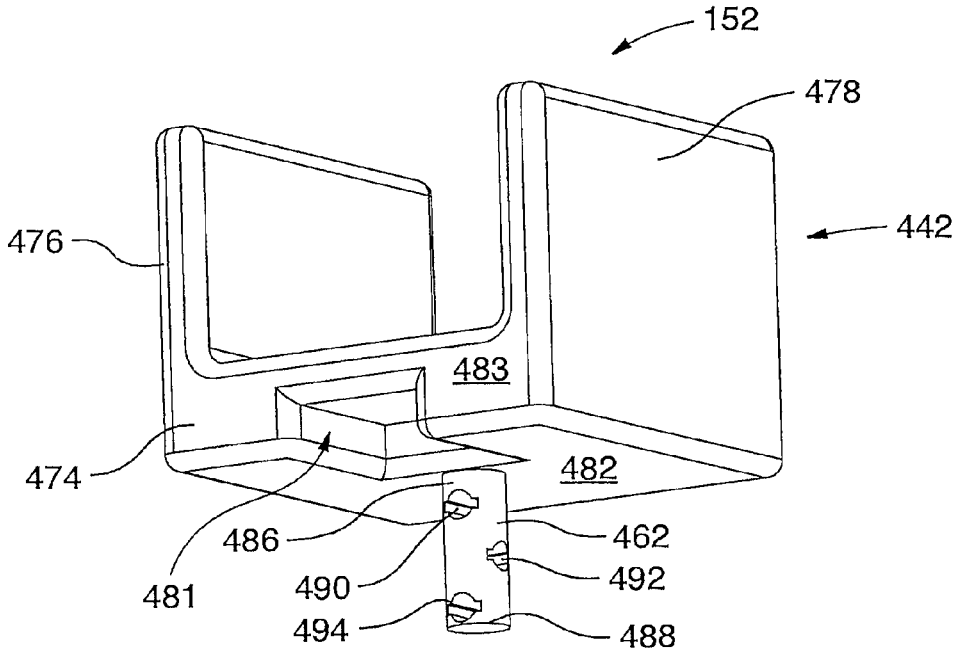
FIG. 13*b* is a cross-sectional view of the connector arm of the first arm restraint attachment shown in FIG. 13*a* taken along line "13*b*-13*b*"
Figure 13B:
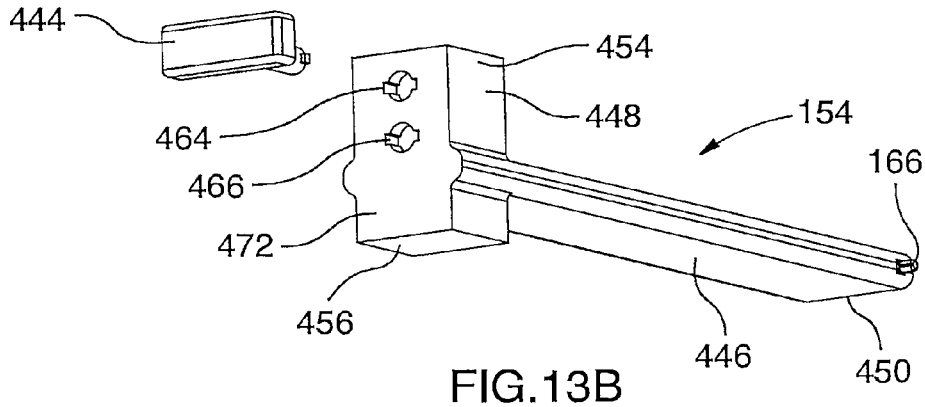

Referring now to FIGS. 13*a*, 13*b* and 13*c*, there is shown the first arm restraint attachment 152. The attachment 152 includes the connector arm 154 for attaching the arm restraint attachment 152 to the base 24, a generally U-shaped sleeve or retaining member 442 releasably connected to the connector arm 154 and a locking key 444 for securing the retaining member 442 to the connector arm 154. In the preferred embodiment, the connector arm 154 is formed by a bar 446 having an upstanding socket member 448 integrally formed therewith. The bar 446 has first end 450 adapted for insertion into a slot 150 and a second end 452 which carries the socket member 448. Projecting outward from the lateral edges of the first end 450 are the locking pins 166 and 168 which are designed to seat within locking recesses 180 (as shown in FIG. 8*c*). The first end view profile of the bar 446 is shaped to generally correspond to the shape of the slot 150. But to allow insertion of the first end 450 in to the slot 150, the cross-sectional area of the first end 450 is slightly smaller than the slot 150.

The socket member 448 has an upper end 454 which is carried above the bar 446 and a lower end 456 which depends downwardly from the bar 446. Formed in the upper end 454 is a blind bore 458. The bore 458 defines a female socket 460 for receiving the male connector pin 462 of the retaining member 442. Two indexing apertures 464 and 466 extend inwardly from the outer face 472 of the socket member 448 and open onto the female socket 460. Each indexing apertures 464, 466 has a shape generally similar to the keyhole 374 in that each includes a centrally disposed, circular opening 467 provided with a rectangular slot 468, 470 positioned on either side of, and opening onto, the circular opening 467. The indexing apertures 464 and 466 are sized to receive a portion of the locking key 444 inserted therethrough.

Referring specifically to FIG. 13*c* the U-shape retaining member 442 includes a back portion 474 and two spaced apart arm portions 476 and 478 which are joined to, and project upwardly from the back portion 474. In this embodiment, the space $S_i$ extending between the arms portions 476 and 478 is sized to accommodate a portion of a user's arm. However, it will be appreciated that in other embodiments, this space could be enlarged to accommodate a portion of user's leg. In such embodiments, the arm restraint attachment would in effect be transformed into a leg restraint attachment.

The inner horizontal face 480 of the back portion 474, the inner vertical face 482 of the arm portion 476, the inner vertical face (not shown) of the arm portion 478 which bound the space $S_1$, are provided with cushioning to enhance the user's comfort during exercise. The cushioning could take the form of a memory foam sheathed in a durable cover, such as vinyl.

A generally rectangular rebate 481 is cut into the back portion 474 at the juncture between the outer horizontal face 482 and the outer vertical face 483. When the first arm restraint attachment 152 is mounted to the base 24 in proximity to one of the casters 66, 72 or 74 (see for instance, arm restraint attachment 152*i* shown in FIG. 3), the rebate 481 serves to provide a clearance for accommodating the castor so as to prevent the castor from interfering with the positioning of the retaining member 442.

Projecting downwardly from the outer horizontal face 482 of the back portion 474 is the male connector pin 462. The connector pin 462 is generally cylindrical and has a proximal end 486 joined to the back portion 474 and a distal or free end 488 which can be inserted into the female socket 460. In the preferred embodiment, three indexing openings 490, 492 and 494 are cut into the connector pin 462 at spaced apart locations disposed between the proximal end 486 and the free end 488. The first indexing opening 490 is located closest to the proximal end 486. The second indexing opening 492 is disposed further down the connector pin 462, while the third indexing opening 494 is located furthest from the proximal end 486 close to the free end 488. When the male connector pin 462 is inserted within the female socket 460, one of the indexing openings 490, 492 and 494 is alignable with one of the indexing apertures 464 and 466 defined in the socket member 460. By inserting the locking key 444 through the aligned indexing opening and aperture the retaining member 442 can be secured to the connector arm 154.

As best shown in FIG. 13*c*, the indexing openings 490, 492 and 494 are not all aligned with each other along a common vertical axis—some are radially staggered from each other. More specifically, the first and third indexing openings 490 and 494 are vertically aligned with each other, but are radial staggered from the second opening 492 by an angle of 90 degrees.

This arrangement of indexing grooves 490, 492 and 494 serves a dual purpose. First, it permits a slight adjustment of the height at which the retaining member 442 is carried above the bar 446 and second, it allows the retaining member 442 to adopt a different orientation. By aligning the first indexing opening 490 with the first indexing aperture 464 when inserting the male connector pin 462 into the female socket member, the retaining member 442 is carried at its shortest height above the bar 446. However, it will be appreciated that the height of the retaining member 442 relative to the bar 446 can be increased by aligning the third indexing opening 494 with the first indexing aperture 464. The ability to adjust the height of the retaining member 442 tends to be very desirable because it further adds to the versatility of the apparatus 20. It may allow additional joint angles to be isolated and exercises to be performed at different angles for the recruitment of different muscles. Additionally, it may permit the apparatus 20 to be better adapted for the specific body of a user.

In FIG. 13*a* the retaining member 442 of the arm restraint attachment 152 is shown oriented with the space $S_1$ defined between opposing arms 476 and 478 being generally parallel to the longitudinal axis of the bar 446. The retaining member 500 of the accessory shown mounted in slot 150*c* (see FIG. 1) has a different orientation. More specifically, the space S extends generally perpendicular to the longitudinal axis of the bar 446. This perpendicular orientation is achieved by aligning the second indexing opening 492 with the first or second indexing apertures 464 and 466. Again, by altering the orientation of the retaining member 442 multiple variations of exercises become possible, thereby further enhancing the versatility of the isometric exercise apparatus 20.

Figure 13D:
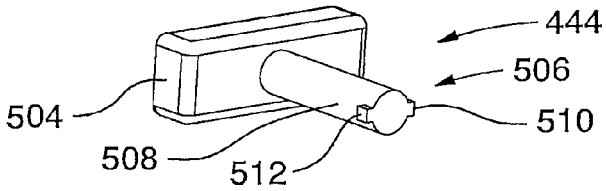
FIG. 13*d* is a side elevation view of the locking key shown in FIG. 13*c;*

Referring to FIG. 13*d*, the locking key 444 is configured generally similar to the indexing key 354 in that it a handle portion 504 at one end, a transverse key portion 506 fixed at the opposite end and a cylindrical portion 508 extending between the handle portion 504 and the key portion 506. When viewed from the side, the cylindrical portion 508 and the key portion 506 have a generally T-shaped profile. The key portion 506 has a pair of opposed locking tabs 510 and 512; each locking tab 510, 512 extending away from the juncture of the key portion 506 with the cylindrical portion 508. The cross-sectional area of the key portion 506 is sized slightly smaller than the indexing apertures 464 and 466 defined in the socket member 460 and the indexing openings 490, 492 and 494 formed in the connector pin 462 so as to allow insertion of the locking key 444 through the socket member 468 and the connector pin 462. When the locking key 444 is inserted through the indexing aperture and the indexing opening and is pivoted, its the locking tabs 510 and 512 are misaligned with the rectangular slots 468 and 470 thereby preventing the locking key 444 from being removed from the indexing aperture and indexing opening.

Figure 13E:
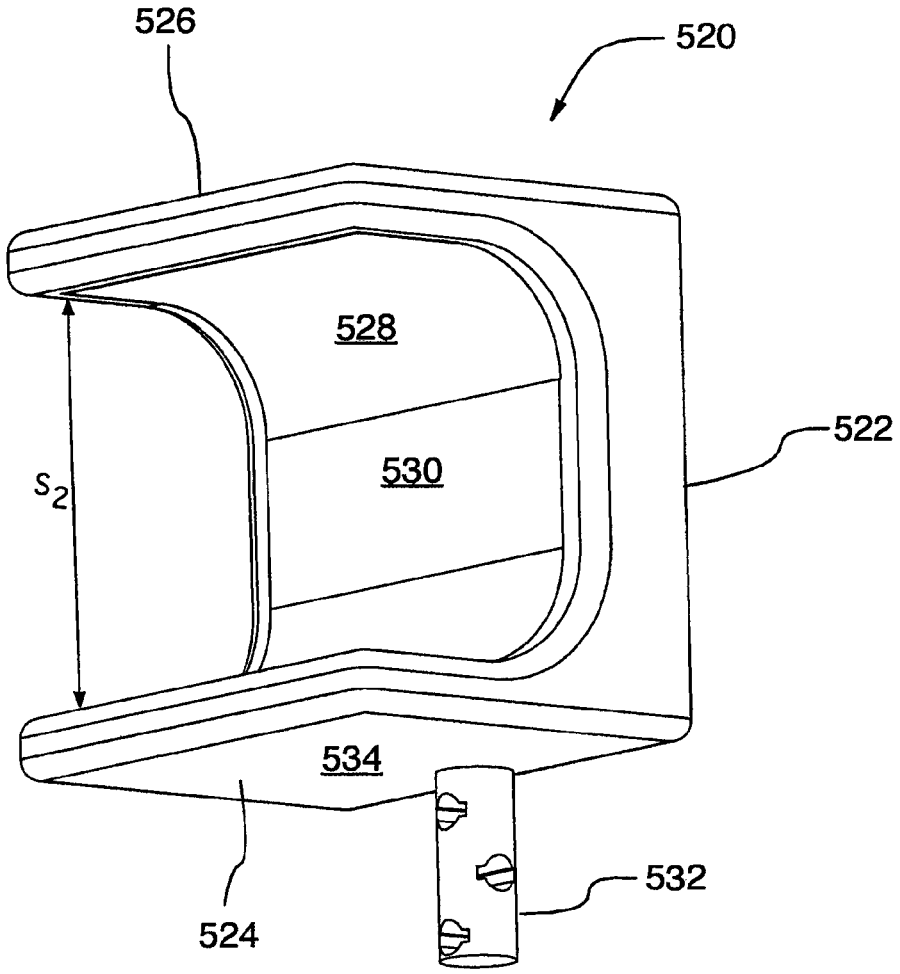
FIG. 13*e* is a perspective view of a retaining member according to an alternate embodiment to that shown in FIG. 13*c;*

Referring to FIG. 13*e*, there is shown an alternate retaining member 520 which may be used with the connector arm 154 and the locking key 444. The retaining member 520 has a structure that generally resembles that of retaining member 442 in that the retaining member 520 is also provided with a back portion 522, two spaced apart arm portions 524 and 526 which are joined to, and project upwardly from the back portion 474 and a space $S_2$ which extends between the arms portions 524 and 526. However, in this embodiment the space $S_2$ is bound by the horizontal inner face 528 of arm portion 524, the vertical inner face 530 of the back portion 522 and the horizontal inner face (not visible) of the arm portion 526. Also, in contrast to the retaining member 442 which is generally U-shaped, the shape of the retaining member 520 is more like that of a "C". Instead of having a male connector pin extending downwardly from the horizontal outer face of the back portion like in the retaining member 442, the male connector pin 532 of retaining member 520 extends downwardly from the horizontal outer face 534 the arm portion 524. The male connector pin 532 is configured for insertion into the socket 460 of the connector arm 154 and is adapted to interact with the locking key 444 in much the same manner as the male connector pin 462 shown in FIG. 14*b*, such that no additional description is required.

The provision of C-shaped retaining member 520 is advantageous and enhances the versatility of the apparatus 20 in that it allows the user to perform isometric exercises that include a vertical force vector. The C-shaped retaining member 520 and more specifically the arm portion 526 thereof, acts as a restraint against a portion of the user's arm during the performance of such isometric exercises.

Figure 14A:
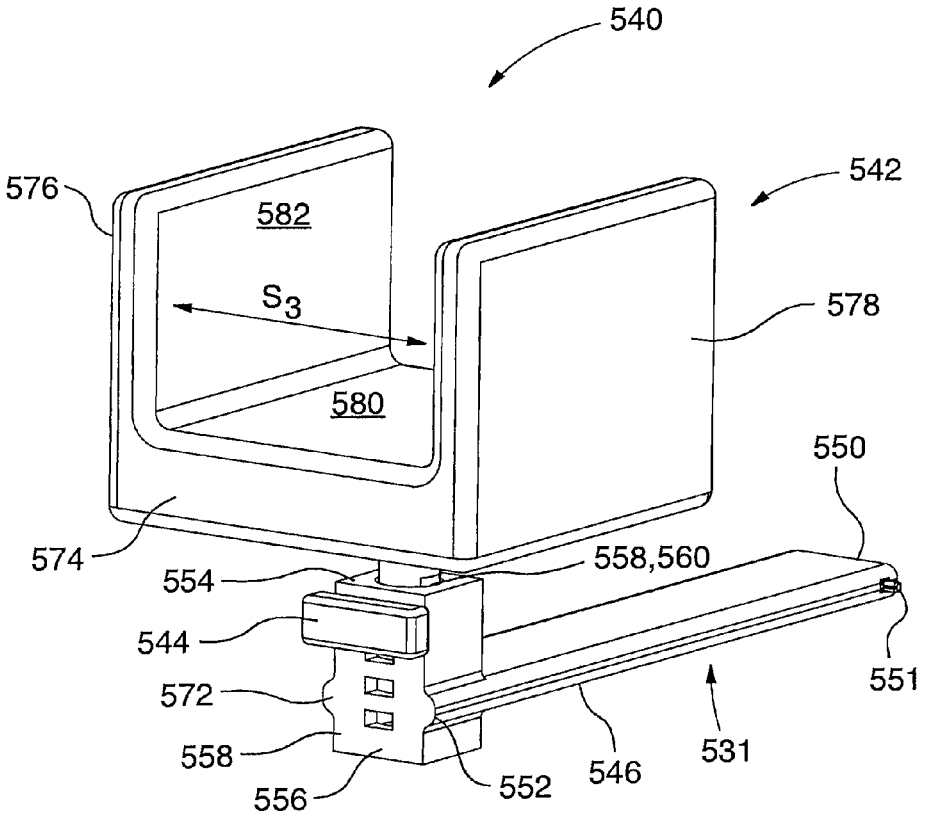
FIG. 14*a* is an isolated perspective view of a first alternate arm restraint attachment according to alternate embodiment to that shown in FIG. 14*a;*
Figure 14B:
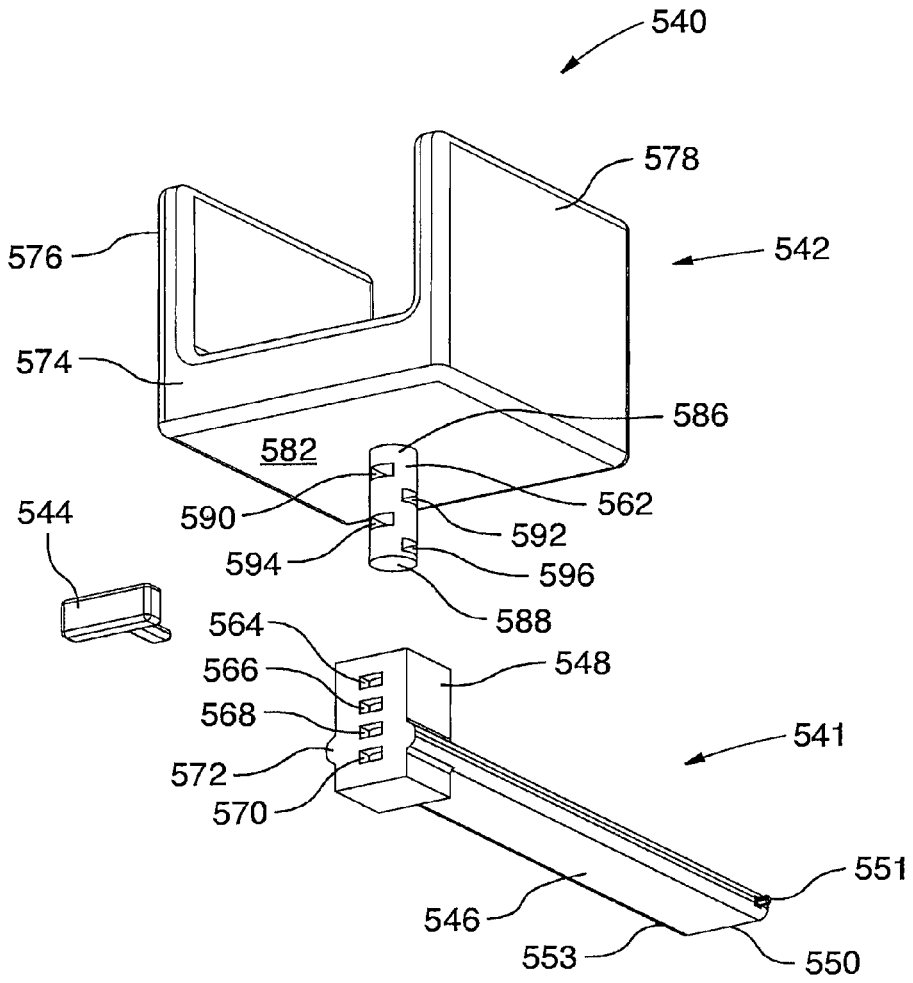
FIG. 14*b* is an exploded perspective view of the first alternate arm restraint attachment shown in FIG. 14*a;*

Referring now to FIGS. 14*a* and 14*b*, there is shown a second arm restraint attachment 540 according to another embodiment of the present invention. The attachment 540 is generally similar to the attachment 152 in that it too includes a connector arm 541 for attaching the arm restraint attachment 540 to the base 24, a generally U-shaped sleeve or retaining member 542 releasably connected to the connector arm 541 and a locking key 544 for securing the retaining member 542 to the connector arm 541.

In like fashion to the connector arm 154, the connector arm 541 is formed by a bar 546 having an upstanding socket member 548 integrally formed therewith. The bar 546 has first end 550 adapted for insertion into a slot 150 and a second end 552 which carries the socket member 548. Projecting outward from the lateral edges of the first end 550 are the locking pins 551 and 553 (seen on FIG. 14*a*) which are generally similar to locking pins 166 and 168 and which are designed to seat within locking recesses 180. The first end view profile of the bar 546 is shaped to generally correspond to the shape of the slot 150. But to allow insertion of the first end 550 in to the slot 150, the cross-sectional area of the first end 550 is slightly smaller than the slot 150.

The socket member 548 is generally similar to the socket member 448 in that it too has an upper end 554 which is carried above the bar 546 and a lower end 556 which depends downwardly from the bar 546. Formed in the upper end 554 is a blind bore 558. The bore 558 defines a female socket 560 for receiving the male connector pin 562 of the retaining member 542. However, in contrast to the socket member 448 which has only two indexing apertures 466 and 468, the socket member 548 has four indexing apertures 564, 566, 568 and 570 which extend inwardly from the outer face 572 of the socket member 548 and open onto the female socket 560. Moreover, instead of having a keyhole shape, the indexing apertures 464, 466, 468 and 470 are generally rectangular and are sized to receive a portion of the locking key 444 inserted therethrough.

Referring specifically to FIG. 14*b*, the U-shape retaining member 542 generally resembles the retaining member 442. The retaining member 542 includes a back portion 574, two spaced apart arm portions 576 and 578 which are joined to, and project upwardly from the back portion 474, and a space $S_3$ extending between the arms portions 476 and 478. The space $S_3$ is bound by the inner face 580 of the back portion 574, the inner face 582 of the arm portion 576, the inner face (not shown) of the arm portion 578.

Projecting downwardly from the outer face 582 of the back portion 574 is the male connector pin 562. The pin 562 is generally cylindrical and has a proximal end 586 joined to the back portion 574 and a distal or free end 588 which can be inserted into the female socket 560. However, instead of having indexing apertures open at both ends similar to indexing apertures 490, 492 and 444, the connector pin 562 in this embodiment, has four indexing grooves or notches 590, 592, 594 and 596 disposed at spaced apart locations between the proximal end 586 and the free end 588. The first indexing groove 590 is located closest to the proximal end 586. The second indexing groove 592 is disposed further down the connector pin 562, while the third indexing groove 594 is located still further from the proximal end 586. Lastly, the fourth indexing groove is located furthest from the proximal end 586 close to the free end 588. When the male connector pin 562 is inserted within the female socket 560, one or more of the indexing grooves 590, 592, 594 and 596 is alignable with one or more of the indexing apertures 564, 566, 568 and 570 defined in the socket member 560. By inserting the locking key 544 through the aligned indexing groove and aperture the retaining member 542 can be secured to the connector arm 541.

As best shown in FIG. 14*c*, the indexing grooves 590, 592, 594 and 596 are not all aligned with each other along a common vertical axis—some are radially staggered from each other. More specifically, the first and third indexing grooves 590 and 594 are vertically aligned with each other, but are radial staggered from the second and fourth grooves 592 and 596 (which are also vertically aligned with each other) by an angle of 90 degrees.

This arrangement of indexing grooves 590, 592, 594 and 596 serves a dual purpose. First, it permits adjustment of the height at which the retaining member 542 is carried above the bar 546 and second, it allows the retaining member 542 to adopt a different orientation. By aligning the first indexing groove 590 with the first indexing aperture 564 when inserting the male connector pin 562 into the female socket member, the retaining member 542 is carried at its shortest height above the bar 546. However, it will be appreciated that the height of the retaining member 542 relative to the bar 546 can be increased by aligning the third indexing groove 594 with the first indexing aperture 564.

In FIG. 14*a* the retaining member 542 of the second arm restraint attachment 520 is shown oriented with the space $S_3$ defined between opposing arms 576 and 578 being generally parallel to the longitudinal axis of the bar 546. However, the retaining member 542 may be oriented differently to allow the space $S_3$ to extend generally perpendicular to the longitudinal axis of the bar 546. This perpendicular orientation would be achieved by aligning the second indexing groove 592 with the first or second indexing apertures 564 and 566, or by aligning the fourth indexing groove 596 with any of one of the indexing apertures 564, 566, 568 and 570. Again, by altering the orientation of the retaining member 542 multiple variations of exercises become possible, thereby further enhancing the versatility of the isometric exercise apparatus 20.

Referring back to FIG. 14*a*, the locking pin 544 is shown to have a generally rectangular portion 597 which serves as a knob to facilitate grasping of the locking pin and an engagement portion 599. The engagement portion 599 is adapted to fit into the indexing apertures 464, 466, 468 and 470 and the indexing groove 590, 592, 594 and 596.

Figure 15:
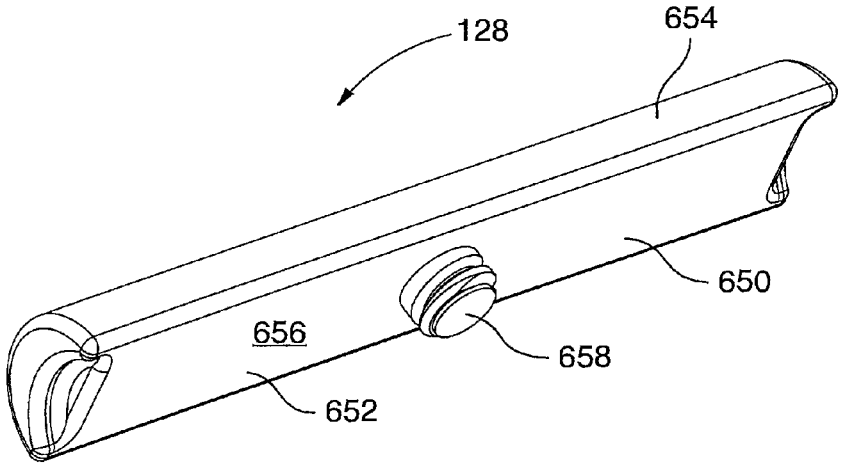
FIG. 15 is an isolated perspective view of the foot pad shown in FIG. 1.

FIG. 15 shows the footpad 128. The footpad 128 has a generally elongate body 650 provided with a rigid plate 652. The rigid plate 652 is topped by a foam pad 654 sheathed in a protective cover. While in this embodiment, the foam pad 654 has a semi-circular profile, this need not be the case in every application. In alternative embodiments, the foam pad or for that matter, the entire footpad could be configured differently.

Extending from the bottom face 656 of the rigid plate 652 is a threaded connector 658 which is used to secure the footpad 128 to the base 24. More specifically, when mounting the footpad 128 to the base 24, the threaded connector 658 is inserted through the aperture 126 defined in the exercise platform 122 and into the threaded blind bore formed in the top face 28 of the base 24 (see FIG. 24) where it is fastened. Preferably, when attached to the base 24, the elongate body 650 of the footpad 128 is oriented generally parallel to the short sides 28 and 32 of the base 24 (as best shown in FIG. 4).

Figure 16:
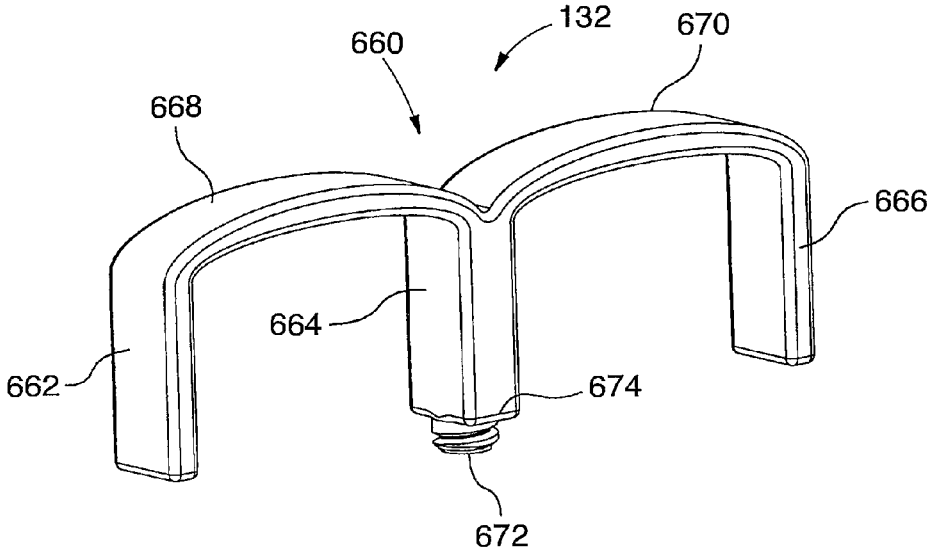
FIG. 16 is an isolated perspective view of the dual foot restraint attachment shown in FIG. 6.

With reference to FIGS. 6 and 16, the dual foot restraint accessory 132 is now described in greater detail. The dual foot restraint accessory 132 has a dual arch structure 660 defined by a three spaced apart vertical members 662, 664 and 666. The second vertical member 664 is disposed between the first and third vertical members 662 and 666. Joining the first vertical member 662 to the second vertical member 664 at their respective top ends is a first arch member 668. Similarly, a second arch member 670 spans the space between the second and third vertical members 664 and 666 to connect their respective top ends to each other. A threaded connector 672 extending from the bottom end 674 of the second vertical member 662, is used to secure the accessory 132 to the base 24. In like fashion to threaded connector 658 of footpad 128, the threaded connector 672 is configured for insertion through the aperture 126 defined in the exercise platform 122 and into the threaded blind bore formed in the top face 28 of the base 24.

As best shown in FIG. 6, when mounted onto the base 24, the dual arch structure 660 is oriented generally parallel to the short sides 28 and 32 of the base 24. The dual arch structure 660 in cooperation with the exercise platform 122 define a pair of apertures 676 and 678 through which a user can insert their feet.

The dual arch structure 660 can be fabricated of hard plastic or metal, but preferably it is coated with a resilient material such as rubber to enhance the comfort of the user. It should be appreciated that in other embodiments, the dual foot restraint accessory could be configured differently. For instance, in an alternative embodiment, the dual foot restraint accessory could replace the dual arch structure with a pair of foot straps connected to each other.

Figure 17:
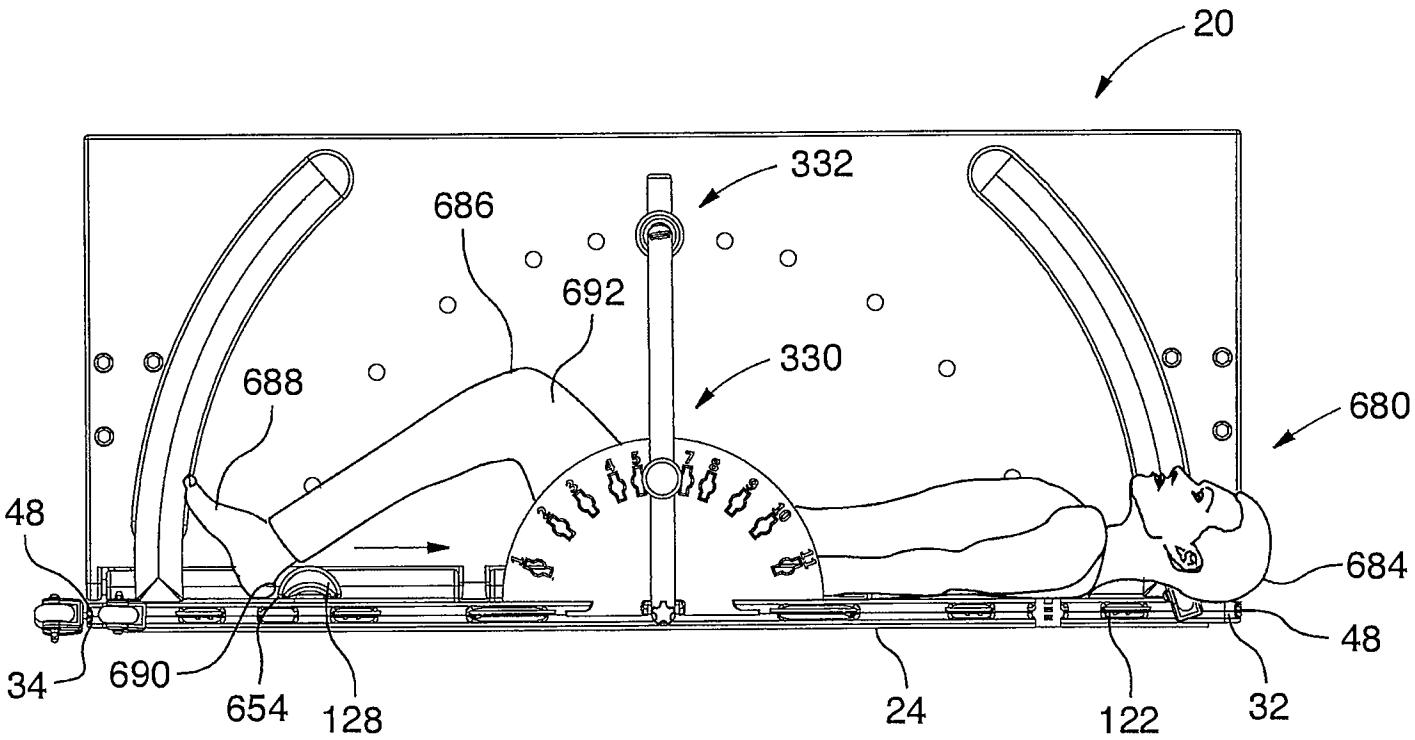
FIG. 17 is a front elevation view of a user positioned within the isometric exercise apparatus of FIG. 1, shown performing an isometric exercise utilizing the footpad accessory as a restraint to urge contraction of the calf muscles of the user's legs; the arm restraint accessories having been omitted for the sake of clarity.

Exemplary uses of the isometric exercise apparatus 20 are now described with reference to FIGS. 17 to 24. FIG. 17 shows a user identified generally with reference numeral 680, using the footpad 128 to perform an exercise to work the user's calf (gastrocnemius) muscle. As a preliminary matter, the user 680 ensures that the swing arm 332 is moved to its fully vertical position. Alternatively, to provide increased clearance to the user 680, the restraint arm assembly 330 could be detached from the frame 22 as described below. The user 680 then lies down on the base 24 with his back supported on the exercise platform 122. His head 684 is positioned proximate the outer edge 48 of first short side 32, while the remainder of his body extends toward the opposed second short side 34. The user's hip (not visible) and knees 686 are flexed to approximately 45 degrees. The user's feet 688 are disposed between the outer edge 48 and the footpad 128 with his heels 690 resting against the pad 654 of the footpad 128. Once in position, the user attempts to pull his heels 690 towards his buttocks (not visible) with the pad 654 acting as a restraint for his heels 690, thereby causing the calf muscles in his legs 692 to isometrically contract. The user may hold this position for a number of seconds, and repeat as desired. This exercise may be performed one leg at a time and may be performed with the foot (or feet) internally or externally rotated.

Figure 18:
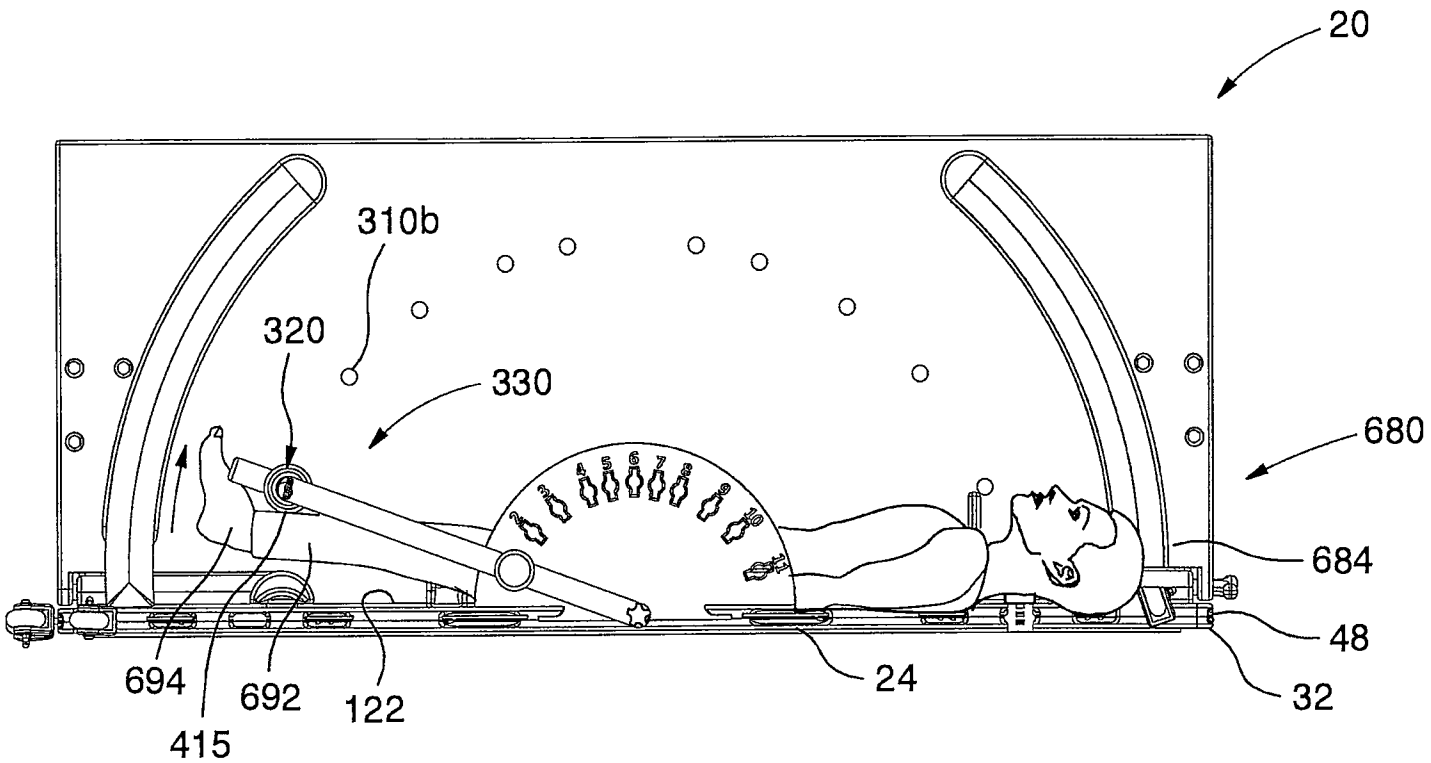
FIG. 18 is a front elevation view of a user positioned within the isometric exercise apparatus of FIG. 1, shown performing an isometric exercise utilizing the horizontal restraint member of the restraint arm assembly as a restraint to urge contraction of certain of user's hip flexor muscles; the arm restraint accessories having been omitted for the sake of clarity.

FIG. 18 shows the user 680 using the horizontal restraint member 320 of the restraint arm assembly 330 to perform an isometric exercise to work certain of the user's hip flexor muscles. As a preliminary matter, the user 680 adjusts the restraint arm assembly 330 so that the restraint arm 320 is carried above the exercise platform 122 at a first angular position defined by the angle $\theta_a$ (see FIG. 4*a*). The user 680 then lies down on the base 24 with his back supported on the exercise platform 122. His head 684 is positioned proximate the outer edge 48 of first short side 32, while the remainder of his body extends toward the opposed second short side 34. The user's legs 692 extend between the restraint arm 320 and the exercise platform 122. The user 680 raises his legs 692 by flexing his hips (not visible) while keeping his knees (not visible) straight, and brings a portion of each leg 692 above the ankle 694 to bear against the foam pads 415 and 417 of the restraint arm 320. Once in position, the user 680 attempts to further raise his legs 692 against the restraint action of the restraint arm 320, thereby causing the rectus femoris or hip flexor muscles in his legs 692 to isometrically contract. The user may hold this position for a number of seconds, and repeat as desired. This exercise may be performed one leg at a time and may be performed with the leg or legs internally rotated.

Figure 19:
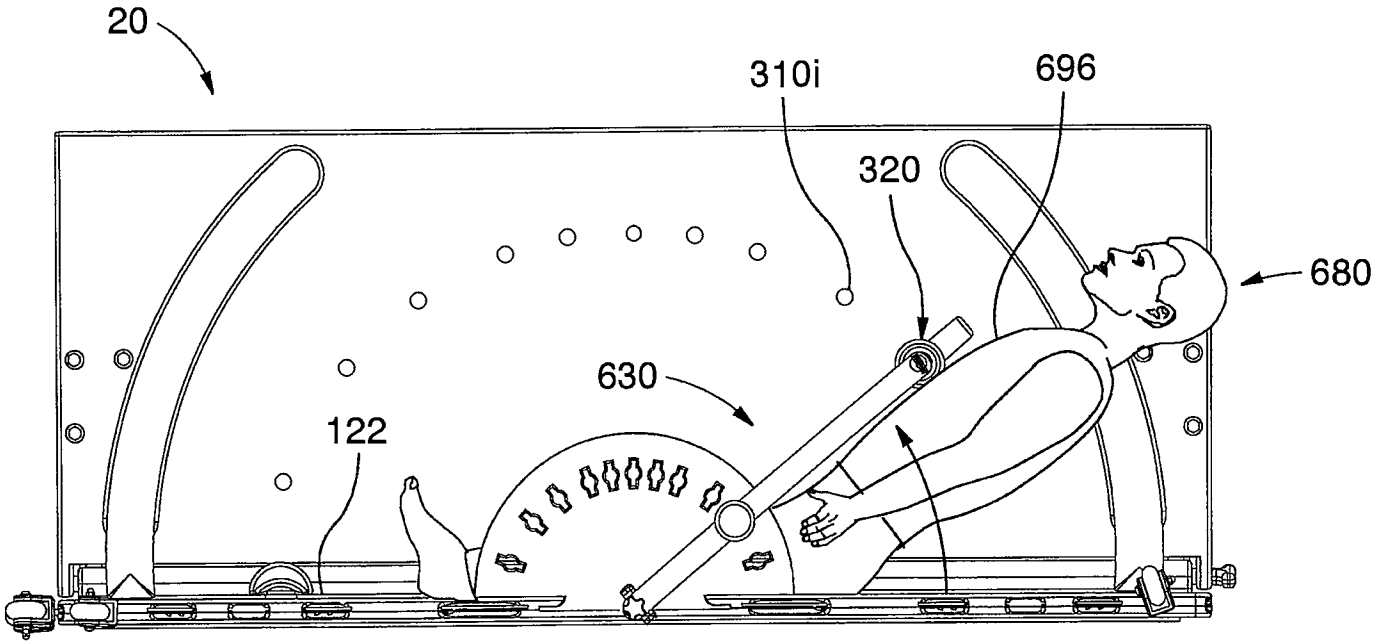
FIG. 19 is a front elevation view of a user positioned within the isometric exercise apparatus of FIG. 1, shown performing an isometric exercise utilizing the horizontal restraint member of the restraint arm assembly as a restraint to urge contraction of certain of the user's abdominal muscles; the arm restraint accessories having been omitted for the sake of clarity.

FIG. 19 shows the user using the horizontal restraint member 320 of the restraint arm assembly 330 to perform an isometric exercise to work the certain of the user's abdominal muscles and more specifically, the transverse abdominis muscles. As a preliminary matter, the user 680 adjusts the restraint arm assembly 330 so that the restraint arm 320 is carried above the exercise platform 122 at an angular position defined by the angle $\theta_k$ (see FIG. 4*a*). The user 680 sits on the platform 122 and raises his torso until his chest 696 makes contact with the restraint arm 320. Thereafter, the user pulls his chest 696 or upper torso into the arm 320 against the restraint of the arm 320 thereby causing his abdominal muscles to contract isometrically. The user may hold this position for a number of seconds, and repeat as desired.

Figure 20:
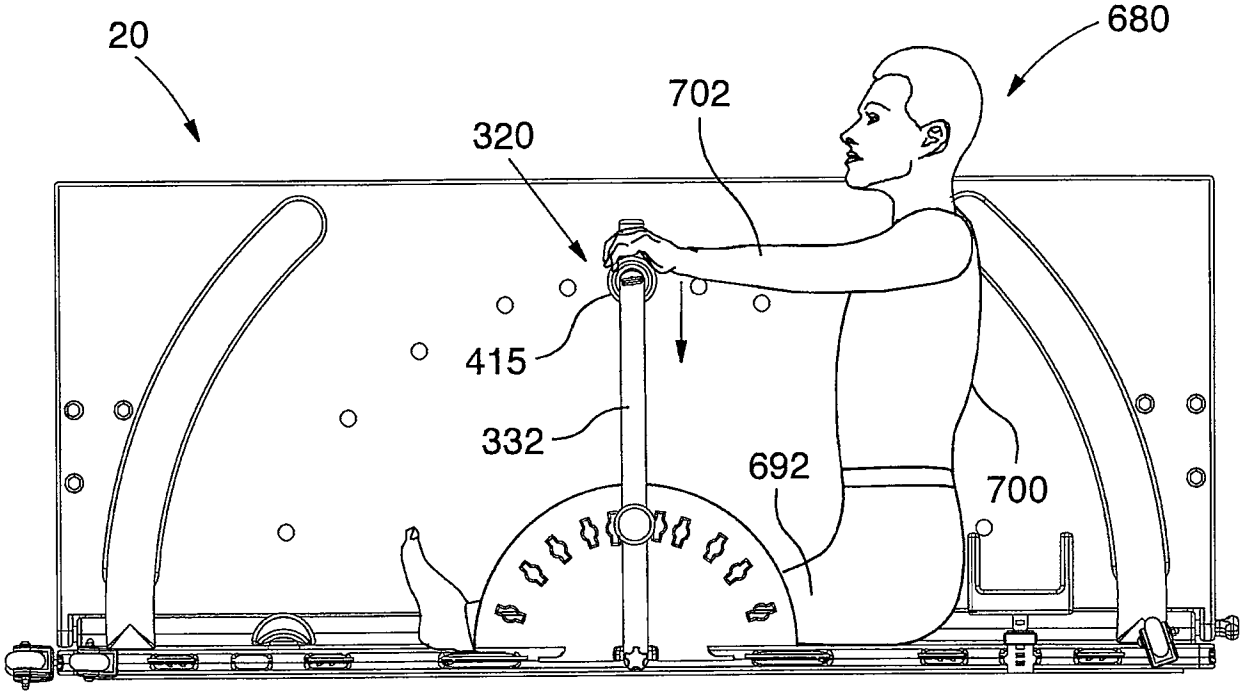
FIG. 20 is a front elevation view of a user positioned within the isometric exercise apparatus of FIG. 1, shown performing an isometric exercise utilizing the horizontal restraint member of the restraint arm assembly as a restraint to urge contraction of certain of the user's back muscles; the aim restraint accessories having been omitted for the sake of clarity.

FIG. 20 shows the user 680 using the horizontal restraint member 320 of the restraint arm assembly 330 to perform an isometric exercise to work the user's back muscles, more specifically, the latissimus dorsi muscles, and the triceps brachii muscles located in the upper arm. As a preliminary matter, the user 680 ensures that the swing arm 332 is moved to its fully vertical position. The user sits up on the platform 122 with his legs 692 substantially perpendicular to his back 700 and his arms 702 outstretched in front of him extending generally parallel to his legs 692. The user is positioned on the platform in such a way as to allow the user to grasp the foam pads 415 and 417 of the restraint arm 320. With his palms facing down, the user then pulls on the restraint arm 320 in a downward direction to thereby cause the isometric contraction of the user's latissimus dorsi muscles and triceps brachii muscles. The user may hold this position for a number of seconds, and repeat as desired.

Figure 21:
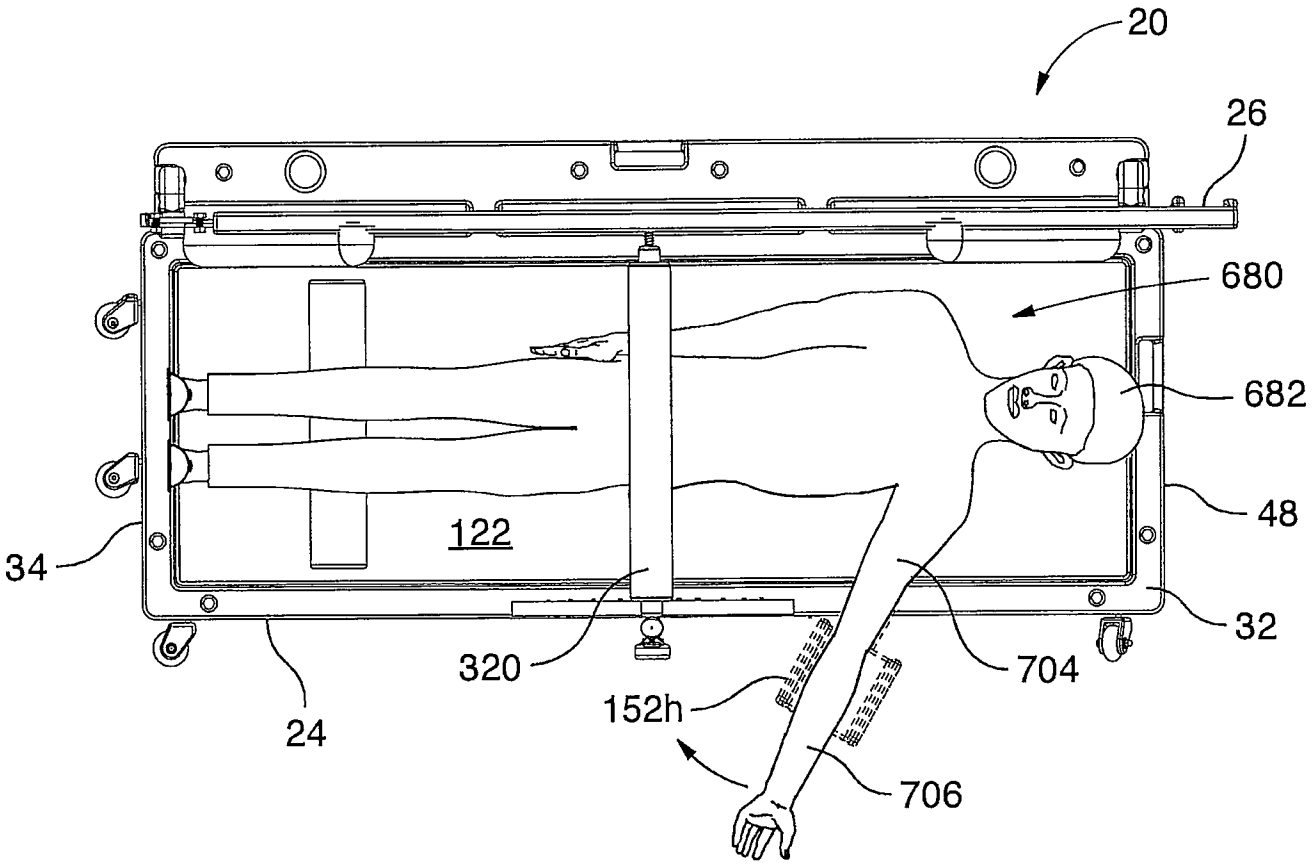
FIG. 21 is a top plan view of a user positioned within the isometric exercise apparatus of FIG. 1, shown performing an isometric exercise utilizing the arm restraint attachment as a restraint to urge contraction of the user's rhomboid muscles.

FIG. 21 shows the user 680 using the arm restraint attachment 152*i* to perform an isometric exercise to work the user's rhomboid muscles (the muscles located between the shoulder blades). As a preliminary matter, the user 680 ensures that the swing arm 332 is moved to its fully vertical position. Alternatively, to provide increased clearance to the user 680, the restraint arm assembly 330 could be detached from the frame 22 as described below. The user 680 then lies down on the base 24 with his back supported on the exercise platform 122. His head 684 is positioned proximate the outer edge 48 of first short side 32, while the remainder of his body extends toward the opposed second short side 34. The user places his arm 704 (and more specifically, his forearm 706) into the space $S_1$ defined in U-shaped retaining member 442. Once in position, the user pulls his arm towards his body and against the restraint created by the arm portion 476 of the retaining member 442 thereby urging the user's rhomboid muscle to isometrically contract. The user may hold this position for a number of seconds, and repeat as desired. In FIG. 21, the user 680 is shown performing this exercise with his arm externally rotated. It will be appreciated that this exercise could also be performed with the arm internally rotated or with the palm of the hand turned to face the body of the user.

FIG. 22 shows the user 680 using the sidewall 26 to perform an isometric exercise to work one of the user's hip flexor muscles and more specifically, the tensor fascia lata muscle. To get into position, the user 680 stands on the platform 122 facing the second short side 34 with his heels 690 adjacent the first short side 32 and his legs 692 spread approximately shoulder width apart. Once in position, the user 680 abducts his right leg 692*a* approximately 20 degrees (that is, the user moves his right leg 692*a* away from the left leg 692*b*) so that the blade of his foot 708 comes to bear against the arc-shaped pad 304. The user 680 pulls his foot 708 into the pad 304 against the restraint created by the sidewall 26 thereby urging the user's tensor fascia lata muscle to isometrically contract. The user may hold this position for a number of seconds, and repeat as desired. The user may perform the same exercise for his left leg by positioning himself on the opposite short side 34.

FIG. 23 shows the user 680 using the dual foot restraint attachment 132 to perform an isometric exercise to work one of the user's lower leg muscles and more specifically, the popliteus muscle located behind the knee. As a preliminary matter, the user 680 ensures that the swing arm 332 is moved to its fully vertical position. Alternatively, to provide increased clearance to the user 680, the restraint arm assembly 330 could be detached from the frame 22 as described below. The user 680 then lies down on the base 24 with his back supported on the exercise platform 122. His head 684 is positioned proximate the outer edge 48 of first short side 32, while the remainder of his body extends toward the opposed second short side 34. Alternatively, the user 680 can sit up on the platform 122 with his back generally perpendicular to his legs 692. The user then inserts his right foot 708*a* into the aperture 678 and his left foot 708*b* into the aperture 676. Once in position, the user rotates his lower legs inwardly and pulls each of the right foot 692*a* and left foot 692*b* into the vertical member 664 of the dual arch structure 660. In this case, the vertical member 664 acts as the restraint against which the user is acting which urges the popliteus muscles in the user's lower legs to isometrically contract. The user may hold this position for a number of seconds, and repeat as desired. This exercise may be performed one leg at a time and may be performed with the lower leg or legs externally rotated. When performed with the lower legs rotated externally, the feet 692 and 692*b* would be urged to pull against the vertical members 662 and 666 of the dual arch structure 660.

The examples described above are not intended to be exhaustive or limiting in any way and are merely provided to illustrate only some of the possible ways in which the isometric exercise apparatus 20 may be used.

Once the user has completed performing exercises on the isometric exercise apparatus 20, the frame 22 of the apparatus 20 could be collapsed to facilitate storage of the apparatus 20. The procedure for moving the apparatus 20 from its in-use position 253 to its out-use position 251 is now described with reference to FIGS. 24, 25 and 26. As an initial step, the pads 304 and 306, the swing assembly 330 and all the attachments (i.e. the footpad 128, the arm restraint attachments 152, and any others) are detached from the isometric exercise apparatus 20. More specifically, sufficient force is applied to the pads 304 and 306 to overcome the magnetic forces which retain the pads 304 and 306 on the panel 212.

Next the swing assembly 330 is partially disassembled. The indexing key 354 is disengaged the from the indexing plate 360 and the rod 336 by rotating the indexing key 354 until it tabs 400 and 402 are aligned with the slots 382 and 384 of the indexing aperture 374 defined in the indexing plate 360 and the slots 350 and 352 of the keyhole 346 defined in the rod 336 and then pulling out the indexing key 354. The pivot pin 342 is then unfastened from the base 24 and the locking pin 420 of the restraint arm 320 is moved to its retracted or disengaged position 434, thereby releasing the swing arm 332 from the frame 22.

Subsequently, the threaded connector 658 of the footpad 128 is unfastened from the base 24. If the dual foot restraint 660 is mounted on the apparatus 20, it can be detached by unfastening its threaded connector 672. To detach the arm restraint accessory 152 from the base, the connector arm 154 is pulled outwardly and upwardly to release the locking pins 166 and 168 from the locking recesses 180. With locking pins released, the connector arm 154 can be pulled out of the slot 150.

The order of removal described above was provided as an example only. It is not intended to be limiting. In other embodiments, the order of removal for the accessories could be modified. For instance, the arm restraint accessories could be removed first, followed by the foot pad and culminating with the arc-shaped pads.

Figure 25:
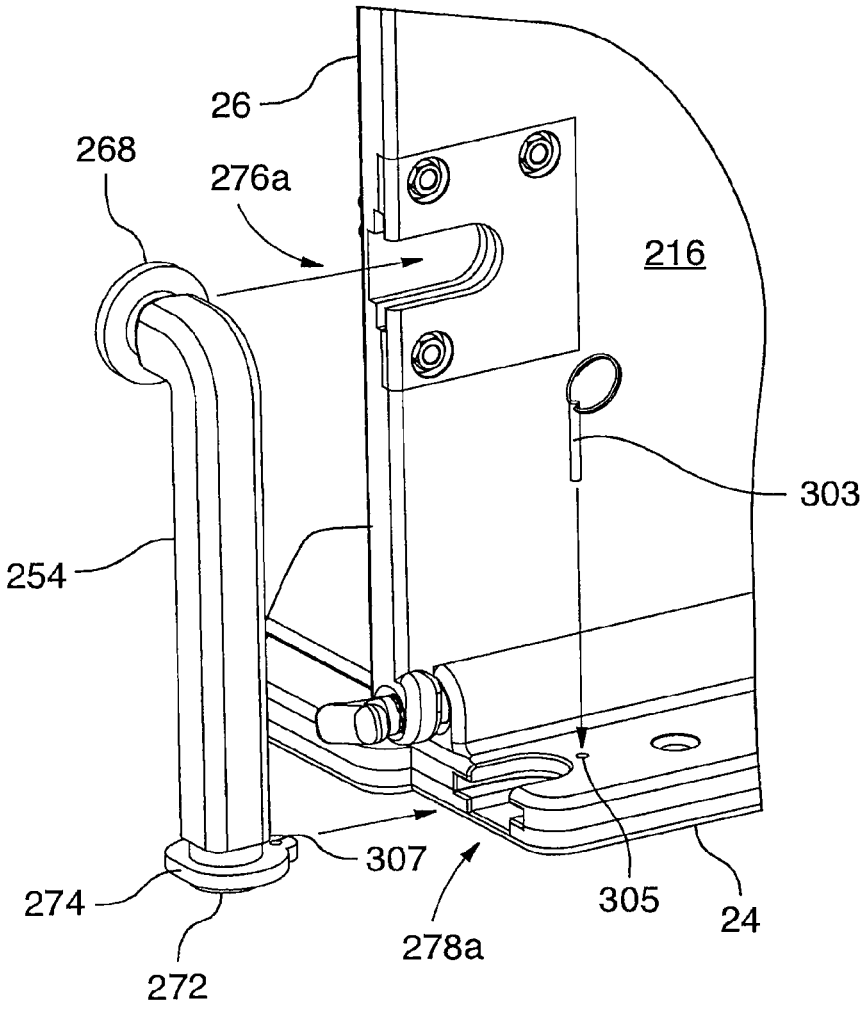
FIG. 25 is an isolated, partially exploded, rear perspective view of a portion of the isometric exercise apparatus illustrated in FIG. 2 showing the side locking bars exploded from the apparatus frame.
Figure 26:
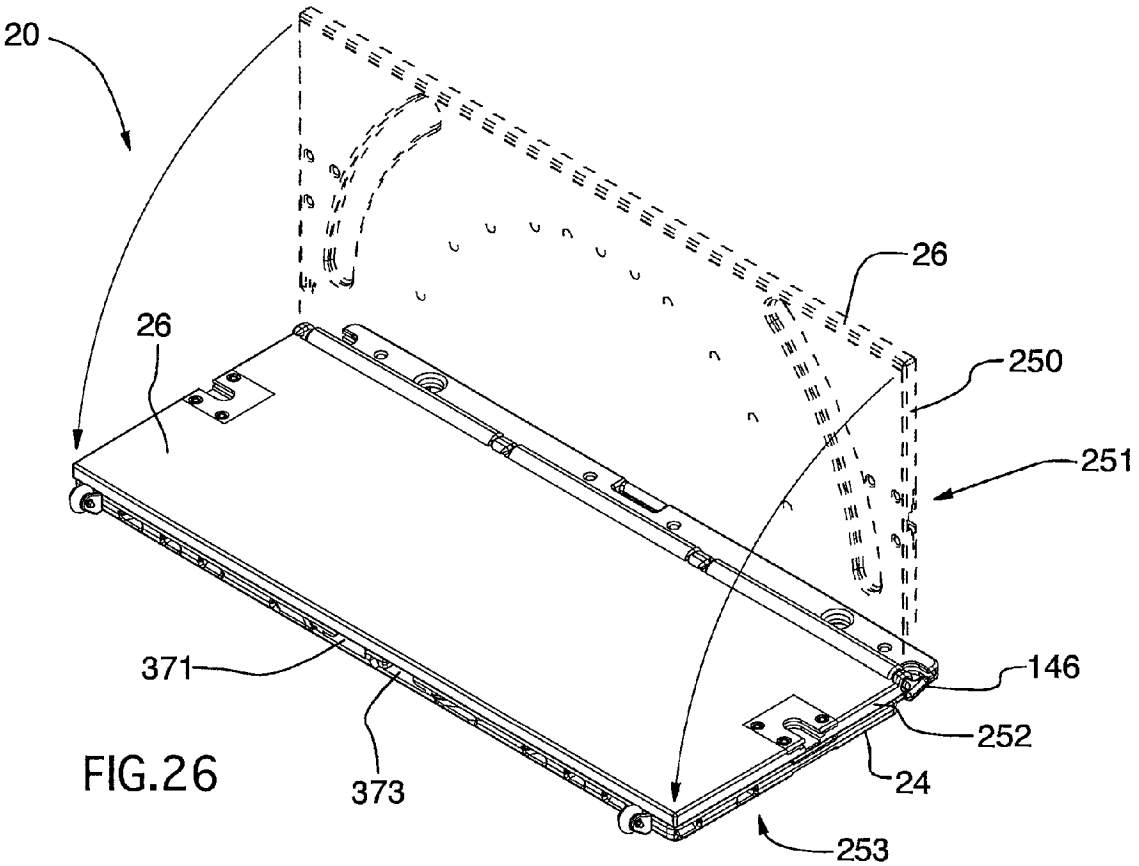
FIG. 26 is a perspective view of the isometric exercise apparatus illustrated in FIG. 1 showing apparatus frame absent the restraint arm assembly, the footpad, the arm restraint attachments, the arc-shaped pads and the side locking bars, the side panel being moved to its collapsed position and the isometric exercise apparatus in its out-of-use, storage configuration.

Next, the lock bars 254 and 256 are removed from the frame 22 by removing the locking pins 303 and sliding the first and second flange portions 268 and 274 of each lock bar 254, 256 out from their respective stations 276*a*, 276*b* or 278*a*, 278*b* (as the case may be) (see FIG. 25). The sidewall 26 is then be pivoted about the hinge rod 146 and brought to its collapsed position 250. With sidewall 26 bearing against the base 24, the frame 22 is now collapsed and the apparatus 20 is in its out-of-use storage position 253 as shown in FIG. 26. When in its out-of-use storage position 253, the apparatus 20 is portable and can be relatively easily carried or transported. In this embodiment, when collapsed the frame 22 bereft of any attachments or accessories weighs approximately 45 lbs. However, in other embodiments, the frame may weigh less or more depending on the intended usage of the apparatus and whether the portability of the apparatus is a factor to be afforded greater or lesser importance for this intended usage.

Figure 28:
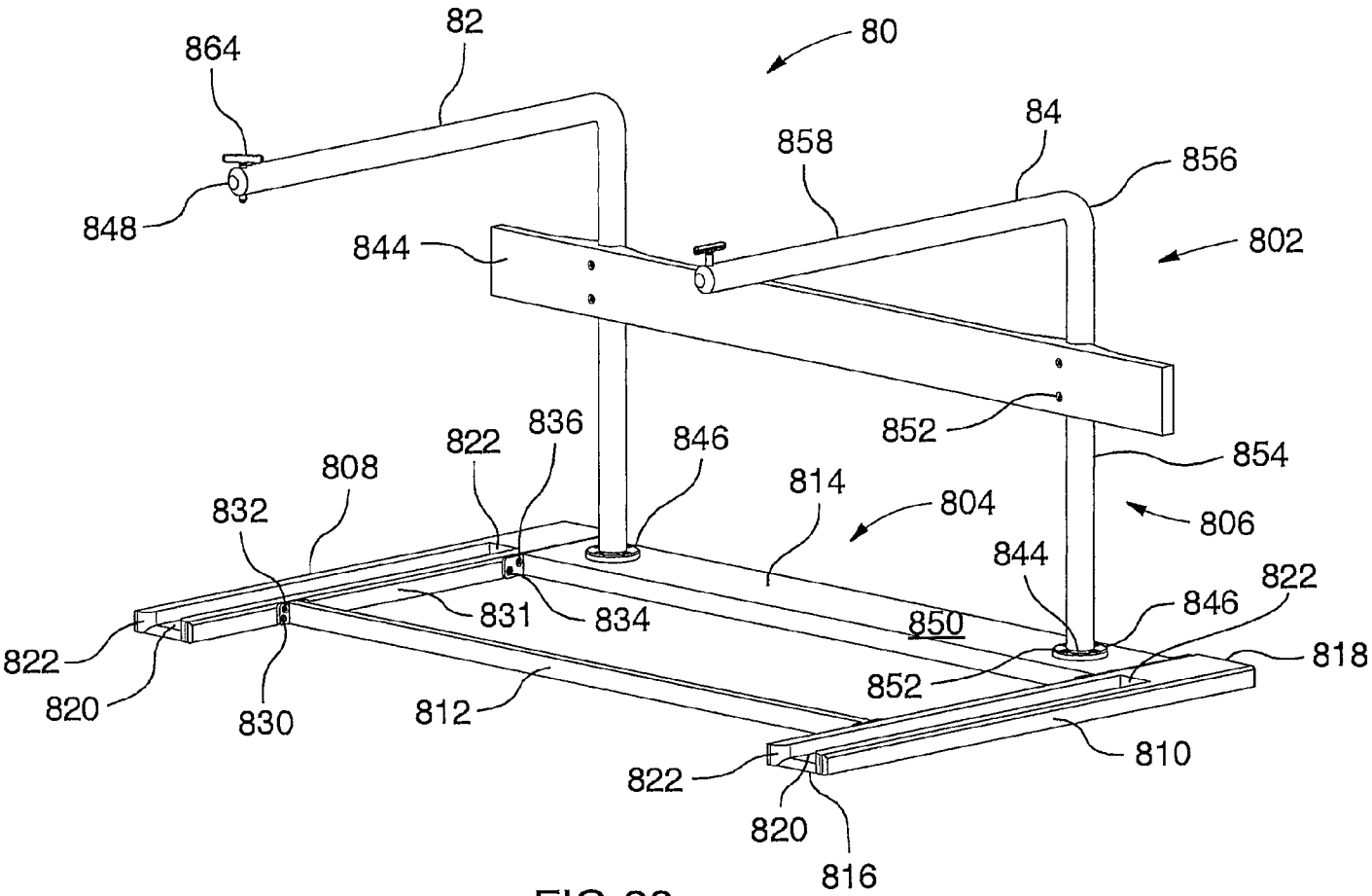
FIG. 28 is a perspective view of a rack member for holding at least one isometric exercise apparatus in its out-of use storage configuration, in accordance with an embodiment of the present invention.
Figure 29:
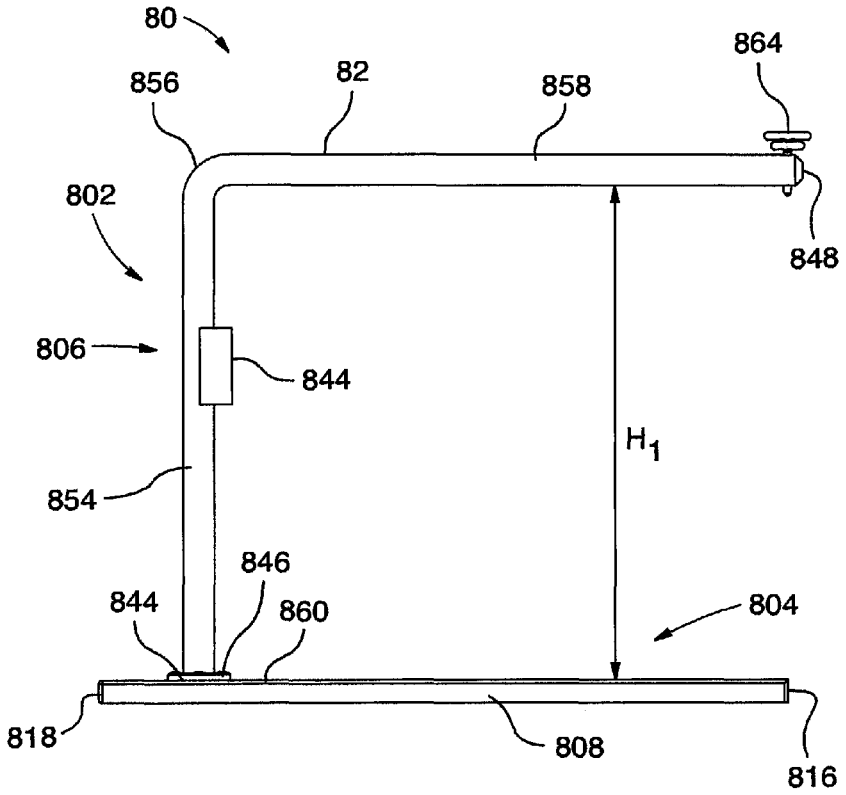
FIG. 29 is a side elevation view of the rack member shown in FIG. 28.
Figure 32:
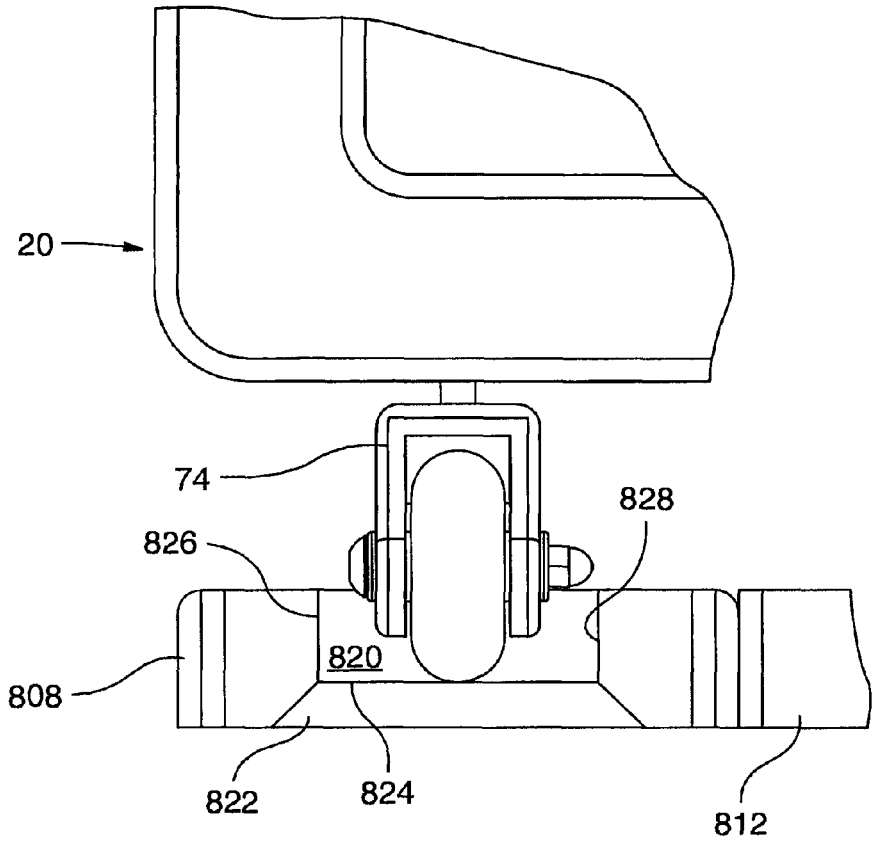
FIG. 32 is an enlarged, partial front elevation view of the rack member illustrated in FIG. 28, showing one of the castors of the apparatus frame received within a slot defined in the first side support member of the rack frame.

Referring now to FIGS. 28, 29 and 32, there is shown a storage rack 80 which is configured to hold one or more isometric exercise apparatus 20 in the out-of-use, storage position 253. The rack 80 has a frame 802 which includes a base 804 and a support structure 806 carried on the base 804. The base 804 has a pair of spaced apart structural side members 808 and 810 which are joined to each other by a relatively thin, tie member 812 and a more substantial cross member 814.

Each structural side member 808, 810 extends between a first end 816 and an opposed second end 818. Formed in each structural side member 808, 810 starting at the first end 816 and extending toward the second end 818, is an elongate channel 820. However, the channel 820 does not extend all the way to the second end 818. At a location closer to the second end 818 than to the first end 816, the channel 820 is closed off by an abutment face 822. As will be explained in greater detail below, the elongate channel 820 acts a guide means for directing and retaining the castors 72 and 74 of the apparatus 20, as the apparatus 20 is placed on the storage rack 800. A tapered throat 822 (widest at the outermost edge and narrowing in the direction of the second end 818) provides access to the channel 820 and tends to facilitate insertion of the castors 72 and 74 into the channel 820. As best shown in FIG. 32, the channel 820 itself is defined by a back portion 824 and a pair of spaced apart legs 826 and 828 which are joined to, and stand proud of, the back portion 824.

The tie member 812 is mounted to the first and second structural side members 808 and 810 at locations closer to the first ends 816 than to the second ends 818 thereof. In this embodiment, the tie member 812 is provided with front and rear flange portions 830 at either end for placement against the inner vertical faces 831 of the structural side members 808 and 810. Fasteners 832 attach the flange portions 830 to the structural side members 808 and 810. In an alternative embodiment, the tie member 812 could be secured to the structural side member 808 and 810 by welding.

The cross-member 814 is disposed between the structural side members 808 and 810 adjacent the second ends 818 thereof. The cross-member 814 has at each end a pair of front and rear flange portions or tabs 834. In like fashion to the flange portions 830, the flange portions 834 are placed against the inner vertical faces 831 of the structural side members 808 and 810 and secured in place by fasteners 836.

The support structure 806 includes a pair of spaced apart, first and second, tubular support arms 82 and 84 and a transverse reinforcement member 844 connecting the support arms 82 and 84 to each other. The reinforcement member 844 is attached to the support arms 82 and 84 by fasteners 845. However, in other embodiments, the reinforcement member could be welded to the support arms.

Each support arm 82, 84 has a proximal end 844 provided with a circular flange portion 846 and a distal or free end 848. The circular flange portion 846 abuts the top face 850 of the cross-member 814 and is secured in place by fasteners 852. In other embodiments, the support arms could be welded to the base. Each support arm 82, 84 further includes a first vertically extending portion 854 which runs from the first end 844 to a transition zone or bend 856, and a second horizontally extending portion 858 which runs from the bend 856 to the free end 846. The reinforcement member 844 is secured to the first vertically extending portions 854 at a location closer to the bend 856 than to the first end 844.

As best shown in FIG. 29, the second horizontally extending portion 854 extends perpendicular to the first vertically extending portion 854 and runs parallel to the structural side members 808 and 810 and in the direction of the first ends 816 thereof. The second horizontally extending portion 854 is carried above the base 804 at a height sufficient to accommodate the width $W_1$ of base 24. The diameter of each second horizontally extending portion 854 is sized slightly smaller than the first and second bores 76 and 78 defined in the base 24 of the isometric exercise apparatus 20.

A pair of aligned bores 862 are defined in the second horizontally extending portion 854 adjacent the free end 846. The bores 862 are configured to accommodate a generally T-shaped locking pin 864.

Figure 30:
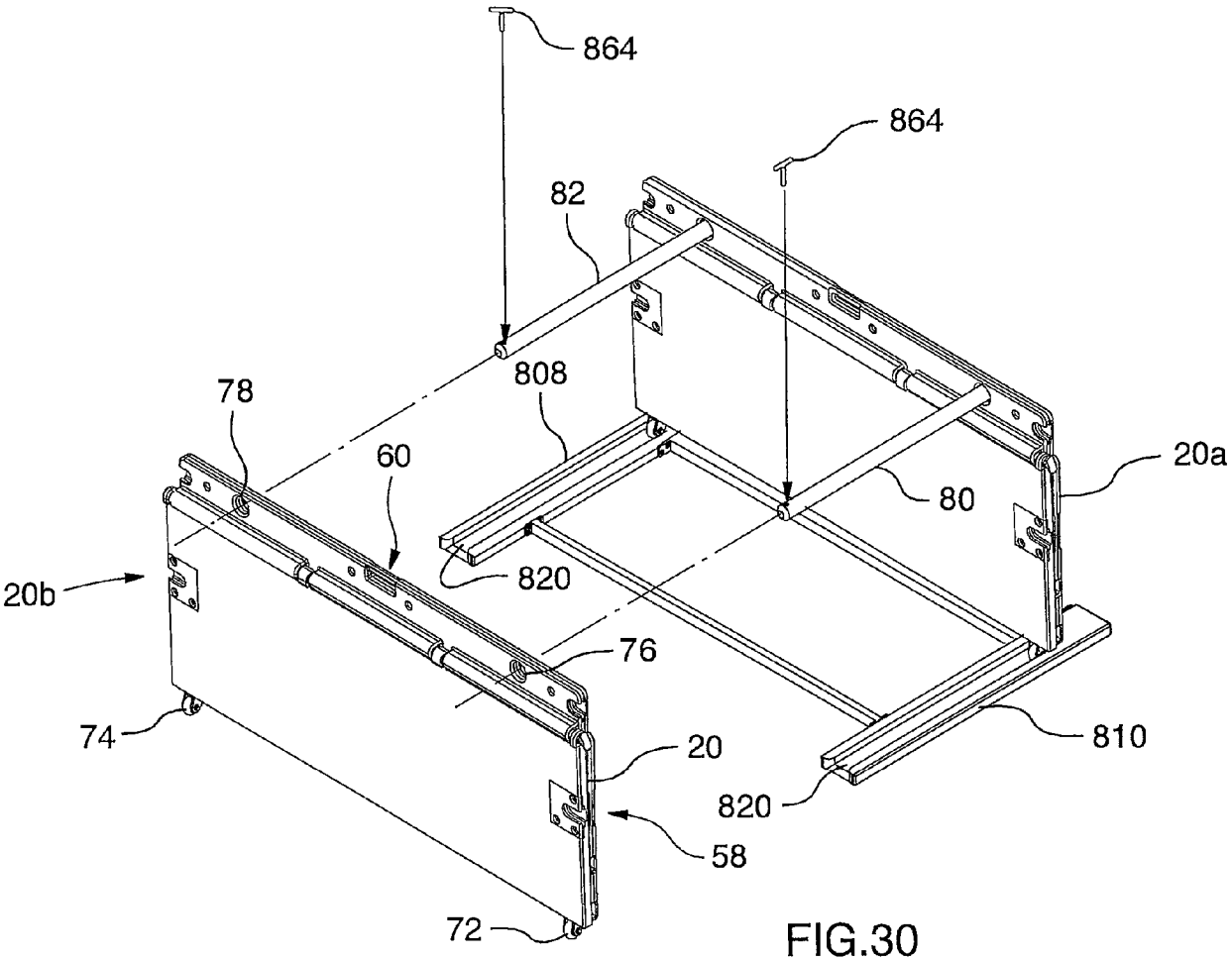
FIG. 30 is a partially exploded perspective view of the rack member shown in FIG. 28 with an isometric exercise apparatus in its out-of use storage configuration, in the midst of being mounted onto the rack member.

Placement of the apparatus 20 onto the storage rack 80 is now described in greater detail with reference to FIGS. 30 and 31. As a preliminary step, the locking pins 864 are disengaged from the support arms 80 and 82. Then grasping the handles 56 and 60, the user lifts the apparatus 20 and aligns the bores 76 and 78 with the second horizontally extending portions 858 and ensures that the castors 72 and 74 are in alignment with the channels 820 of the structural side members 808 and 810. The second horizontally extending portions 858 are then inserted into the bores 76 and 78, and the apparatus 20 (now suspended from the support arms 82 and 84) is urged to travel toward the rear of the support rack 80 (i.e. toward the vertically extending portions 854). The displacement of the apparatus 20 along the support arms 82 and 84 is guided in part by the engagement of the castors 72 and 74 within the channels 820. Adjacent the bend 856, further movement of the apparatus 20 along the support arms 82 and 84 is arrested by the vertically extending portions 854 and the abutment faces 822 of the structural side members 808 and 810. To ensure, the stowed apparatus 20 does not accidentally disengage from the support rack 80, the locking pins 864 are put in place.

Figure 31:
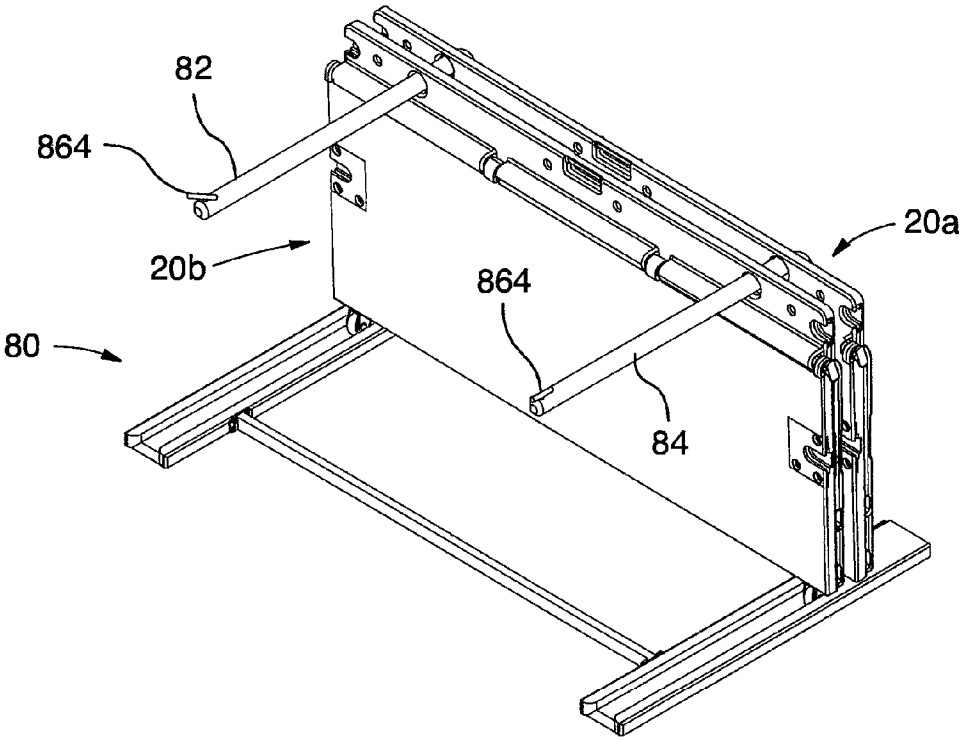
FIG. 31 is a perspective view of the rack member shown in FIG. 28 with an isometric exercise apparatus mounted thereon for storage.

In FIG. 31, the support rack 80 is shown holding two isometric exercise apparatuses 20*a* and 20*b*. But, the support rack 80 of this embodiment is configured to hold ten isometric exercise apparatus placed one after the other. This need not be the case in every application. In other embodiments, the support rack may be configured to hold a greater or lesser number of apparatus. If the apparatus 20 is destined for home use, the support rack may be configured to hold a single unit.

Figure 33:
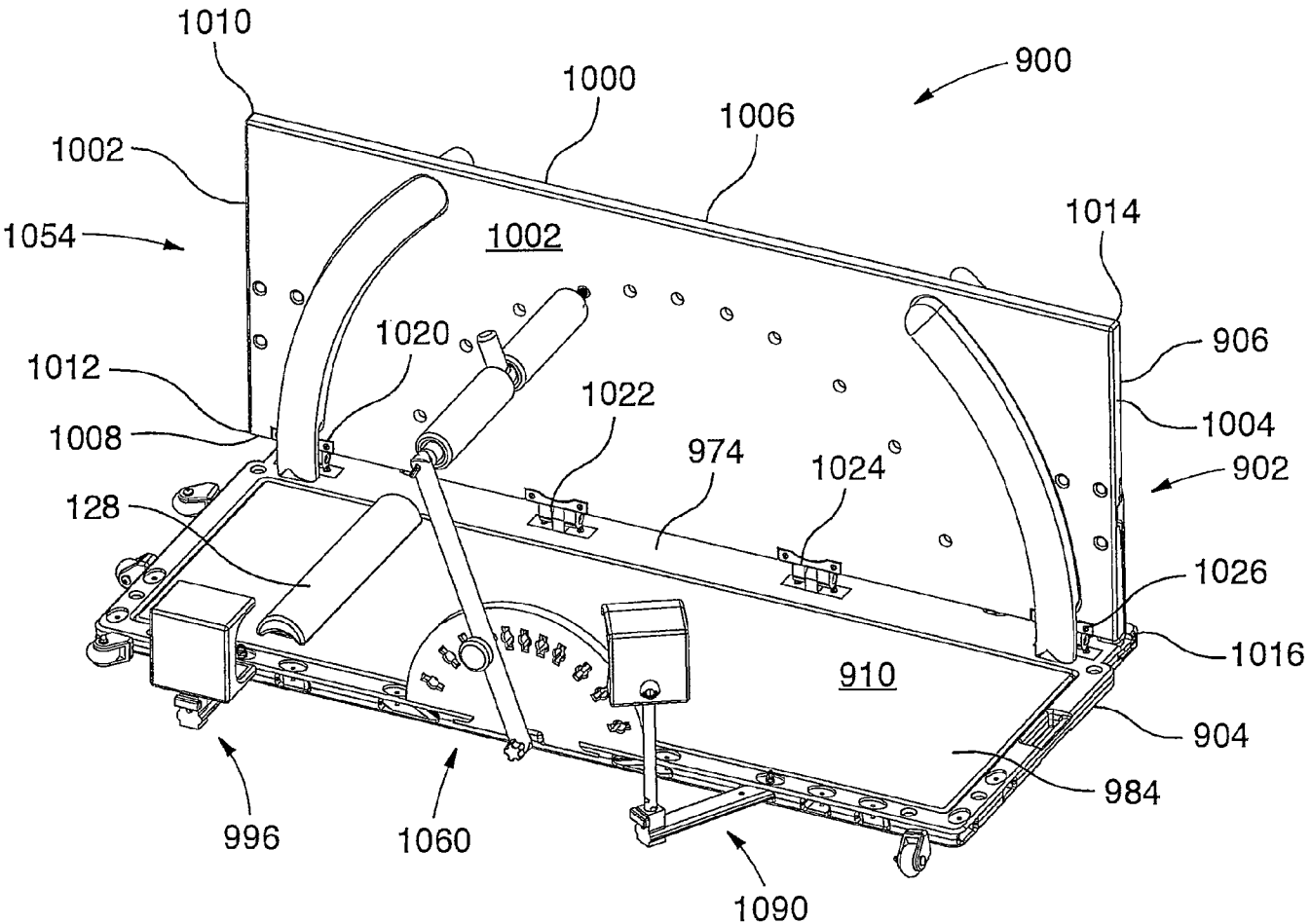
FIG. 33 is a front left perspective view of an alternative embodiment to that illustrated in FIG. 1, showing an isometric exercise apparatus depicted in a deployable, ready-to use configuration, with the sidewall of the apparatus frame shown in an upstanding position relative to the base of the apparatus frame.
Figure 34:
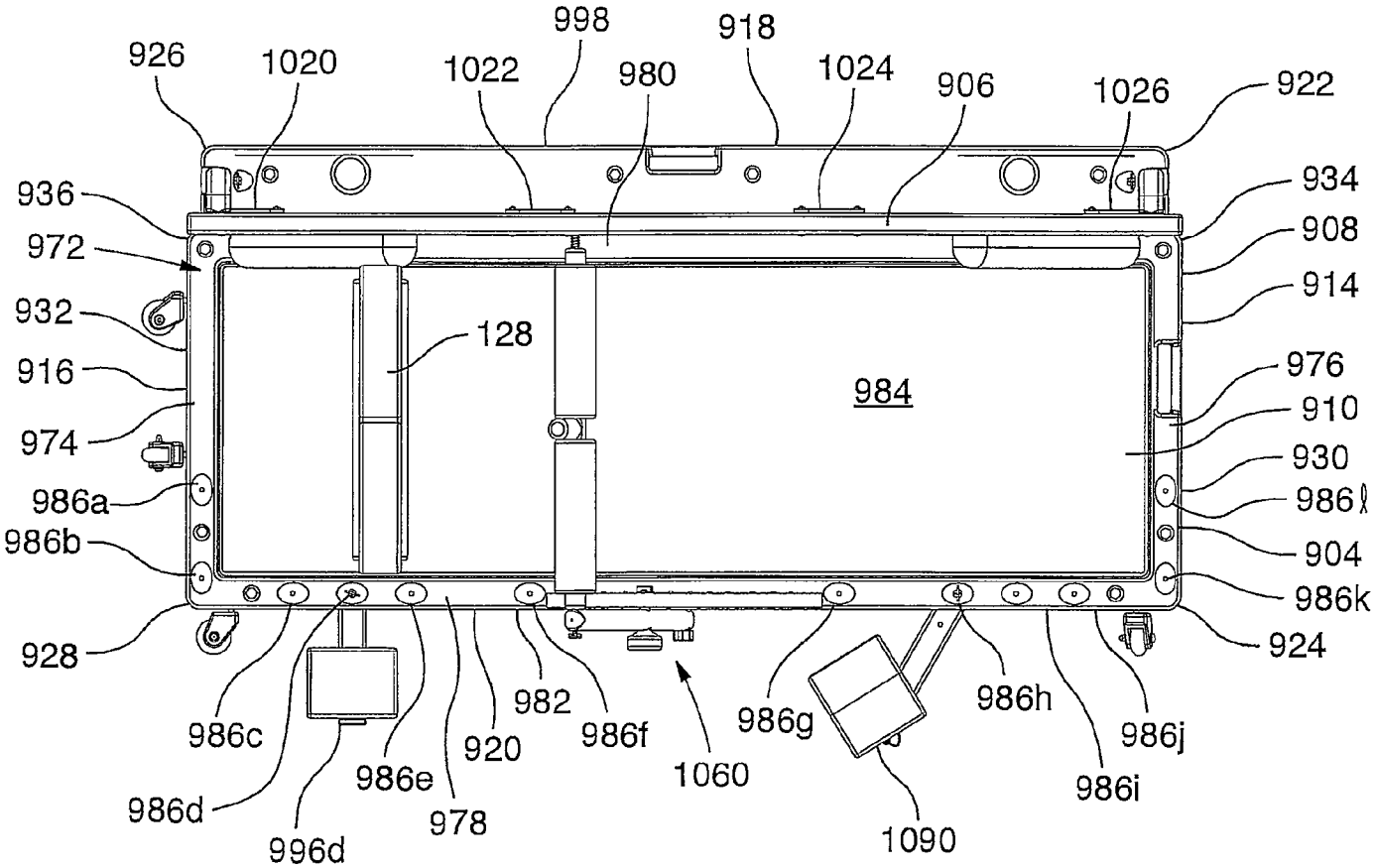
FIG. 34 is a top plan view of the isometric exercise apparatus illustrated in FIG. 33.
Figure 35:
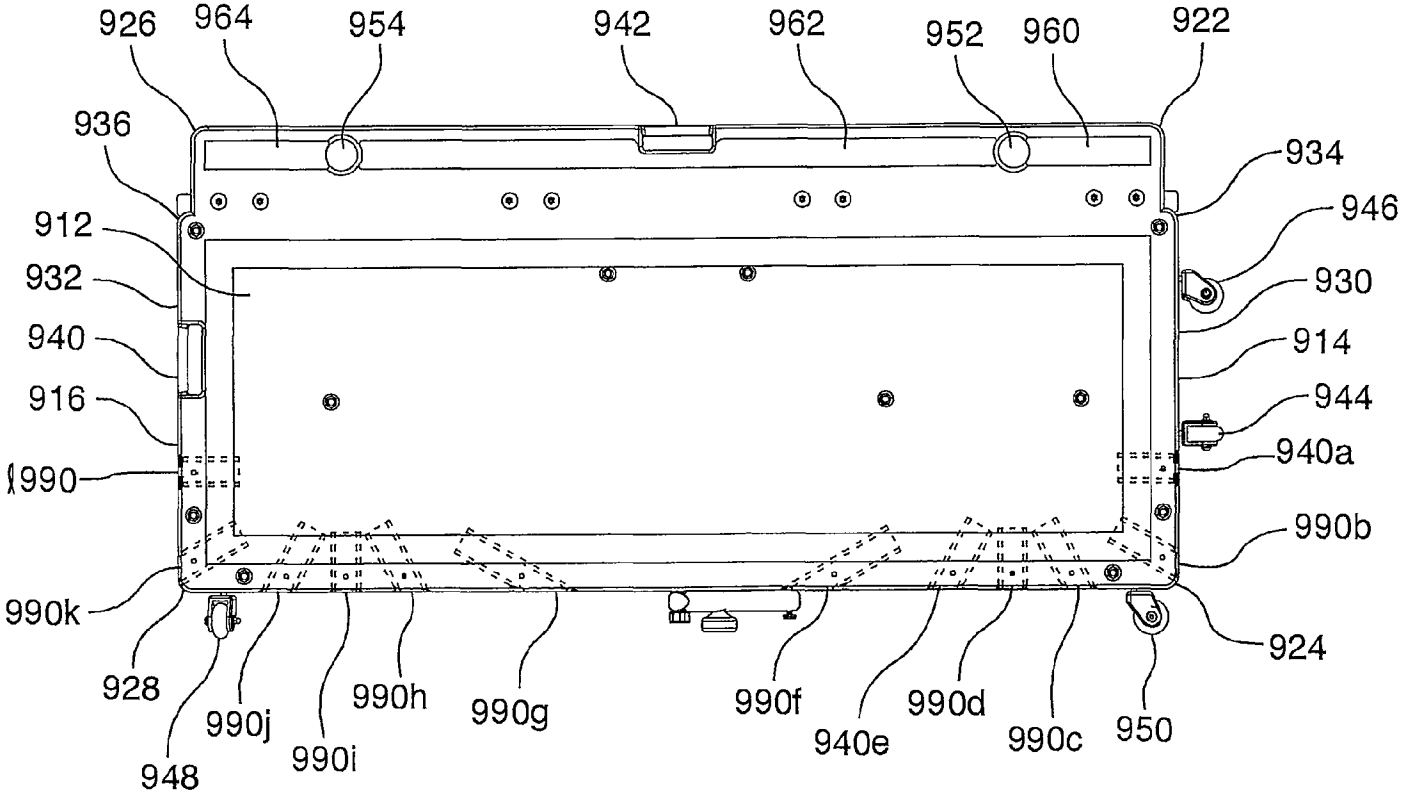
FIG. 35 is a bottom plan view of the base panel shown in FIG. 33 taken in isolation, with the plurality of motion restraint accessories omitted for clarity and a plurality of slots cut into the base shown in dashed lines.

Referring to FIGS. 33 to 35, there is shown an alternate isometric exercise apparatus generally designated with reference numeral 900. The apparatus 900 is generally similar to apparatus 20 in both structure and functionality. Like the apparatus 20, the apparatus 900 possesses a frame 902 which includes a base 904 and a sidewall 906 hingedly connected to the base 24 along a portion thereof. However, the hinge connection used in apparatus 900 is different than that used in apparatus 20. Similarly, much like the base 24 of apparatus 20, the base 904 is configured to receive motion restraint attachments or accessories. However, the manner in which some of these accessories or attachments are attached to the base 904 differs from that used to secure similar attachments to the base 24. These design modifications are described in greater detail below.

The base 904 includes a substantially rectangular panel 908 provided with a top face 910 (see FIG. 34) and an opposed bottom face 912 (see FIG. 35). As best shown in FIG. 35, the shape of the panel 908 is defined by a pair of opposed, relatively short first and second sides 914 and 916, and a pair of opposed, relatively long, first and second sides 918 and 920 extending between the short sides 914 and 916. The first short side 914 meets the first long side 918 at a first radiused corner 922, and joins the second long side 916 at a second radiused corner 924. The two remaining corners of the panel 908—third and fourth radiused corners 926 and 928—are formed by the juncture of the second short side 920 and each of the first and second long sides 918 and 920, respectively. At a location approximately four-fifths of the way between the first and second long sides 918 and 920 proximate the first and third corners 926 and 928, the outer edges 930 and 932 of the first and second short sides 914 and 916 come in a short distance toward each other to define shoulder portions 934 and 936. Beyond the shoulder portions 934 and 936, the outer edges 930 and 932 are parallel to each other as they extend toward their respective corners 922 and 926.

In like fashion to the panel 27, the panel 908 is also provided with first and second handles 940 and 942 which are generally similar in structure and location to the handles 58 and 60 defined in the panel 27 and castors 944, 946, 948 and 950 which correspond generally to castors 66, 68, 72 and 74, respectively. Bores 952 and 954 resembling bores 76 and 78 in size and location are defined in the panel 27. The isometric exercise apparatus 900 can be hung onto the support arms 82 and 84 of the rack 80 from the bores 952 and 954.

As shown in FIG. 35, the bottom face 912 is provided with several grip-enhancing bands or strips 960, 962, 964 and 966. These bands are generally similar in shape to bands 90, 92, 94 and 96 and are disposed on the bottom face 912 in a similar arrangement to that shown in FIG. 7.

Referring now to FIGS. 33 and 34, the top face 28 has a rectangular station 970 formed therein. The boundaries of the station 970 are delimited by a frame 972 having margins 974, 976, 978 and 980. Each margin 974, 976, 978 extends outwardly toward a corresponding outer edge 930, 932, 982, respectively. Secured within the station 970 is an exercise platform 984 which supports the user's body while he/she is performing exercises using the isometric exercise apparatus 900. The exercise platform 984 is similar to the exercise platform 122 shown in FIG. 3 in all other respects.

In contrast to the panel 27 shown in FIG. 2, the panel 908 depicted in FIG. 33 does not have any hinge tubes. As explained in greater detail below, in this alternate embodiment, the hinge connection is formed with four hinge assemblies 1020, 1022, 1024 and 1026.

Figure 37:
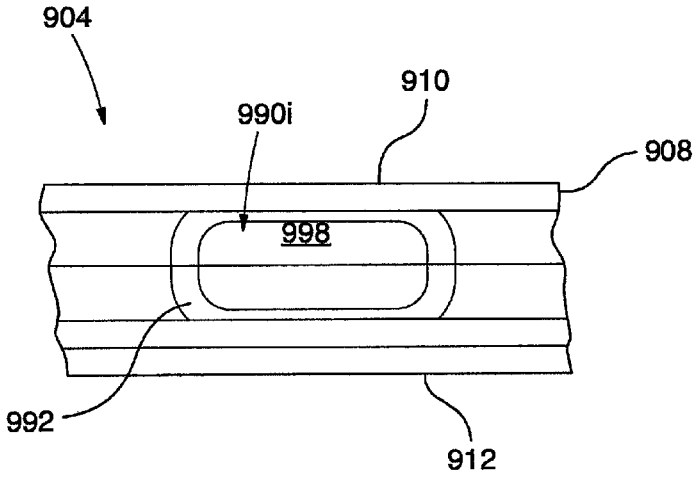
FIG. 37 is an enlarged, isolated front elevation view of one of the slots defined in one of the outer edges of the base panel shown in FIG. 33.

Referring now to FIGS. 33 and 35, a plurality of slots generically identified with reference numeral 990 extends from the outer edges 930, 932 and 982 into the panel 908 and toward the station 970. As will be explained in greater detail below, the slots 990 are adapted to receive a connector arm of an accessory of the isometric exercise apparatus 900 (as shown in FIG. 37). The slots 990 include twelve slots 990*a*, 990*b*, 990*c*, 990*d*, 990*e*, 990*f*, 990*g*, 990*h*, 990*i*, 990*j*, 990*k* and 9901, disposed at different locations along the sides 914, 916 and 918 and having different orientations relative to their corresponding outer edges 930, 932 and 982. The relative position and orientation of each slot 990*a*, 990*b*, 990*c*, 990*d*, 990*e*, 990*f*, 990*g*, 990*h*, 990*i*, 990*j*, 990*k*, 9901 substantially matches that of each corresponding slot 150*a*, 150*b*, 150*c*, 150*d*, 150*e*, 150*f*, 150*g*, 150*h*, 150*i*, 150*j*, 150*k* and 150*l* shown in FIG. 7.

Figure 36:
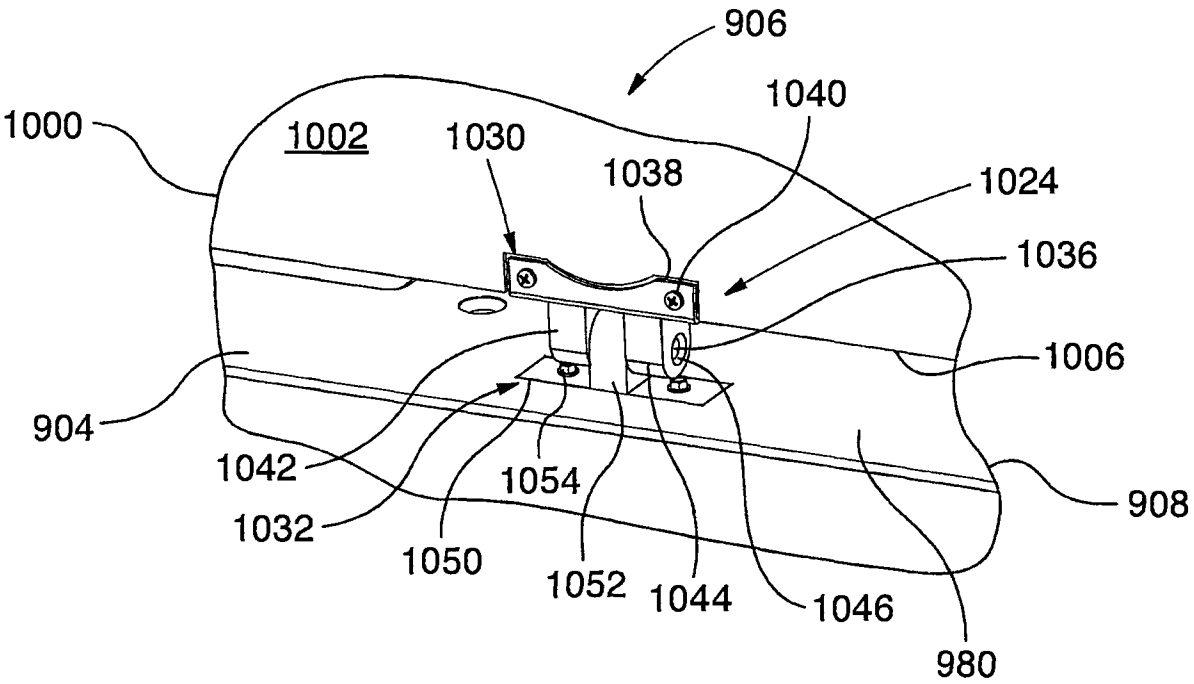
FIG. 36 is an enlarged partial perspective view of the isometric exercise apparatus illustrated in FIG. 33, showing the base panel hingedly connected to the sidewall panel by a hinge assembly.

But for differences arising from their varying orientations, the slots 990 all have a generally similar structure, such that a description of one representative slot—slot 990*d*—will suffice for the others. Referring now to FIG. 36, slot 990*d* is generally similar to slot 150*i* in that it too has a tapered throat 992 (widest at the outer edge 930 and narrowing in the direction of the slot) which tends to serve as a guide for locating the connector arm 994 of the arm restraint attachment 996*d* into the slot 990*d*. The throat 992 opens onto a relatively large central opening 998 whose profile is generally oblong. However, in contrast to the slot 150*i*, the slot 990*d* is not bounded on either side by C-shaped channels and is not configured with any locking recesses.

Disposed along the margins 974, 976 and 978 at locations corresponding to each slot 990, are a plurality of circular rebates generically identified with reference numeral 986 that are defined into the top face 910 of the panel 908. More specifically, there are twelve rebates 986*a*, 986*b*, 986*c*, 986*d*, 986*e*, 986*f*, 986*g*, 986*h*, 986*i*, 986*j*, 986*k* and 9861. At the center of each rebate 986 is an aperture 988 which opens onto an associated slot 990. As explained in greater detail below, each aperture 988 is sized to receive a locking pin 999 to secure the connecting arm 994 of an arm restraint attachment 996 into a slot 990.

Referring now to FIG. 33, the sidewall 906 is now described in greater detail. The sidewall 906 is generally similar to sidewall 26 in that it also includes a substantially rectangular panel 1000 provided with a first face 1002 (see FIG. 33) and an opposed second face (not shown). The shape of the panel 1000 is defined by a pair of opposed, relatively short first and second sides 1002 and 1004, and a pair of opposed, relatively long, first and second sides 1006 and 1008 extending between the short sides 1002 and 1004. The first short side 1002 meets the first long side 1006 at a first corner 1010, and joins the second long side 1008 at a second corner 1012. The two remaining corners of the panel 1000—third and fourth corners 1014 and 1016—are formed by the juncture of the second short side 1004 and each of the first and second long sides 1006 and 1008, respectively.

In contrast to panel 212 shown in FIG. 2, the panel 1000 depicted in FIG. 33 does not have any hinge knuckles welded to its outer edge. Instead, the panel 1000 of the sidewall 906 is hingedly connected to the panel 908 of the base 904 with spaced apart, first, second, third and fourth hinge assemblies 1020, 1022, 1024 and 1026. The hinge assemblies 1020, 1022, 1024 and 1026 are oriented generally parallel to the outer edges 982 and 998 and are disposed in the region which lies between the margin 980 and the outer edge 998. The second and third hinge assemblies 1022 and 1024 are disposed between the first and fourth hinge assemblies 1020 and 1026.

Referring now to FIG. 36, each hinge assembly 1020, 1022, 1024 and 1026 includes a first hinge bracket 1030, a second hinge bracket 1032 engageable with a portion of the first hinge bracket 1034, and a hinge pin 1036 for securing engagement of the first hinge bracket 1032 to the second hinge bracket 1034. The first hinge bracket 1030 includes a base plate 1036 and a pair of spaced mounting tabs 1038 standing proud of the base plate 1036. The mounting tabs 1038 and the base plate 1036 co-operate with each other to define a channel (not visible) which is sized to receive therein a portion of the first long side 1006 of the panel 1000. The first hinge bracket 1032 is secured to the panel 1000 by a pair of fasteners 1040 extending through each mounting tab 1038 and the first and second faces of the panel 1000. Extending away from the base plate 1036 opposite to the mounting tabs 1038, are a pair of spaced apart hinge knuckles 1042 and 1044. Each hinge knuckle 1042, 1044 has an aperture 1046 defined therein sized to receive a portion of the hinge pin 1036.

The second hinge bracket 1034 includes a base plate 1050 and a single hinge knuckle 1052 standing proud of the base plate 1050. The base plate 1050 is secured to the top face 910 of the base panel 908 by fasteners 1054. When first hinge bracket 1032 is engaged with the second hinge bracket 1034, the hinge knuckle 1052 is positioned between the hinge knuckles 1042 and 1044 with the aperture (not shown) defined in the hinge knuckle 1052 aligned with the apertures 1046 defined in the hinge knuckles 1042 and 1044 and the hinge pin 1036 inserted therethrough.

Thus formed, the hinge connection between the base 904 and the sidewall allows the sidewall 906 to be moved between a collapsed position (not shown) and an upstanding position 1054 (shown in FIGS. 33 and 34). The apparatus 900 of this embodiment employs a similar arrangement of side locking bars and receiving stations to those employed in apparatus 20 to maintain the sidewall 906 in the upstanding position 1054. When the sidewall 906 is moved to its collapsed position the first face 1002 of the sidewall 906 is brought opposite the top face 910 of the base 904 and the apparatus 900 is now in its out-of-use, storage position.

Except as set out above, the panel 1000 of the sidewall 906 is otherwise configured similar to the panel 212 of the sidewall 27 is all respects.

Along the same vein, the apparatus 900 is provided with a support or restraint arm assembly 1060 which is similar to the support arm assembly 330 employed by the apparatus 20 in all respects including structure and functionality, such that no additional description is required.

Much like the apparatus 20, the apparatus 900 can be used with a plurality of attachments or accessories for enhanced versatility and comfort. Examples of such attachments are the third arm restraint attachment 996 shown in FIGS. 38 and 39 and the fourth arm restraint attachment 1090 shown in FIGS. 40 and 41, the footpad 128 and the dual foot restraint accessory 132. Of course, the apparatus 900 could be employed with other attachments as well.

Figure 38:
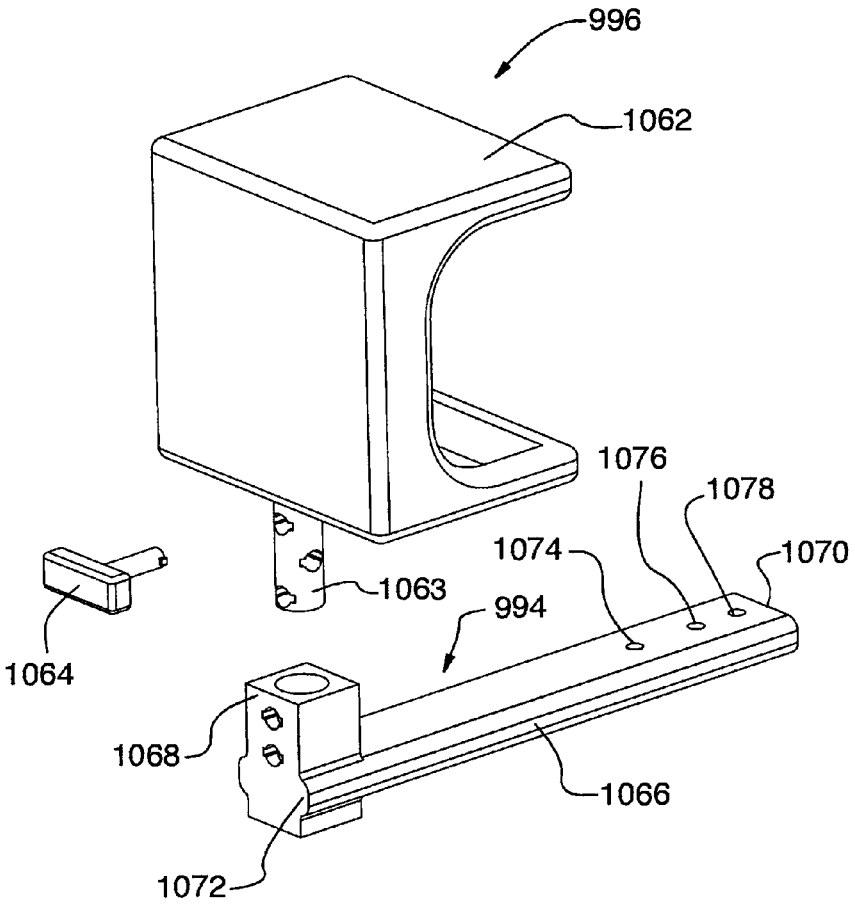
FIG. 38 is an exploded perspective view of one of the arm restraint attachments shown in FIG. 33.
Figure 39:
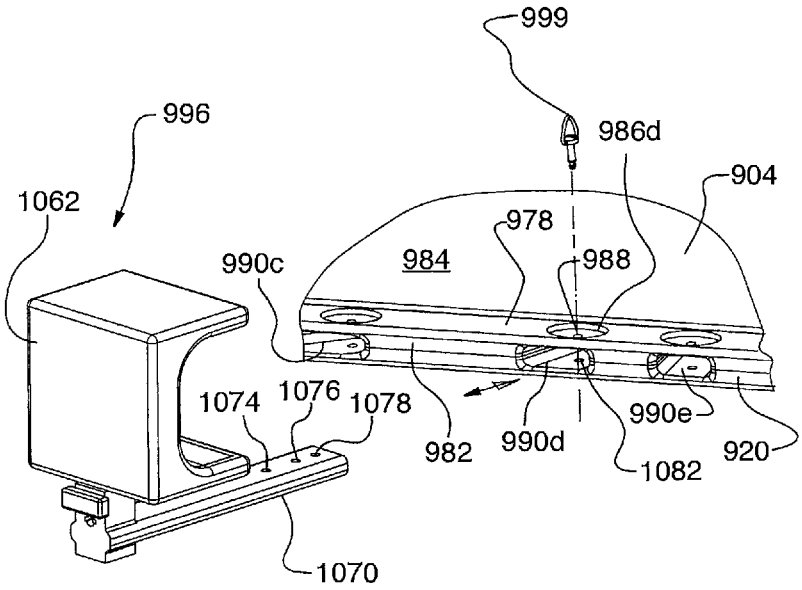
FIG. 39 is a partial perspective view of the base panel illustrated in FIG. 33 showing the arm restraint attachment depicted in FIG. 38 and its locking pin shown exploded from the base panel.

Referring now to FIG. 38, there is shown the third arm restraint attachment 996. The attachment 996 is generally similar to attachment 152 in that it includes the connector arm 994 for attaching the arm restraint attachment 996 to the base 904, a sleeve or retaining member 1062 releasably connected to the connector arm 994 and a locking key 1064 similar to locking key 444 for securing the retaining member 1062 to the connector arm 994. However, in contrast to the retaining member 442 which is generally U-shaped, the retaining member 1062 in this embodiment is generally C-shaped and resembles alternate retaining member 520 shown in FIG. 13*e* in all respects. The connector pin 1063 of the retaining member 1062 is configured for insertion into the socket member 1068 of the connector arm 994 and is adapted to interact with the locking key 1064 in much the same manner as the male connector pin 462 shown in FIG. 14*b* engages the socket 460 and interacts with locking key 444, such that no additional description is required.

The connector arm 994 is generally similar to the connector arm 154 in that it too is formed with a bar 1066 having upstanding socket member 1068 integrally formed therewith. The bar 1066 has a first end 1070 adapted for insertion into a slot 990 and a second end 1072 which carries the socket member 1068. However, unlike the bar 446, the bar 1066 does not have any locking pins projecting from the lateral edges of the first end 1070. Additionally, adjacent the first end 1070, the bar 1066 has three bores 1074, 1076 and 1078 extending between the top and bottom faces of the bar 1066. Except as described above, the connector arm 994 is otherwise similar to the connector arm 154 in all respects, such that no additional description is required.

It will be appreciated by a person skilled in the art that the attachment 996 is attached to the base 904 in a different manner than that employed by the attachment 152 of the apparatus 20. With specific reference to FIG. 39, to secure the arm restraint attachment 996 to the base 904, the first end 1070 of the connector arm 994 is inserted into a slot 990 and one of the bores 1074, 1076 and 1078 is aligned with the apertures 988 and 1080 defined in the base 904. Thereafter, a locking pin 999 is inserted through the aligned bore 1074, 1076 or 1078 and apertures 988 and 1082 to thereby fix the attachment 996 in place.

The arm restraint attachment 1090 is now described with reference to FIGS. 40 and 41. The attachment 1090 includes a connector arm 1092, an extension rod 1094 releasably connected to the connector arm 1092, a locking key 1095 for securing the lower end 1096 of the extension rod 1094 to the connector arm 1092, a retaining member 1098 releasably connected to the upper end 1100 of the extension rod 1094, and a locking pin 1102 for securing the upper end 1100 of the extension rod 1094 to the retaining member 1098. The connector arm 1092 is similar to the connector arm 994 in all respects such that no further description is required.

Turning now to the extension rod 1094, it has a generally cylindrical body 1104 that extends between the upper and lower ends 1100 and 1096. The lower end 1096 is configured similarly to the male connector pin 462 shown in FIG. 13*c* in that it too is provided with three indexing openings 1106, 1108 and 1110 cut into the body 1104 at spaced apart locations. The first indexing opening 1106 is located closest to the upper end 1100. The second indexing opening 1108 is disposed relatively lower on the body 1104 than the opening 1106, while the third indexing opening 1110 is located furthest from the upper end 1098 close to the lower end extremity 1112. The indexing openings 1106, 1108 and 1110 are not all aligned with each other along a common vertical axis—some are radially staggered from each other. More specifically, the first and third indexing openings 1106 and 1110 are vertically aligned with each other, but are radial staggered from the second opening 1108 by an angle of 90 degrees. The lower end 1096 is configured for insertion into the socket 1114 and is adapted to interact with the locking key 1095 in much the same manner as the male connector pin 462 shown in FIG. 14*b* engages the socket 460 and interacts with locking key 444, such that no additional description is required.

A short distance down from the upper end 1100, the body 1104 has a notch or groove 1120 defined therein. When the extension rod 1094 is inserted into the blind bore 1122 of the retaining member 1098 (shown in FIG. 41), the notch 1120 is alignable with an aperture 1124 defined in the back face 1126 of the retaining member 1098. To secure the retaining member 1098 to the extension rod 1094, the locking pin 1102 is inserted through the aperture 1124 and engages the notch 1120.

In this embodiment, the extension rod 1094 measures approximately 12 inches. In other embodiments, the length of the rod could be modified to suit a particular application.

Figure 40:
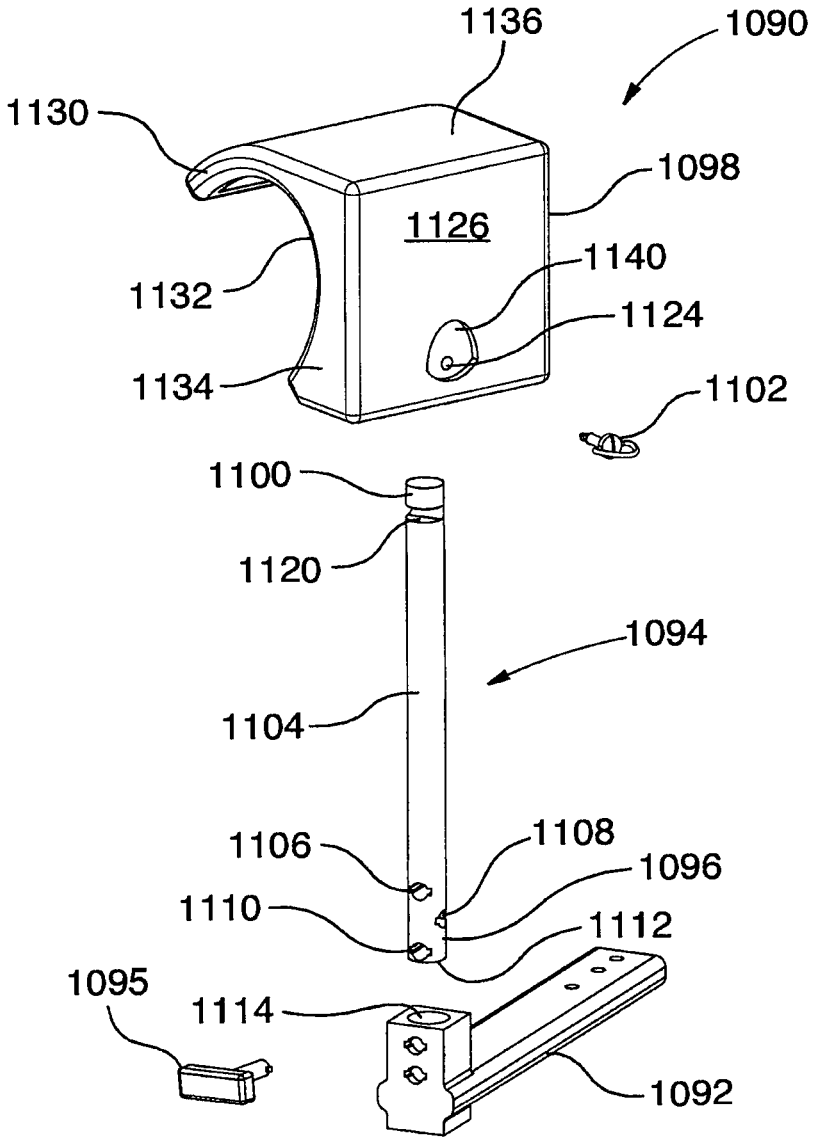
FIG. 40 is an exploded perspective view of the other arm restraint attachment shown in FIG. 33.
Figure 41:
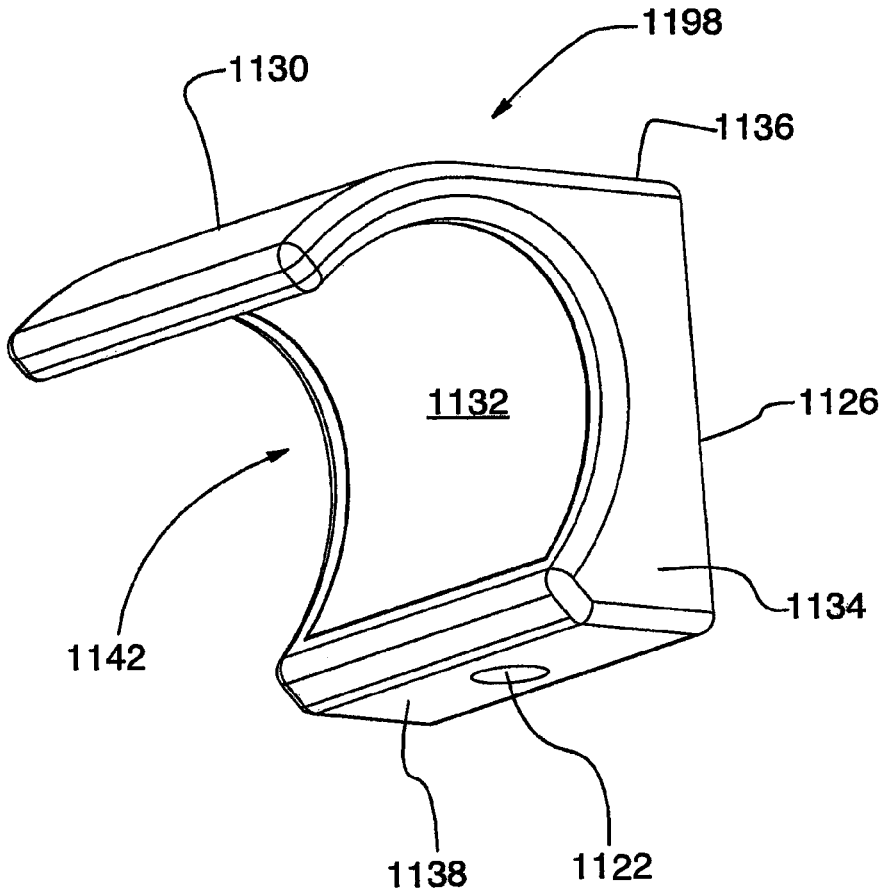
FIG. 41 is an isolated perspective view of the retaining member of the other arm restraint attachment shown in FIG. 33.

Referring to FIGS. 40 to 41, the retaining member 1098 is now described in greater detail. The retaining member 1098 has a body 1130 defined by back face 1126, an opposed arcuate face 1132, a pair of lateral faces 1134 extending between the back face 1126 and the arcuate face 1132, a top face 1136 and an opposed bottom face 1138. The back face 1126 is generally square and has a fingerprint-shaped rebate 1140 defined therein at a location closer to the bottom face 1138 than to the top face 1136. The aperture 1124 is formed within the rebate 1140. Similarly, the bore 1122 is defined into the bottom face 1138.

The arcuate face 1132 defines a partial or open cuff 1142 which is sized to receive a portion of user's arm. The cuff 1142 acts as a restraint to prevent movement of the user's arm during the performance of an isometric exercise. In particular, it may be used advantageously to resist or restrain movements that have vertical force components. Additionally, the provision of extension rod 1094 further enhances the versatility of the apparatus 900 by enabling the user to perform isometric exercises that target different joint angles and muscles than those which would have otherwise been targeted using the arm restraint attachments 152, 540 and 996.

It should be appreciated that the extension rod 1094 and retaining member 1098 could be used to equal advantage with the connector arm 154 shown in FIG. 13*c*.

Figure 42:
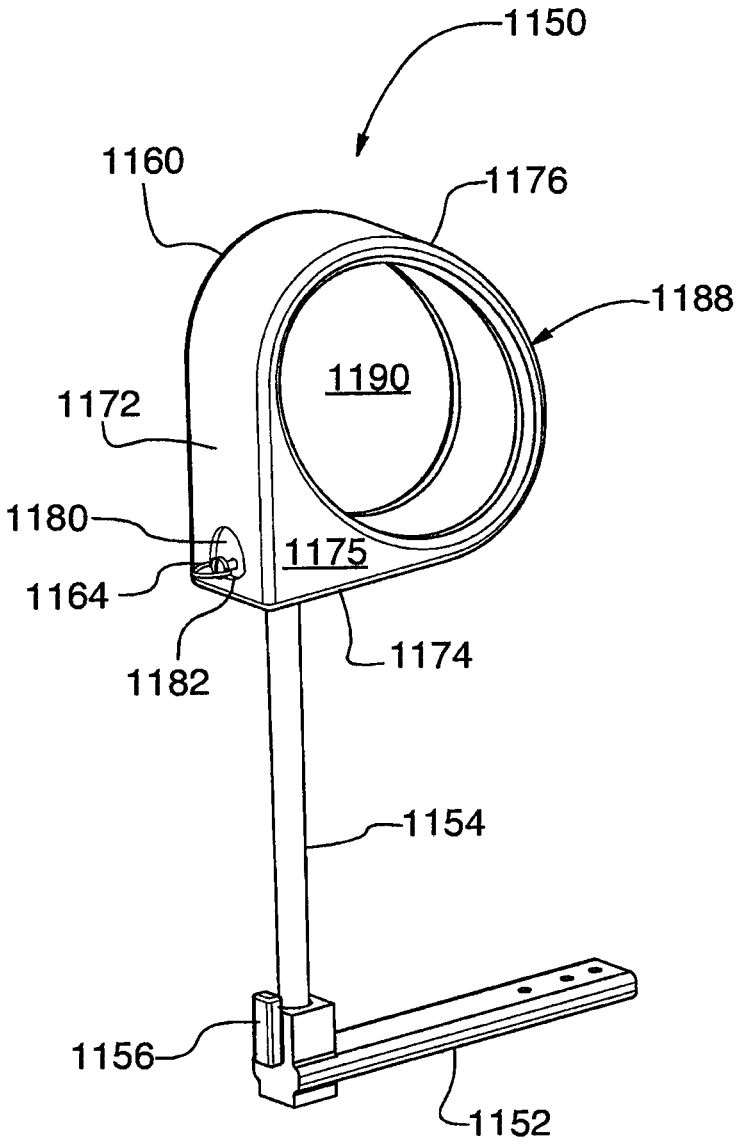
FIG. 42 is a perspective view of an alternate arm restraint attachment to that shown in FIG. 38.

FIG. 42 shows yet another arm restraint attachment designated generally with reference numeral 1150. The attachment 1150 includes a connector arm 1152, an extension rod 1154 releasably connected to the connector arm 1152, a locking key 1156 for securing the lower end of the extension rod 1154 to the connector arm 1152, a retaining member 1160 releasably connected to the upper end of the extension rod 1154, and a locking pin 1164 for securing the upper end of the extension rod 1154 to the retaining member 1160. The connector arm 1152, the extension rod 1154 and the locking key 1156 are similar to their counterpart elements 1092, 1094, 1095 in all respects such that no further description is required.

Figure 43:
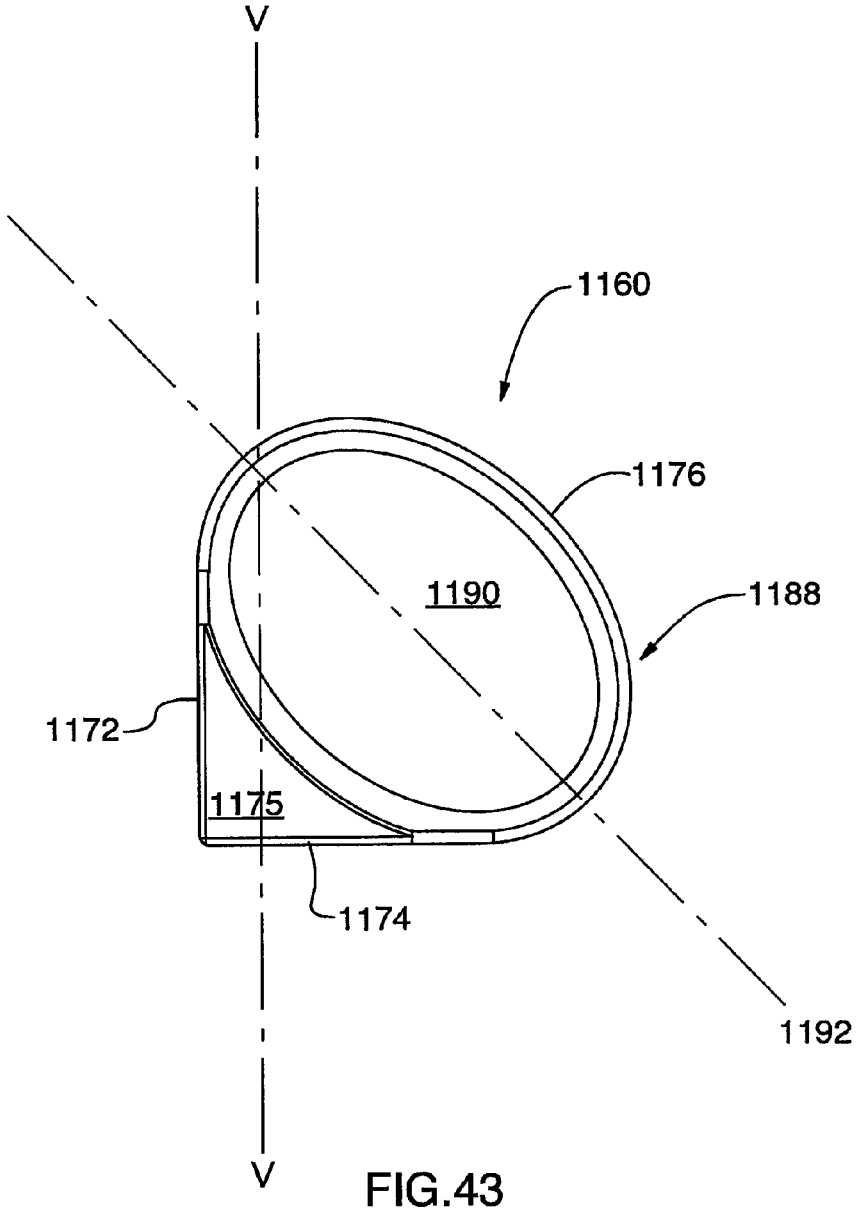
FIG. 43 is an isolated perspective view of the retaining member of the alternate arm restraint attachment shown in FIG. 42.

Referring now to FIG. 43, the retaining member 1160 has a body 1170 defined by a back wall 1172, a bottom wall 1174, an arcuate wall 1176 joining the back wall 1172 and the bottom wall 1174, and a pair of lateral faces 1175 defined by edges of the back wall 1172, the bottom wall 1174 and the arcuate wall 1176. The back face 1172 is generally rectangular and has a fingerprint-shaped rebate 1180 defined therein at a location closer to the bottom wall 1174 than to the juncture of the back wall 1172 and the arcuate wall 1176. An aperture 1182 is formed within the rebate 1180. Similarly, a bore (not visible) for receiving the upper end of the extension rod 1154 is defined into the bottom wall 1174.

The arcuate wall 1176 and the interior face 1186 cooperate with each other to form a closed cuff 1188 which bounds a generally oval-shaped opening 1190. The opening 1190 is sized to receive a portion of the user's arm. The cuff 1188 acts as a restraint to prevent movement of the user's arm during the performance of an isometric exercise. In particular, it may be used advantageously to resist or restrain movements that have vertical force components. For enhanced versatility, the oval opening 1190 is oriented with its long axis 1192 disposed at an angle of 45 degrees from the vertical axis V-V. It will be appreciated that in other embodiments, the orientation of the opening could be modified to suit a particular application. In a further alternative, the shape of the opening could be changed to be circular or elliptical, for instance, or it could be configured with a different geometric shape altogether.

In each of the various arm restraint attachments described above, the retaining member and the connector arm are configured to be detachable from each other. This need not be the case in every application. In an alternate embodiment, the retaining member may be permanently fixed to the connector arm.

A preferred embodiment and several alternative embodiments of the present invention have been described above. However, it should be appreciated that the isometric exercise apparatus could be modified further still in accordance with the principles of the present invention. For instance, in the preferred embodiment, the isometric exercise apparatus 20 is configured for a single user. In an alternative embodiment, the apparatus could be modified by constructing a relatively larger base provided with two side-by-side exercise platforms sharing a common sidewall. In such a case, the common side wall would be provided with foam pads and bores on both of its faces. Each user would perform his/her exercises on his/her respective exercise platform. This modified apparatus could be used, for instance, in an exercise class setting.

Although the foregoing description and accompanying drawings relate to specific preferred embodiments of the present invention as presently contemplated by the inventor, it will be understood that various changes, modifications and adaptations, may be made without departing from the spirit of the invention.

What is claimed is:

1. An apparatus for performing isometric exercises comprising:

a frame having a base and a sidewall joined to the base, the base having an exercise area within which a user's body is positionable; the base having a pair of opposed, first and second, spaced apart sides; the sidewall lying adjacent the first side of the base;

a restraint arm assembly connected to the frame, the restraint assembly including:

a swing arm pivotable relative to the base;

a restraint arm carried by the swing arm and positionable above the exercise area to inhibit movement of a portion of the user's body so as to allow the user to perform isometric exercises; the restraint arm extending across the exercise area between the swing arm and the sidewall;

an indexing assembly disposed adjacent the second side of the base opposite the sidewall for fixing the swing arm in a predetermined angular position selected from a set of discrete angular positions relative to the base; and at least one limb restraint accessory positionable at predetermined locations along the base for inhibiting movement of the user's limb so as to allow the user to perform isometric exercises.

2. The isometric exercise apparatus of claim 1 wherein the base is hingedly connected to the sidewall.

3. The isometric exercise apparatus of claim 2 wherein:

the sidewall is moveable between a first, in-use position and a second, out-of-use position;

when in the first, in-use position, the sidewall is oriented at least substantially perpendicular to the base; and when in the second, out-of use position, the sidewall is collapsed against the base.

4. The isometric exercise apparatus of claim 1 wherein the restraint arm assembly is releasably connected to the frame.

5. The isometric exercise apparatus of claim 1 wherein the indexing assembly includes an indexing plate mounted to the base and an indexing pin releasably engageable with a portion of the indexing plate and a portion of the swing arm to fix the swing arm to the indexing plate.

6. The isometric exercise apparatus of claim 5 wherein:

the indexing plate has a plurality of indexing apertures defined therein, each indexing aperture corresponding to one of the predetermined angular positions;

the swing arm has a first end pivotally connected to the base, a second end attached to the restraint arm and includes at a location intermediate the first and second ends a bore;

the bore of the swing arm being alignable with one of the indexing apertures to allow insertion of the indexing pin therethrough.

7. The isometric apparatus of claim 6 wherein the plurality of indexing apertures are disposed in a semi-circular arrangement along the indexing plate.

8. The isometric exercise apparatus of claim 5 wherein the indexing assembly is provided with locking means to prevent disengagement of the indexing pin from the indexing plate and the swing arm.

9. The isometric exercise apparatus of claim 1 wherein the restraint arm has a first portion attached to the swing arm and a second portion releasably connected to the sidewall.

10. The isometric exercise apparatus of claim 1 wherein:

the sidewall has defined therein a plurality of indexing bores;

each indexing bore corresponds to one of the predetermined angular positions and is configured to receive the second portion of the restraint arm.

11. The isometric exercise apparatus of claim 10 wherein the indexing bores are disposed in a semi-circular arrangement along the sidewall.

12. The isometric exercise apparatus of claim 1 wherein the base includes a plurality of slots defined in the base, each slot being disposed at one of the predetermined locations and configured to receive a portion of the at least one limb restraint accessory therein.

13. The isometric exercise apparatus of claim 12 wherein:

the base has a third side extending between the first and second sides, and a fourth side opposite the third side and extending between the first and second sides; and the plurality of slots includes at least one slot disposed along the first side, at least one slot disposed along the second side and at least one slot disposed along the third side.

14. The isometric exercise apparatus of claim 12 wherein:

the base has a longitudinal axis and a transverse axis perpendicular to the longitudinal axis;

at least some of the slots of the plurality being oriented generally perpendicular to the longitudinal axis of the base.

15. The isometric exercise apparatus of claim 14 wherein at least some of the slots of the plurality are oriented generally perpendicular to the transverse axis of the base.

16. The isometric exercise apparatus of claim 14 wherein at least some of the slots of the plurality are canted relative to the longitudinal axis of the base.

17. The isometric exercise apparatus of claim 12 wherein the at least one limb restraint accessory includes:

a connector arm configured for insertion into one of the plurality of slots; and a retainer member supported by the connector arm for restraining a portion of the user's limb.

18. A kit for an isometric exercise apparatus comprising:

a frame having a base and a sidewall joinable to the base, the base having an exercise area within which a user's body is positionable; the base having a pair of opposed, first and second, spaced apart sides; the sidewall positionable adjacent the first side of the base;

a restraint arm assembly connectable to the frame, the restraint assembly including:

a swing arm mountable for pivoting relative to the base;

a restraint arm mountable to the swing arm and positionable above the exercise area to inhibit movement of a portion of the user's body so as to allow the user to perform isometric exercises; the restraint arm being positionable to extend across the exercise area between the swing arm and the sidewall;

an indexing assembly being positionable adjacent the second side of the base opposite the sidewall for fixing the swing arm in a predetermined angular position selected from a set of discrete angular positions relative to the base; and at least one limb restraint accessory positionable at predetermined locations along the base for inhibiting movement of the user's limb so as to allow the user to perform isometric exercises.

19. A kit for an isometric exercise apparatus and storage rack therefor comprising:

a collapsible frame having a base and a sidewall joinable to the base, the base having an exercise area within which a user's body is positionable; the base having a pair of opposed, first and second, spaced apart sides; the sidewall positionable adjacent the first side of the base;

a restraint arm assembly connectable to the frame, the restraint assembly including:

a swing arm mountable for pivoting relative to the base;

a restraint arm mountable to the swing arm and positionable above the exercise area to inhibit movement of a portion of the user's body so as to allow the user to perform isometric exercises; the restraint arm being positionable to extend across the exercise area between the swing arm and the sidewall;

an indexing assembly being positionable adjacent the second side of the base opposite the sidewall for fixing the swing arm in a predetermined angular position selected from a set of discrete angular positions relative to the base;

at least one limb restraint accessory positionable at predetermined locations along the base for inhibiting movement of the user's limb so as to allow the user to perform isometric exercises; and a rack structure for suspending the frame when in a collapsed state.

* * * * *